US007946340B2

(12) United States Patent
Surjaatmadja et al.

(10) Patent No.: US 7,946,340 B2
(45) **Date of Patent: *May 24, 2011**

(54) METHOD AND APPARATUS FOR ORCHESTRATION OF FRACTURE PLACEMENT FROM A CENTRALIZED WELL FLUID TREATMENT CENTER

(75) Inventors: Jim B. Surjaatmadja, Duncan, OK (US); Matt T. Howell, Duncan, OK (US); Leonard Case, Duncan, OK (US); Lonnie R. Robinson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 147 days.

This patent is subject to a terminal disclaimer.

(21) Appl. No.: 11/873,160

(22) Filed: Oct. 16, 2007

(65) Prior Publication Data

US 2009/0194273 A1 Aug. 6, 2009

Related U.S. Application Data

(63) Continuation-in-part of application No. 11/396,918, filed on Apr. 3, 2006, now abandoned, which is a continuation-in-part of application No. 11/291,496, filed on Dec. 1, 2005, now Pat. No. 7,841,394, said application No. 11/396,918 is a continuation-in-part of application No. 11/545,749, filed on Oct. 10, 2006, and a continuation-in-part of application No. 11/753,314, filed on May 24, 2007.

(51) Int. Cl.
*E21B 49/00* (2006.01)
*G01V 1/40* (2006.01)

(52) U.S. Cl. ..... 166/250.1; 166/52; 166/308.1; 702/11

(58) Field of Classification Search ..... None
See application file for complete search history.

(56) References Cited

U.S. PATENT DOCUMENTS 2,758,653 A 8/1956 Desbrow
(Continued)

FOREIGN PATENT DOCUMENTS

EP 0124251 11/1984
(Continued)

OTHER PUBLICATIONS

Office Action for U.S. Appl. No. 11/353,559 mailed Jan. 23, 2009.
(Continued)

*Primary Examiner* — Zakiya W Bates
*Assistant Examiner* — Angela M DiTrani
(74) *Attorney, Agent, or Firm* — John W. Wustenberg; McDermott, Will & Emery

(57) ABSTRACT

A method and apparatus for orchestrating multiple fractures at multiple well locations in a region by flowing well treatment fluid from a centralized well treatment fluid center includes the steps of configuring a well treatment fluid center for fracturing multiple wells, inducing a fracture at a first well location, measuring effects of stress fields from the first fracture, determining a time delay based in part upon the measured stress effects, inducing a second fracture after the time delay at a second location based upon the measured effects, and measuring the stress effects of stress fields from the second fracture. Sensors disposed about the region are adapted to output effects of the stress fields. Location and orientation of subsequent fractures is based on the combined stress effects of the stress fields as a result of the prior fractures which provides for optimal region development.

24 Claims, 48 Drawing Sheets

U.S. PATENT DOCUMENTS

| | | | | |
|---|---|---|---|---|
| 2,953,460 | A | 9/1960 | Baker | |
| 2,980,291 | A | 4/1961 | Schuerger | |
| 3,062,286 | A | 11/1962 | Wyllie | |
| 3,455,391 | A | 7/1969 | Matthews | |
| 3,537,529 | A | 11/1970 | Timmerman | |
| 3,556,218 | A | 1/1971 | Talley | |
| 3,578,080 | A | 5/1971 | Closmann | |
| 3,682,246 | A | 8/1972 | Closmann | |
| 3,822,747 | A | 7/1974 | Maguire | |
| 3,933,205 | A | 1/1976 | Kiel | |
| 4,050,529 | A | 9/1977 | Tagirov et al. | |
| 4,137,970 | A | 2/1979 | Laflin et al. | 166/292 |
| 4,209,278 | A | 6/1980 | Cooper et al. | |
| 4,265,266 | A | 5/1981 | Kierbow et al. | |
| 4,305,463 | A | 12/1981 | Zakiewicz | 166/245 |
| 4,353,482 | A | 10/1982 | Tomlinson et al. | |
| 4,409,927 | A | 10/1983 | Loesch et al. | |
| 4,410,106 | A | 10/1983 | Kierbow et al. | |
| 4,427,133 | A | 1/1984 | Kierbow et al. | |
| 4,635,723 | A | 1/1987 | Spivey | |
| 4,701,095 | A | 10/1987 | Berryman et al. | |
| 4,715,721 | A | 12/1987 | Walker et al. | |
| 4,724,905 | A * | 2/1988 | Uhri | 166/250.1 |
| 4,733,567 | A | 3/1988 | Serata | |
| 4,830,106 | A | 5/1989 | Uhri | 166/250 |
| 4,845,981 | A | 7/1989 | Pearson | |
| 4,850,750 | A | 7/1989 | Cogbill et al. | |
| 4,974,675 | A | 12/1990 | Austin et al. | |
| 5,014,218 | A | 5/1991 | Crain et al. | |
| 5,111,881 | A | 5/1992 | Soliman et al. | |
| 5,228,510 | A | 7/1993 | Jennings, Jr. | |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A | 2/1996 | Surjaatmadja et al. | |
| 5,499,678 | A | 3/1996 | Surjaatmadja et al. | |
| 5,515,920 | A | 5/1996 | Luk et al. | 166/280.1 |
| 5,574,218 | A | 11/1996 | Withers | |
| 5,659,480 | A | 8/1997 | Anderson et al. | |
| 6,120,175 | A | 9/2000 | Tewell | |
| 6,193,402 | B1 | 2/2001 | Grimland et al. | |
| 6,236,894 | B1 | 5/2001 | Stoisits et al. | |
| 6,394,184 | B2 | 5/2002 | Tolman et al. | 166/281 |
| 6,575,247 | B2 | 6/2003 | Tolman et al. | |
| 6,644,844 | B2 | 11/2003 | Neal et al. | |
| 6,729,394 | B1 | 5/2004 | Hassan et al. | |
| 6,935,424 | B2 | 8/2005 | Lehrnan | |
| 6,991,037 | B2 * | 1/2006 | Hocking | 166/308.1 |
| 7,036,587 | B2 | 5/2006 | Munoz et al. | 166/279 |
| 7,143,842 | B2 | 12/2006 | Ikuta | 173/201 |
| 7,225,869 | B2 | 6/2007 | Willett et al. | |
| 7,243,726 | B2 | 7/2007 | Ohmer | |
| 7,367,411 | B2 | 5/2008 | Leuchtenberg | |
| 7,391,675 | B2 * | 6/2008 | Drew | 367/73 |
| 7,431,090 | B2 | 10/2008 | Surjaatmadja et al. | |
| 7,445,045 | B2 | 11/2008 | East, Jr. et al. | |
| 7,711,487 | B2 * | 5/2010 | Surjaatmadja | 702/11 |
| 2002/0125011 | A1 | 9/2002 | Snider et al. | |
| 2003/0050758 | A1 | 3/2003 | Soliman et al. | |
| 2003/0141064 | A1 | 7/2003 | Roberson, Jr. | |
| 2004/0020662 | A1 | 2/2004 | Freyer | 166/387 |
| 2005/0121196 | A1 | 6/2005 | East et al. | |
| 2005/0211439 | A1 | 9/2005 | Willett et al. | |
| 2006/0081412 | A1 | 4/2006 | Wright et al. | |
| 2006/0161358 | A1 | 7/2006 | Dykstra et al. | |
| 2006/0185848 | A1 | 8/2006 | Surjaatmadja et al. | |
| 2006/0243437 | A1 | 11/2006 | Albers et al. | |
| 2006/0289167 | A1 | 12/2006 | Surjaatmadja et al. | |
| 2007/0116546 | A1 | 5/2007 | Dearing | |
| 2007/0125543 | A1 | 6/2007 | McNeel et al. | 166/308.3 |
| 2007/0125544 | A1 | 6/2007 | Robinson et al. | 166/308.3 |
| 2007/0153622 | A1 | 7/2007 | Dykstra et al. | |
| 2007/0153623 | A1 | 7/2007 | Dykstra et al. | |
| 2007/0153624 | A1 | 7/2007 | Dykstra et al. | |
| 2007/0171765 | A1 | 7/2007 | Dykstra et al. | |
| 2007/0201305 | A1 | 8/2007 | Heilman et al. | |
| 2008/0083531 | A1 | 4/2008 | Surjaatmadja | |
| 2008/0083532 | A1 | 4/2008 | Surjaatmadja | 166/250.1 |
| 2008/0083538 | A1 * | 4/2008 | Soliman | 166/308.1 |
| 2008/0236818 | A1 | 10/2008 | Dykstra | |
| 2009/0050311 | A1 | 2/2009 | Crawford | |

FOREIGN PATENT DOCUMENTS

| | | | |
|---|---|---|---|
| EP | 0508817 | | 10/1991 |
| EP | 0474350 | A1 | 3/1992 |
| GB | 1460647 | A | 1/1977 |
| NO | 20042134 | | 11/2005 |
| WO | WO 2004/007894 | | 1/2004 |
| WO | WO 2006/109035 | A | 10/2006 |
| WO | WO 2007/024383 | A2 | 3/2007 |
| WO | WO2008/041010 | A1 | 4/2008 |
| WO | WO2008/142406 | A3 | 11/2008 |

OTHER PUBLICATIONS

Office Action for U.S. Appl. No. 11/545,749, mailed Feb. 10, 2009.
Office Action for U.S. Appl. No. 11/291,496 dated Mar. 11, 2009.
Office Action for U.S. Appl. No. 11/873,186, dated Mar. 23, 2009.
Office Action for U.S. Appl. No. 11/396,918, dated Apr. 29, 2009.
Office Action for U.S. Appl. No. 11/545,749, dated May 1, 2009.
Office Action for U.S. Appl. No. 11/753,314, dated May 5, 2009.
Office Action for U.S. Appl. No. 11/291,496, dated May 19, 2009.
Notice of Publication dated Apr. 10, 2008 from U.S. Appl. No. 11/753,314.
Office Action for U.S. Appl. No. 11/691,623, dated Jul. 9, 2009.
U.S. Appl. No. 11/545,749, filed Oct. 10, 2006, Surjaatmadja et al.
U.S. Appl. No. 11/753,314, filed May 24, 2007, Surjaatmadja et al.
Information Disclosure Statement, p. 1. Jobs performed by Halliburton and other companies at Bakersfield, CA in the late 1980s.
Information Disclosure Statement, p. 1. Jobs performed by Halliburton and other companies at Bakersfield, CA in 1994.
Information Disclosure Statement, p. 1-2. Jobs performed by Halliburton at Bakersfield, CA in 1994.
Information Disclosure Staetment, p. 1-2. Jobs performed by Schlumberger at Bakersfield, CA in 1994.
Information Disclosure Statement, p. 1-2. Jobs performed by Schlumberger at Lost Hills in 1996.
Information Disclosure Statement, p. 1-2. Jobs performed by BJ Services in 2004.
Information Disclosure Statement, p. 2. Jobs performed by Halliburton in Rock Springs, WY in Mar. 2005.
Warpinski, Norman R and Branagan, Paul T., "Altered Stress Fracturing", JPT, 990-97, 473-476, Sep. 1989.
Surjaatmadja, "Single Point of Initiation, Dual-Fracture Placement for Maximizing Well Production," Society of Petroleum Engineers, SPE 107718, 2007.
Surjaatmadja, "The Important Second Fracture and its Operational Placement for Maximizing Production," Society of Petroleum Engineers SPE 107059, 2007.
Surjaatmadja, "The Mythical Second Fracture and its Operational Placement for Maximizing Production," Society of Petroleum Engineers SPE 106046, 2007.
Office Action from U.S. Appl. No. 11/291,496, May 3, 2007.
Office Action from U.S. Appl. No. 11/396,918, May 3, 2007.
Office Action from U.S. Appl. No. 11/291,496, Oct. 16, 2007.
Information Disclosure Statement for U.S. Appl. No. 11/291,496, Nov. 21, 2006.
International Search Report for International Application No. PCT/GB2007/000677, Jun. 11, 2007.
International Search Report for International Application No. PCT/GB2007/001189, Sep. 5, 2007.
Information Disclosure Statement for U.S. Appl. No. 11/396,918, Oct. 15, 2007.
Information Disclosure Statement for U.S. Appl. No. 11/873,186, Oct. 16, 2007.
Office Action for U.S. Appl. No. 11/396,918, Jan. 25, 2008.
Office Action for U.S. Appl. No. 11/753,314, Jun. 12, 2008.
International Search Report for International Application No. PCT/GB2008/001044, Aug. 13, 2008.
Office Action for U.S. Appl. No. 11/291,496, Aug. 21, 2008.
Office Action for U.S. Appl. No. 11/873,186, filed Sep. 24, 2008.

Notice of Publication for U.S. Appl. No. 11/691,623, Oct. 2, 2008.
Office Action for U.S. Appl. No. 11/753,314 dated Nov. 19, 2008.
Office Action for U.S. Appl. No. 11/396,918 dated Oct. 15, 2008.
Surjaatmadja et al., "Consideration for Future Stimulation Options is Vital in Deciding Horizontal Well Drilling and Completion Schemes for Production Optimization," Society of Petroleum Engineers, 2006, SPE 103774.
Office Action for U.S. Appl. No. 11/545,749 dated Jan. 27, 2010.
Office Action for U.S. Appl. No. 11/873,186 dated Jan. 25, 2010.
Notice of Allowance and Notice of Allowability for U.S. Appl. No. 11/753,314 dated Dec. 17, 2009.
Notice of Allowance for U.S. Appl. No. 11/753,314, dated Dec. 17, 2009.
Office Action for U.S. Appl. No. 11/396,918, dated Dec. 1, 2009.
Office Action for U.S. Appl. No. 11/545,749, dated Jan. 27, 2010.
Office Action for U.S. Appl. No. 11/873,186, dated Jan. 25, 2010.
Notice of Allowance for U.S. Appl. No. 11/691,623 dated Feb. 18, 2010.
Notice of Allowance for U.S. Appl. No. 11/545,749 dated Apr. 5, 2010.
Office Action for U.S. Appl. No. 11/873,186, dated Oct. 5, 2009.
International Preliminary Report on Patentability from PCT/GB2008/001044, dated Oct. 8, 2009.
Office Action for U.S. Appl. No. 11/291,496 dated May 13, 2010.
Search Report and Written Opinion for International Application No. PCT/GB2008/001730 dated May 21, 2008.
Notice of Allowance for U.S. Appl. No. 11/691,623 dated Jul. 26, 2010.

* cited by examiner

METHOD AND APPARATUS FOR ORCHESTRATION OF FRACTURE PLACEMENT FROM A CENTRALIZED WELL FLUID TREATMENT CENTER

CROSS-REFERENCE TO RELATED APPLICATIONS

This application is a continuation in part of: U.S. patent application Ser. No. 11/396,918 filed on Apr. 3, 2006 now abandoned, which is a continuation in part of U.S. patent application Ser. No. 11/291,496 filed on Dec. 1, 2005; U.S. patent application Ser. No. 11/545,749 filed on Oct. 10, 2006; and U.S. patent application Ser. No. 11/753,314 filed on May 24, 2007 which are each hereby incorporated by reference as if fully reproduced herein.

FIELD OF THE INVENTION

The present invention relates generally to methods for orchestrating the inducement of multiple fractures in a plurality of well locations in a subterranean formation for a region to obtain optimal production from a plurality of wells with minimal required fracturing. More particularly, the present invention relates to methods to induce a first fracture at a well location with a first orientation in a formation followed by determinations of a time delay and according to stress field effects to optimize the inducement of a second fracture with a second angular orientation in the formation either at the well location or different well location.

BACKGROUND

In the production of oil and gas in a region or field, when using the newly developed stimulation techniques, it is desired to fracture multiple wells and oftentimes these fractures must be performed within a designated amount of time. Several costs are associated with this process of fracturing multiple wells located at a single well pad or multiple well pads sequentially in a field. For example, each fracture induced requires not only time for movement and set up of equipment but also incurs monetary costs which may become substantial for a given field. Further, obtaining maximum production from a previously producing oil well may require additional fracturing as the producing well as when damage occurs due to factors such as fine migration in the subterranean formation. Such additional fracture increases the monetary costs associated with production of a field. Also, production time is drawn out as the servicing of each subsequent oil well requires the movement of equipment.

Conventional methods for initiating additional fractures typically induce the additional fractures with near-identical angular orientation to previous fractures. While such methods increase the number of locations for drainage into the wellbore, they are generally not optimal, as they tend to avoid good producing reservoirs. Conventional methods do not introduce new directions for hydrocarbons to flow into the wellbore. The conventional method may also not account for, or even more so, utilize, stress alterations around existing fractures when inducing new fractures in order to connect to previously unattained reservoirs. Further, typical methods rely on the complex movement of equipment and personnel to sequentially service wells.

Thus, a need exists for an improved method for initiating multiple fractures not only in a wellbore but also within a region or field, where the method accounts for tangential forces around a wellbore and within a region or field and the timing of inducing a subsequent fracture as well as providing a central location for the distribution of well treatment fluids for the fracturing of multiple wells.

SUMMARY

In general, one aspect of the invention features a method for inducing multiple fractures in a subterranean formation associated with a plurality of wells within a region by utilizing a centralized well treatment fluid center. In particular, this invention introduces a new approach to maximize fracture contact into the unnatural direction; e.g. perpendicular or at least oblique to the naturally preferred fracture direction; using the minimum required fracture placement in the field. The centralized well treatment fluid center is configured for fracturing a plurality of wells. The centralized well treatment fluid center is adapted to manufacture and pump a well treatment fluid. A first fracture is induced at a first well location by flowing well treatment fluid from the centralized well treatment fluid center to the first well location. The first fracture alters one or more first well location stress fields in the subterranean formation. One or more first well location effects of the one or more first well location stress fields from the first fracture are measured. The time delay is determined before the second fracture is induced. The determination of the time delays is based, at least in part, on at least one of the one or more first well location effects in order to maximize the unnatural reach of the second fracture. A second well location for fracturing is selected. The selection of the second well location is based, at least in part, on the maximum reorientation due to the one or more first well location effects. The second fracture at the second well location is induced after the time delay by flowing well treatment fluid from the centralized well treatment fluid center to the second well location. The second fracture alters one or more second well location stress fields in the subterranean formation.

In addition, the first fracture stress fields are altered in a first direction. A third fracture is induced at the first well location by flowing well treatment fluid from the centralized well treatment fluid center to the third well location. The orientation line of the third fracture has an angular disposition with an orientation line of the first fracture. The angular disposition of the third fracture with the first fracture is such so as to alter direction of one or more third fracture stress fields to an at least thirty degree disposition to the first direction. The third fracture alters the one or more first well location stress fields in the subterranean formation. The orientation line of the third fracture is based, at least in part, on the one or more first well location effects from the first fracture. The one or more combined effects of one or more combined stress fields in a region are measured. The one or more combined effects are based, at least in part, on the one or more first well location effects and one or more second well location effects of the one or more second well location stress fields from the second fracture. The orientation line of the third fracture is based, at least in part, on the one or more combined effects.

In another aspect of the invention, after a first fracture is induced at the first well location, a third fracture is induced at a third well location by flowing well treatment fluid from the centralized well treatment fluid center to the third well location substantially simultaneous with a second fracture. The third fracture alters one or more third well location stress fields in the subterranean formation.

Another aspect of the invention features a system for fracturing a subterranean formation, associated with a region, from a centralized location. The system includes a centralized well treatment fluid center located within a region. The centralized well treatment fluid center is adapted to manufacture, or re-manufacture, and pump a well treatment fluid. The centralized well treatment fluid center is configured with a plurality of distribution lines for pumping the well treatment fluid. The plurality of distribution lines are adapted to flow a well treatment fluid. The first downhole conveyance is coupled to at least one of the plurality of distribution lines, wherein the first downhole conveyance is at least partially disposed in a first wellbore. The second downhole conveyance is coupled to at least one of the plurality of distribution lines, wherein the second downhole conveyance is at least partially disposed in a second wellbore. A first fracturing tool is coupled to the first downhole conveyance, wherein the first fracturing tool is adapted to initiate a first fracture at about a first fracturing location. The second fracturing tool is coupled to the second downhole conveyance, wherein the second fracturing tool is adapted to initiate a second fracture at about a second fracturing location. One or more region stress field sensors are disposed about the first fracturing location and the second fracturing location, wherein the one or more region stress field sensors are adapted to measure information from one or more region effects of the one or more region stress fields. The system includes a computer comprising one or more processors and a memory, the memory comprising executable instructions that, when executed, cause the one or more processors to receive one or more outputs from the one or more region stress field sensors and determine the time delay between inducing the first fracture and inducing the second fracture, wherein the time delay is determined based, at least in part, on the one or more region effects contained in the one or more outputs.

In another aspect of the invention, the first fracturing tool and the second fracturing tool can comprise one or more isolation assembly tools adapted to provide multi-interval fracturing completion. One example of a method for multi-interval fracturing completion comprises the steps of: introducing an isolation assembly to a well bore, the isolation assembly comprising a liner, one or more sleeves, one or more screen-wrapped sleeves and a plurality of swellable packers, wherein the plurality of swellable packers are disposed around the liner at one or more selected spacings; swelling at least one of the plurality of swellable packers so as to provide zonal isolation one or more selected intervals; wherein the one or more sleeves and the one or more screen-wrapped sleeves are disposed around the liner at selected spacings so as to provide at least one of the one or more sleeves and at least one of the one or more screen-wrapped sleeves within at least one of the one or more selected intervals; deploying a shifting tool inside the liner, wherein the shifting tool is adapted to adjust positioning of each of the one or more sleeves and each of the one or more screen-wrapped sleeves; actuating the shifting tool to adjust positioning of the at least one of the one or more sleeves to an open position so as to stimulate the at least one or more selected intervals by flowing fluid through one or more openings of the liner and through one or more openings in the at least one of the one or more sleeves; actuating the shifting tool to adjust positioning of the at least one of the one or more sleeves to a closed position so as to reestablish zonal isolation of the at least one of the one or more selected intervals; and actuating the shifting tool to adjust positioning of the at least one of the one or more screen-wrapped sleeves to an open position so as to allow flow of production fluid from the at least one of the one or more selected intervals through one or more opening in the liner and through a plurality of openings in the at least one of the one or more screen-wrapped sleeves.

Another example of a method for multi-interval fracturing completion comprises the steps of: introducing an isolation assembly to a well bore, the isolation assembly comprising a liner, one or more sleeves and a plurality of swellable packers, wherein the plurality of swellable packers are disposed around the liner at one or more selected spacings; swelling at least one of the plurality of swellable packers so as to provide zonal isolation of one or more selected intervals; wherein the one or more sleeves are disposed around the liner at selected spacings so as to provide at least one of the one or more sleeves within at least one of the one or more selected intervals and wherein the one or more sleeves are configured so as to provide a closed position, an open position and an open to screen position; actuating the shifting tool to adjust positioning of the at least one of the one or more sleeves to an open position; pumping fluid through one or more openings in the liner and through one or more openings of the at least one of the one or more sleeves within the at least one of the one or more selected intervals so as to stimulate the at least one of the one or more selected intervals; actuating the shifting tool to adjust positioning of the at least one of the one or mores sleeves to an open to screen position so as to allow flow of production fluid form the at least one of the one or more selected intervals through one or more openings in the liner and through one or more openings in the at least one of the one or more sleeves.

An example isolation assembly tool adapted to provide multi-interval fracturing completion comprises: a liner; one or more sleeves, wherein the one or more sleeves are disposed around the liner; wherein a shifting tool is adapted to adjust positioning of each of the one or more sleeves to an open position, a closed position and an open to screen position and wherein a shifting tool is adapted to adjust positioning of each of the one or more sleeves to an open position, a closed position and an open to screen position and wherein the one or more sleeves is disposed around the liner at selected spacing to cover selected perforations of the liner.

Another example isolation assembly tool adapted to provide multi-interval fracturing completion comprises: a liner; one or more sleeves, wherein the one or more sleeves are disposed around the liner; wherein a shifting tool is adapted to adjust positioning of each of the one or more sleeves to an open position, a closed position and an open to screen position and wherein a shifting tool is adapted to adjust positioning of each of the one or more sleeves to an open position, a closed position and an open to screen position and wherein the one or more sleeves is disposed around the liner at selected spacing to cover selected perforations of the liner.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates generally to methods for orchestrating the inducement of multiple fractures in a subterranean formation for a region and more particularly to methods to induce a first fracture at a first well location with a first orientation in a formation followed by determinations of a time delay and according to stress field effects of the first fracture or of the region to optimize the inducement of a second fracture with a second angular orientation in the formation either at the first well location or a different well location. The fractures are induced by flowing well treatment fluid from a centralized well treatment fluid center that has been adapted to flow well treatment fluid to a plurality of wells in order to perform substantially simultaneous or sequential fracturing.

The methods and apparatus of the present invention may allow for increased well productivity by the introduction of multiple fractures at different angular dispositions relative to one another in a plurality of well bores. Also, monetary cost savings may result as the need for multiple fractures is reduced by the determination of strategic timing and location of each fracture. Reduction in monetary costs as well as time and labor may also be attained as equipment and personnel are stationed at a centralized well treatment fluid center saving the expense of moving and setup of the necessary equipment for each fracturing location.

Figure 1:
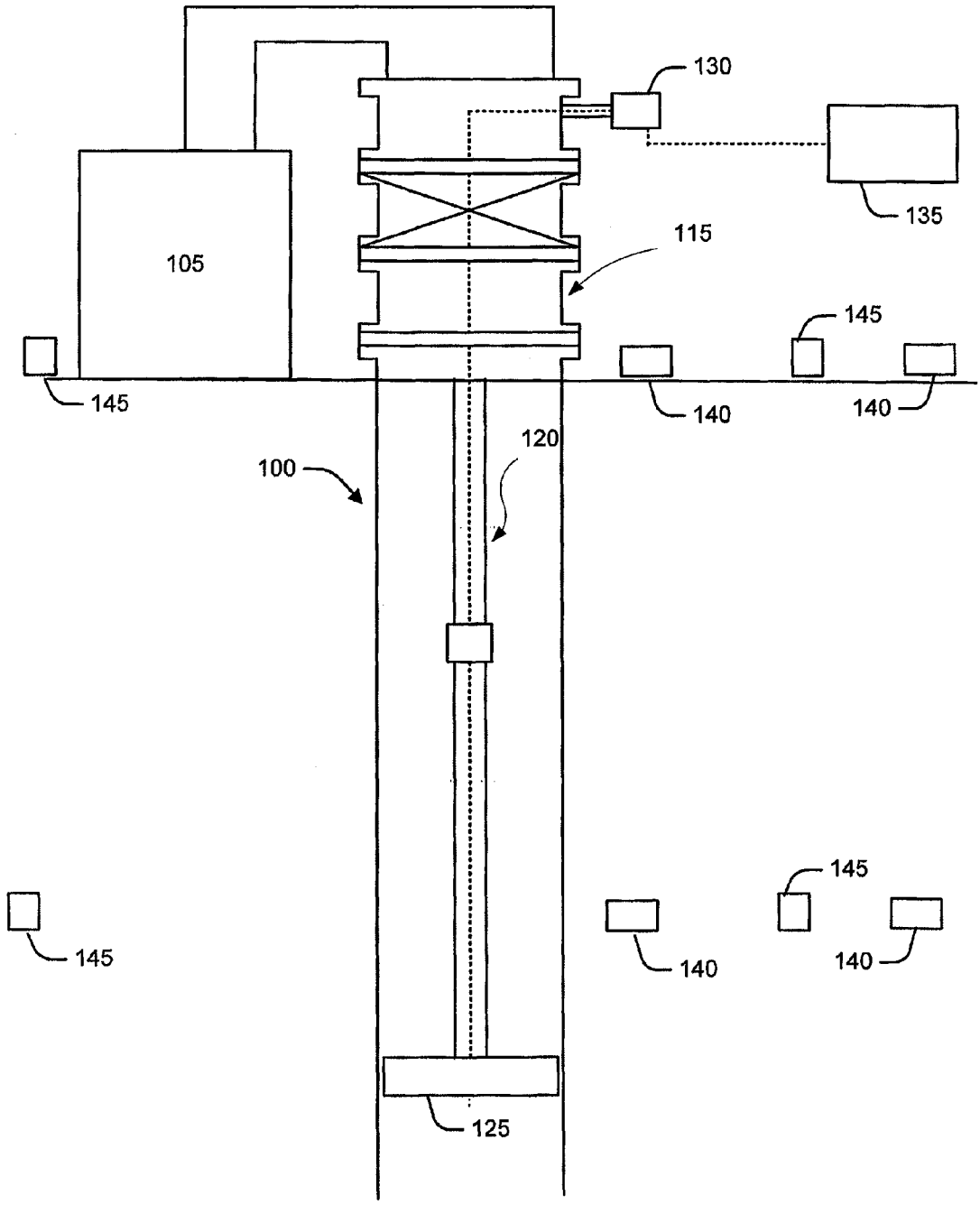
FIG. 1 is a schematic block diagram of a wellbore and a system for fracturing.

FIG. 1 depicts a schematic representation of a subterranean well bore 100 through which a fluid may be injected into a region of the subterranean formation surrounding well bore 100. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 100 and generates pressure signals. The fluid may be injected by injection device 105 (e.g., a pump). At wellhead 115, a downhole conveyance device 120 is used to deliver and position a fracturing tool 125 to a location in the wellbore 100. In some example implementations, the downhole conveyance device 120 may include coiled tubing. In other example implementations, downhole conveyance device 120 may include a drill string that is capable of both moving the fracturing tool 125 along the wellbore 100 and rotating the fracturing tool 125. The downhole conveyance device 120 may be driven by a drive mechanism 130. One or more sensors may be affixed to the downhole conveyance device 120 and configured to send signals to a control unit 135.

The control unit 135 is coupled to drive unit 130 to control the operation of the drive unit. The control unit 135 is coupled to the injection device 105 to control the injection of fluid into the wellbore 100. The control unit 135 includes one or more processors and associated data storage. In one example embodiment, control unit 135 may be a computer comprising one or more processors and a memory. The memory includes executable instructions that, when executed, cause the one or more processors to determine the time delay between inducing the first fracture and inducing the second fracture. In certain example implementations, the time delay between the inducement of the first fracture and the inducement of the second fracture is based, at least in part, on physical measurements. In certain example implementations, the time delay between the inducement of the first fracture and the inducement of the second fracture is based, at least in part, on simulation data. In one embodiment, the control unit 135 determines the time delay based, at least in part, on one or more stress fields of one or more affected layers of the formation that are altered during the opening and closing of the first fracture.

Stress fields in one or more layers of the formation that are altered by the first fracture may be measured using one or more devices. In certain embodiments, one or more tilt meters 140 are placed at the surface and are configured to generate one or more outputs. The outputs of the tilt meters are indicative of the magnitudes and orientations of the stress fields. In other example implementations, the one or more tilt meters 140 are disposed in the subterranean formation. For example, the tilt meters 140 may be displaced in the formation at a location near the fracturing level. The outputs from the tilt meters 140 during the opening or closing of the first fracture are relayed to the control unit 135. As mentioned above, the control unit 135 may determine the time delay based, at least in part, on one or more of these tilt meter outputs.

In other example systems, a plurality of microseismic receivers 145 are placed in an observation well. These microseismic receivers 145 are configured to generate one or more outputs based on measured stress fields of one or more affected layers. In one example implementation, the microseismic receivers 145 are placed in the observation well at a depth that is close enough to the level of fracturing to produce meaningful output. Microseismic receivers 145 may also be placed at about the surface. Outputs of the microseismic receivers 145 are received by the control unit 135. The outputs of the microseismic receivers 145 include outputs generated during one or more of the opening and closing of the first fracture. In general, the microseismic receivers 145 listen to signals that may be characterized as "microseisms" or "snaps" when microcracks are occurring. The received signals of these "snaps" are received at multiple microseismic receivers. The system then triangulates the received "snaps" to determine a location from which the signals originated. In certain example implementations, the time delay is determined based, at least in part, on the one or more outputs of the microseismic receivers 145. In certain example implementations, outputs from tilt meters, discussed above, are used in combination with the outputs from the microseismic receivers 145 to determine the time delay.

In some example implementations, the measured stress fields are used to determine one or more of stick-slip velocity, Maxwell creep, and pseudo-Maxwell creep. In some example implementations, the one or more of stick-slip velocity, Maxwell creep, and pseudo-Maxwell creep are, in turn, used to determine the time delay between the inducement of the first fracture and the inducement of the second fracture.

In some implementations, other formation characteristics of the formation that are measured during fracturing are used to determine the time delay. In certain example implementations, the control unit 135 determines the length of fracture of the first fracture in one or more of an inward and outward direction, based, at least in part, on the stress fields. In certain example implementations, the control unit 135 determines the stress change of a wavefront of the first fracture based, at least in part, on the stress fields. In some example implementations, the time delay is based on one or more of these other formation characteristics.

In certain example implementations, the one or more processors of control unit 135 are configured to monitor one or more of the extension of the first fracture and the expansion effect velocity of the first fracture. In certain example implementations, the one or more processors determine the time delay based, at least in part, on one or more of the monitored extension of the first fracture and the expansion effect velocity of the first fracture.

In other embodiments, the control unit 135 controls the pumping of the treatment fluid, which, in turn, controls a fracture extension velocity of one or more of the first and second fractures. In some example implementations, the pumping of the treatment fluid is controlled to prevent a fracture tip of the second fracture from advancing beyond one or more of a stick-slip front of the first fracture and a Maxwell creep front of the first fracture. In this instance, the fracture tip velocity of the second fracture may be simulated by the one or more processors. In other example implementations, the fracture tip velocity of the second fracture may be determined based, at least in part, on historical data from other fracturing operations.

Figure 2A:
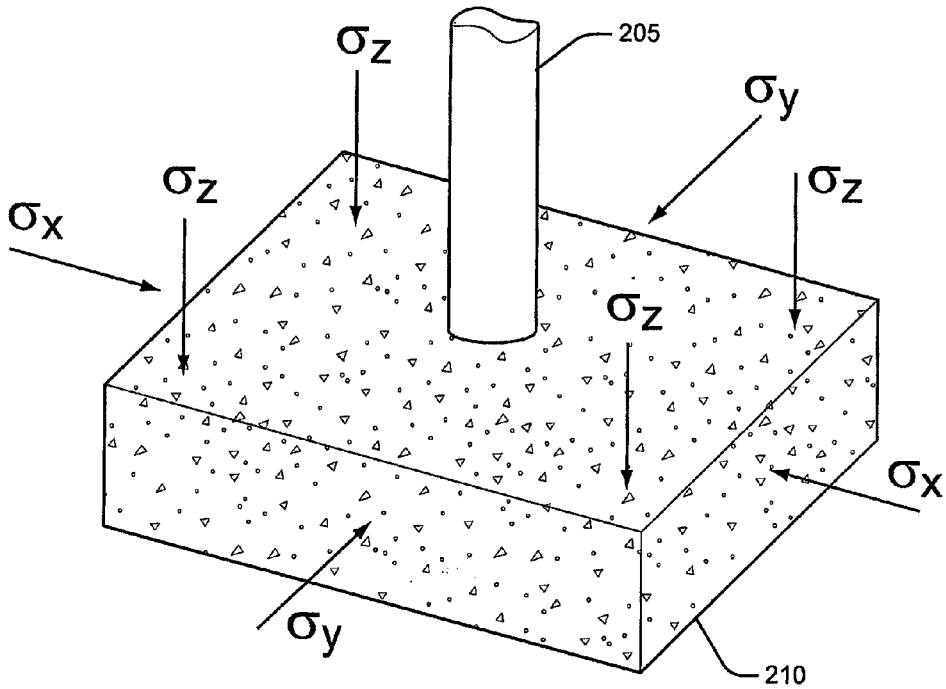
FIG. 2A is a graphical representation of a wellbore in a subterranean formation and the principal stresses on the formation.

FIG. 2A is an illustration of a wellbore 205 passing though a formation 210 and the stresses on the formation. In general, formation rock is subjected by the weight of anything above it, i.e. $\sigma_z$ overburden stresses. By Poisson's rule, these stresses and formation pressure effects translate into horizontal stresses $\sigma_x$ and $\sigma_y$. In general, however, Poisson's ratio is not consistent due to the randomness of the rock. Also, geological features, such as formation dipping may cause other stresses. Therefore, in most cases, $\sigma_x$ and $\sigma_y$ are different.

Figure 2B:
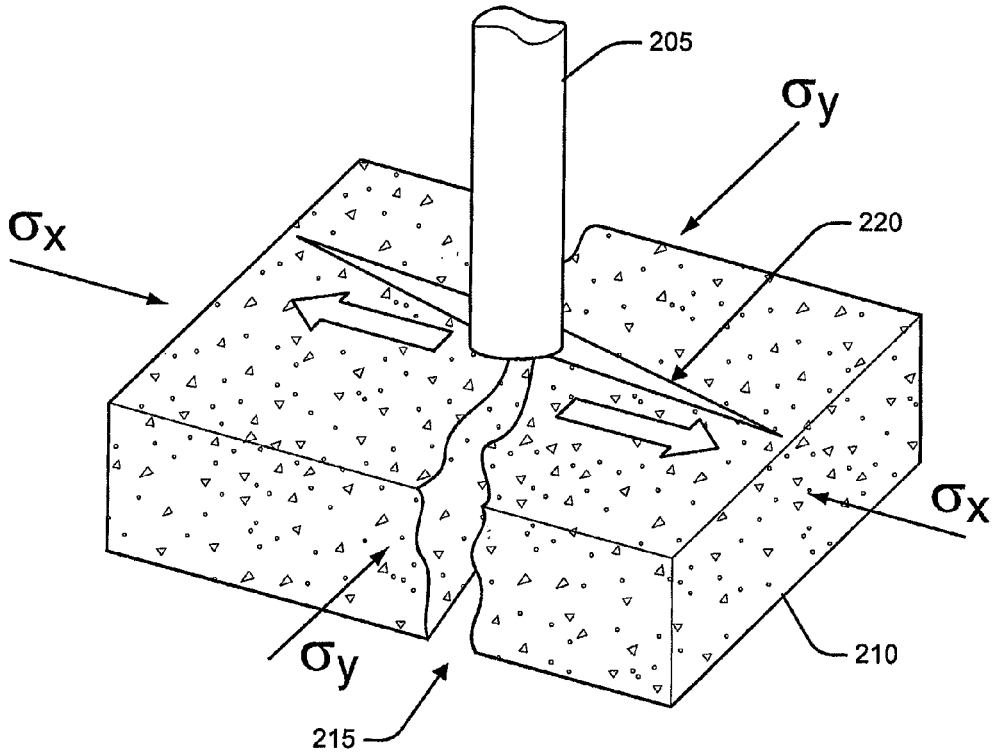
FIG. 2B is a graphical representation of a wellbore in a subterranean formation that has been fractured and the principal stresses on the formation and a second fracture placed thereafter.

FIG. 2B is an illustration the wellbore 205 passing though the formation 210 after a fracture 215 is induced in the formation 210. Assuming for this example that $\sigma_x$ is smaller than $\sigma_y$, the fracture 215 will extend into the y direction, following the minimum stress plane. The orientation of the minimum stress vector direction is, however, in the x direction. As used herein, the orientation of a fracture is defined to be a vector perpendicular to the fracture plane.

As fracture 215 opens, fracture faces are pushed in the x direction. Because formation boundaries cannot move, the rock becomes more compressed, increasing $\sigma_x$. Over time, effects of compression are felt further from the fracture face location. The increased stress in the x direction, $\sigma_x$, quickly becomes higher than $\sigma_y$ causing a change in the local stress direction. When the stimulation process of the first fracture is stopped, the fracture will tend to close as the rock moves back to its original shape, especially due to the increased $\sigma_x$. Even after the fracture is closed, the presence of propping agents that are placed in the first fracture to keep the fracture at least partially open causes stresses in the x direction. These stresses in the formation cause a subsequent fracture (e.g., the second fracture) to propagate in a new direction shown by projected fracture 220. These stresses will be kept even at a higher level due to the latency of stresses due to the Maxwell creep or pseudo-Maxwell creep. The present disclosure is directed to initiating fractures, such as projected fracture 220, while the stress field in the formation 210 is temporarily altered by an earlier fracture, such as fracture 215.

Figure 3:
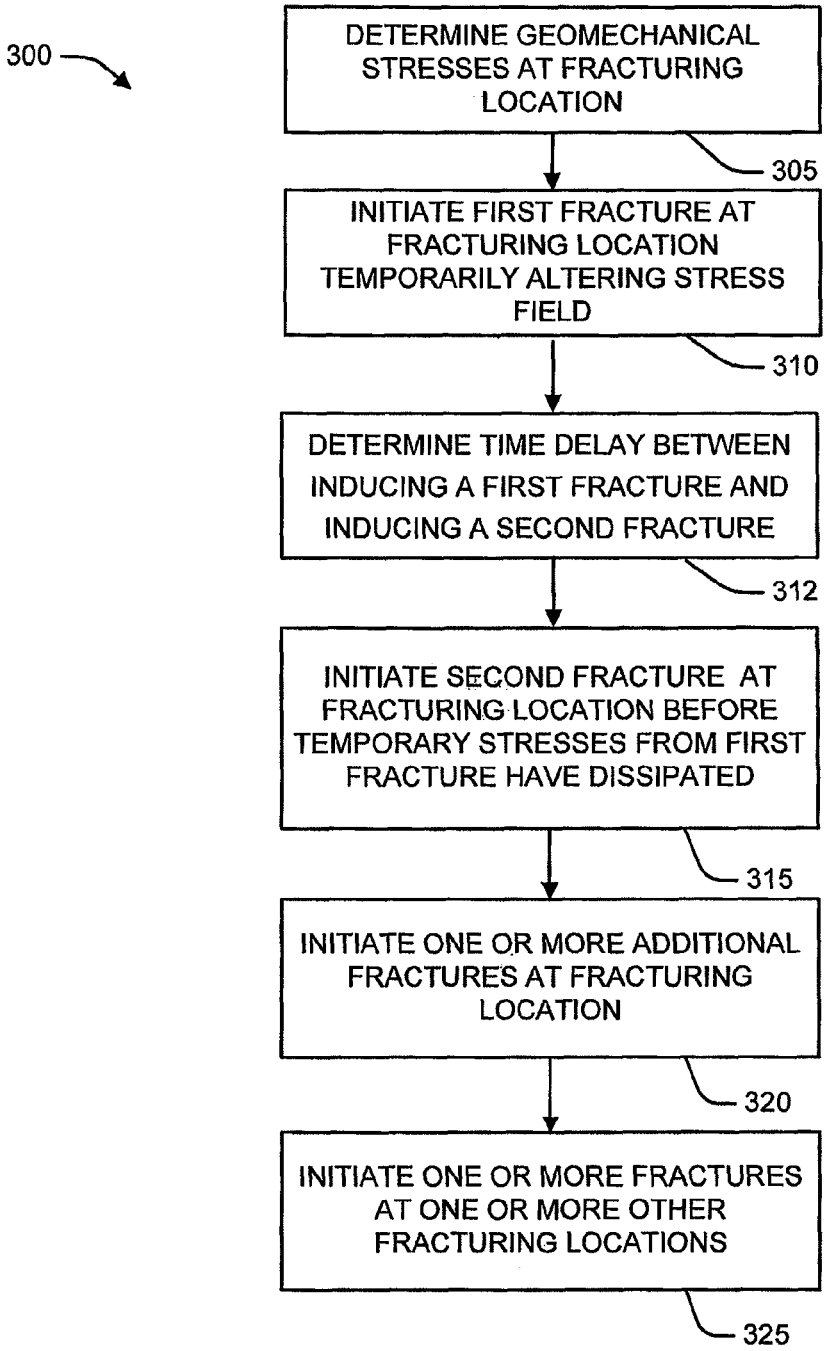
FIG. 3 is a flow chart illustrating an example method for fracturing a formation according to the present invention.

FIG. 3 is a flow chart illustration of an example implementation of one method of the present invention, shown generally at 300. The method includes determining one or more geomechanical stresses at a fracturing location in step 305. In some implementations, step 305 may be omitted. In some implementations, this step includes determining a current minimum stress direction at the fracturing location. In one example implementation, information from tilt meters or micro-seismic tests performed on neighboring wells is used to determine geomechanical stresses at the fracturing location. In some implementations, geomechanical stresses at a plurality of possible fracturing locations are determined to find one or more locations for fracturing. Step 305 may be performed by the control unit 135 by a computer with one or more processors and associated data storage.

The method 300 further includes initiating a first fracture at about the fracturing location in step 310. The first fracture's initiation is characterized by a first orientation line. In general, the orientation of a fracture is defined to be a vector normal to the fracture plane. In this case, the characteristic first orientation line is defined by the fracture's initiation rather than its propagation. In certain example implementations, the first fracture is substantially perpendicular to a direction of minimum stress at the fracturing location in the wellbore.

The initiation of the first fracture temporarily alters the stress field in the subterranean formation, as discussed above with respect to FIGS. 2A and 2B. The duration of the alteration of the stress field may be based on factors such as the size of the first fracture, rock mechanics of the formation, the fracturing fluid seeping into the formation, and subsequently injected proppants, if any. There is some permanency to the effects caused from injected proppants. Unfortunately, as the fracture closes the final residual effect attributed to the proppant bed is just a couple of millimeters frac face movement and may be less. Due to the temporary nature of the alteration of the stress field in the formation, there is a limited amount of time for the system to initiate a second fracture at about the fracturing location before the temporary stresses alteration has dissipated below a level that will result in a subsequent fracture at the fracturing being usefully reoriented.

A time delay between the induction of the first fracture and the second fracture may be necessary to increase the fracture length of the second fracture. After initiating a first fracture at a fracturing location in step 310, the method includes determining a time delay between inducing a first fracture and inducing a second fracture (block 312). In certain example implementations, during the fracturing process, one or more effects and characteristics of the fracturing process are measured. These measured effects and characteristics for a particular fracturing process may differ according to the type of affected layer of the formation. These measurements may be used to determine the time delay in step 312. In certain implementations, shear effects between affected layers are used to determine the time delay in step 312. The time delay is determined from the creep velocity in a material exposed to stress. In hard rock, the Maxwell type creep phenomenon is very slow or even essentially non-existent in certain stimulations. The Maxwell phenomenon assumes that all material has an ability to deform over time. This movement, or deformation, is characterized by a conventional well-known relationship of viscosity—assuming that rock, for instance, is a viscous Newtonian fluid with viscosities with an order of magnitude of millions, or sometimes billions, Poise. In comparison, water has a viscosity of 1 centi-Poise. The relationship is generally defined as Shear rate=du/dy=Shear Stress/viscosity. With a viscosity of millions or billions, the shear rate is infinitesimally small. Thus, the actual creep phenomenon as defined by the Maxwell process can be very slow; the effects being felt in unpractical timeframes.

Figure 16:
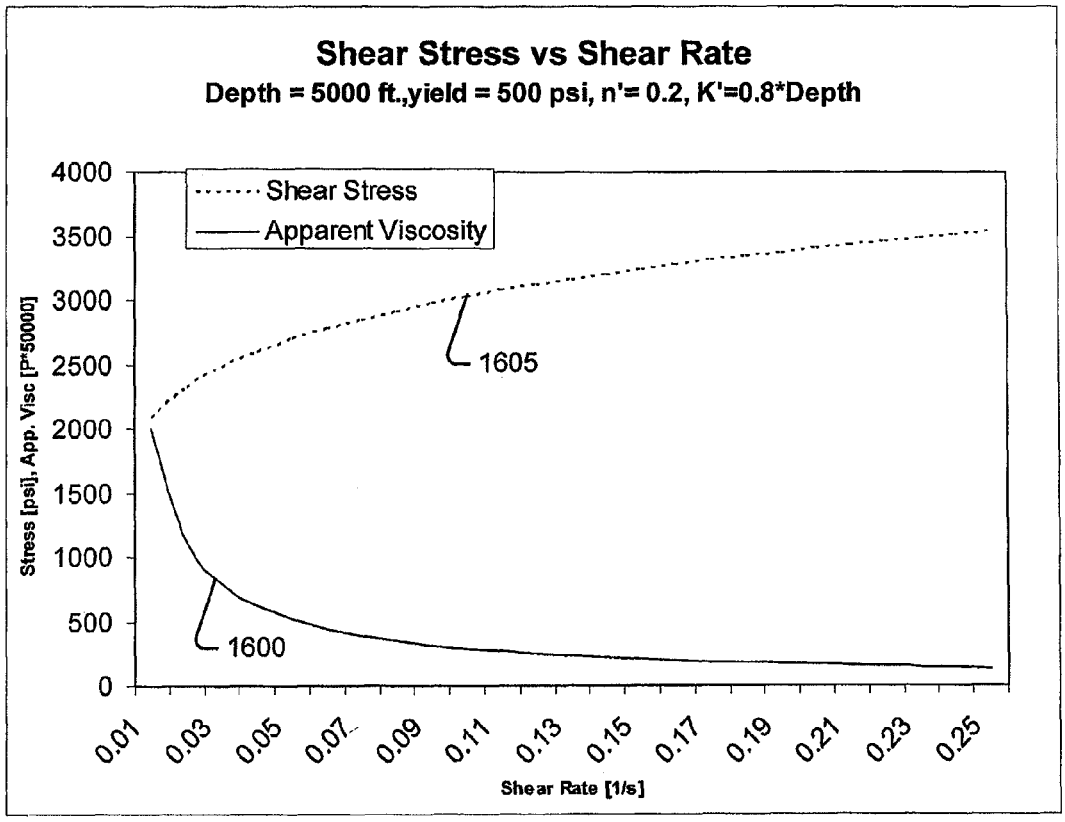
FIG. 16 is a graphical representation depicting typical shear stress and viscosity of a rock formation as a function of shear rate.

Therefore, instead of using the true intermolecular or intercystalline motion of the material, a much larger scale is used. Using the shearing phenomenon between layers, a pseudo-Maxwell creep phenomenon can be observed. Using this pseudo-Maxwell approach, movement of rock is substantially larger. When the shear stress is sufficiently large, then a "Mode II Sliding Fault" occurs. During this time, a small portion of the fault faces "sticks" to each other; while another portion "slips"—a main basis of the "stick-slip" theory. The sticking force process is based on a dry friction model, and is therefore much larger than the shear forces during a slip process. This means that the stick-slip scenario can be approximated as "thixotrophic fluid," with certain "out-of-limit" n' K' values. The Herschel-Bulkley relationship may therefore be used in the assumptions to compute the shear stresses as a function of different shear rates between the slip faces. The following relationship may be used: Shear Stress–Initial Shear Rate+K'*(Shear Rate)^n'. As an example, FIG. 16 depicts Shear Stress versus Shear Rate for a slip plane located at a depth of 5000 ft., and selecting K'=0.8* depth, and n'=0.2, and initial shear equals 500 psi. The apparent viscosity 1600 at every shear rate may be computed using this "Non-Newtonian" relationship. Shear stress 1605 is also plotted. The initial viscosity of the rock, for example, could be approximately equal to 100 million Poise. This initial viscosity drops rapidly with velocity to about 5 million Poise.

The Maxwell creep relationship is more adaptable to soft rocks as such material is essentially liquefied. Even in such a situation, however, the particle size is generally large. During the movement process, some amount of stick-slip occurs. The stick-slip process in this example may be envisioned as balls (the large particle) jumping over other balls. The use of the Herschel-Bulkley approach would therefore be applicable directly since this process can be approximated to be a thixotropic behavior. As before, the "out of limit" n' K' values may be defined and the Herschel Bulkley relation may be used to compute the shear stress as a function of shear rate.

The time delay computations may largely depend upon the integration of the shear rates over the complete height of the fracture with respect to the displacement of the fracture face and the time during which fracture is being extended and fracture faces being pushed away from each other. This computation will result in the location of the maximum stress at the maximum extension point, as show in FIG. 15, at the time pumping of the first fracture is stopped.

In another embodiment, determination of a time delay between a first fracture and a second fracture is based, at least on in part, on evaluating the effects of closure of the first fracture after the first fracture stimulation has ceased. The effects of closure of the first fracture include, for example, one or more of stick-slip between the affected layers, Maxwell creep effects of the affected layers, pseudo-Maxwell creep effects of the affected layers, lapse of time between initiating the first fracture and closure of the first fracture, the maximum stress location at the maximum extension point caused by the first fracture during the outward direction of the fracture effects, and length duration of time as the stresses drop inwardly and outwardly. Maxwell creep is a plastic function that assumes that a formation is a liquid characterized by a viscosity. Maxwell creep may also be modeled in a pseudo-Maxwell domain, which assumes that a formation has a pseudo-plasticity. The concept of pseudo-plasticity considers letting a formation crack and then modeling the crack as a viscous element, with layers of the formation moving against each other. In a pseudo-Maxwell modeling domain the formation layers moving against each other react as a plastic element. One skilled in the art may also use ductility/pseudo ductile and malleability/malleable/pseudo-malleable characteristics of the formation in the same manner as pseudo-Maxwell creep for determination of the time delay.

Figure 15:
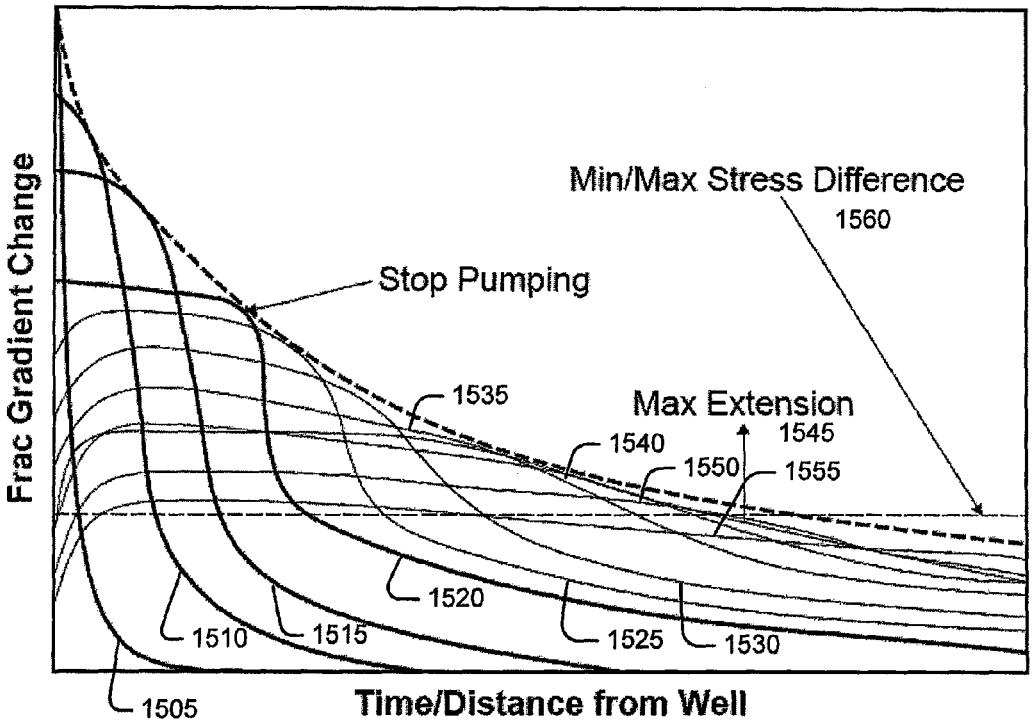
FIG. 15 is a graphical representation of maximizing the second fracture length based on the first fracture gradient change.

In another implementation, the time delay determination may be based at least in part on determining when stress direction modification at the wellbore drops below a stress differential between minimum stress and maximum stress, to provide a maximum time delay for inducing the second fracture. At the maximum time delay, a second fracture may be initiated as shown in FIG. 15.

Yet another example time delay determination is based, at least in part, on when stress direction modification drops below the stress differential between minimum and maximum levels in the area of the tip. During this time, fracture tip velocity is simulated. To optimize the length of the second fracturing, the second fracture tip should not advance beyond the outward stick-slip or creep front created by the first fracture. Based on the fracture tip velocity, the pumping of treatment fluid may be controlled to prevent the fracture tip of the second fracture from advancing beyond a stick-slip front of the first fracture or a Maxwell creep front of the first fracture.

In another example implementation, the time delay is determined, at least in part, on one or more fracture opening effects of the affected layers. The fracture opening effects may be based upon localized fracture gradient changes of the first fracture or dilatancy of the affected layers.

In one example implementation, movement of the wavefront caused by the first fracture is monitored. In certain example implementations, the time delay is determined based, at least in part, on the velocity and intensity of the wavefront data of the first fracture. In some example implementations, one or more tilt meters or microseismic receivers are used to obtain one or more of the velocity and intensity of the first fracture wavefront. The data received from the one or more tilt meters and microseismic receivers may be transmitted in real-time by use of telemetry or satellite communications approaches.

In certain example implementations, the time delay is determined based, at least in part, by monitoring closure of the first fracture. Closure at the mouth of the first fracture is especially useful in determining the total time delay that needs to be considered. In some implementations, the closure time, which could be very long or reasonably short, is added to the total delay time. Again, one or more tilt meters or microseismic receivers may be used independently or in combination to obtain closure of the first fracture data.

In yet another example implementation, extension and expansion velocity of the first fracture are monitored. The time delay may then be determined based, at least in part, on the expansion velocity and extension of the first fracture.

Therefore, in step 315 a second fracture is initiated at about the fracturing location before the temporary stresses from the first fracture have dissipated. In some implementations, the first and second fractures are initiated within 24 hours of each other. In other example implementations, the first and second fractures are initiated within four hours of each other. In still other implementations, the first and second fractures are initiated within an hour of each other.

The initiation of the second fracture is characterized by a second orientation line. The first orientation line and second orientation lines have an angular disposition to each other. The plane that the angular disposition is measured in may vary based on the fracturing tool and techniques. In some example implementations, the angular disposition is measured on a plane substantially normal to the wellbore axis at the fracturing location. In some example implementations, the angular disposition is measured on a plane substantially parallel to the wellbore axis at the fracturing location.

In some example implementations, step 315 is performed using a fracturing tool 125 that is capable of fracturing at different orientations without being turned by the drive unit 130. Such a tool may be used when the downhole conveyance 120 is coiled tubing. In other implementations, the angular disposition between the fracture initiations is cause by the drive unit 130 turning a drillstring or otherwise reorienting the fracturing tool 125. In general there may be an arbitrary angular disposition between the orientation lines. In some example implementations, the angular orientation is between 45° and 135°. More specifically, in some example implementations, the angular orientation is about 90°. In still other implementations, the angular orientation is oblique.

In step 320, the method includes initiating one or more additional fractures at about the fracturing location. Each of the additional fracture initiations are characterized by an orientation line that has an angular disposition to each of the existing orientation lines of fractures induced at about the fracturing location. In some example implementations, step 320 is omitted. Step 320 may be particularly useful when fracturing coal seams or diatomite formations.

Figure 4:
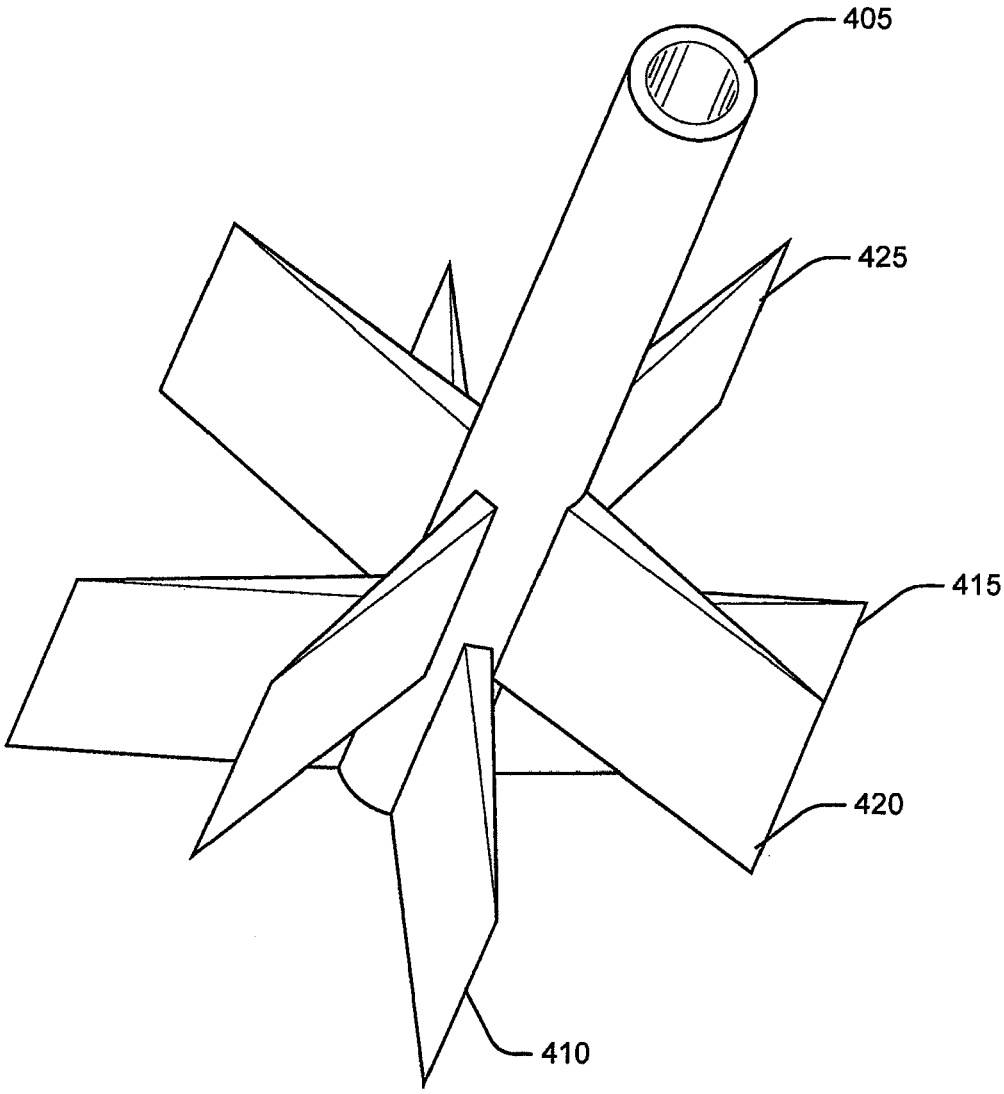
FIG. 4 is a graphical representation of a wellbore and multiple fractures at different angles and fracturing locations in the wellbore.

The fracturing tool may be repositioned in the wellbore to initiate one or more other fractures at one or more other fracturing locations in step 325. For example, steps 310, 315, and optionally 320 may be performed for one or more additional fracturing locations in the wellbore. An example implementation is shown in FIG. 4. Fractures 410 and 415 are initiated at about a first fracturing location in the wellbore 405. Fractures 420 and 425 are initiated at about a second fracturing location in the wellbore 405. In some implementations, such as that shown in FIG. 4, the fractures at two or more fracturing locations, such as fractures 410-425, and each have initiation orientations that angularly differ from each other. In other implementations, depending upon the time delays as discussed earlier, fractures at two or more fracturing locations have initiation orientations that are substantially angularly equal. In certain implementations, the angular orientation may be determined based on geomechanical stresses about the fracturing location.

Figure 5:
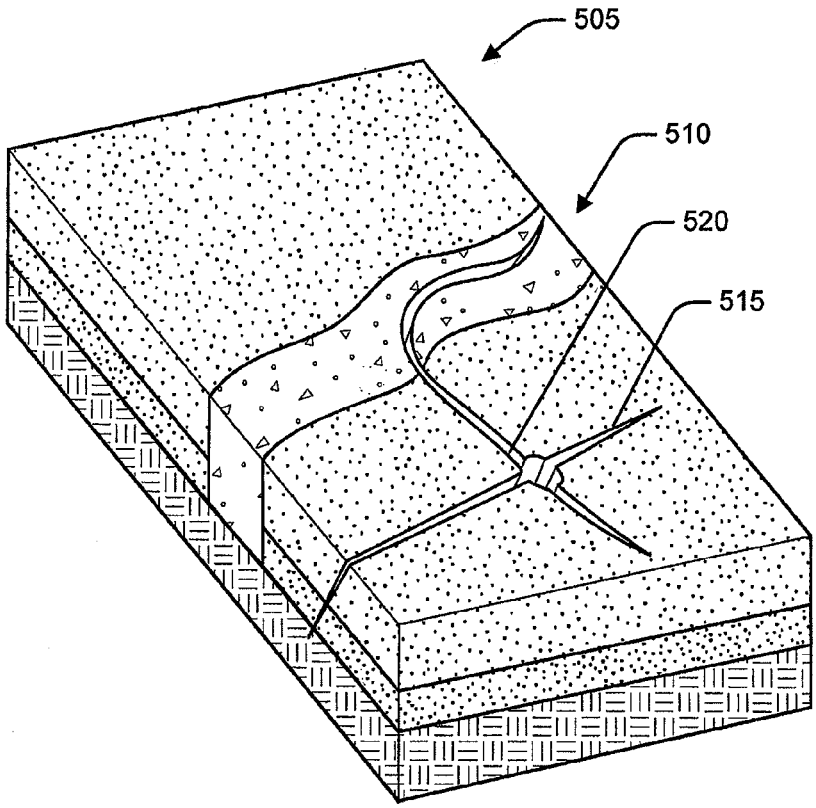
FIG. 5 is a graphical representation of a formation with a high-permeability region with two fractures.

FIG. 5 is an illustration of a formation 505 that includes a region 510 with increased porosity or permeability, relative to the other portions of formation 505 shown in the figure. In this method it is assumed that more porous rock formations are more permeable. However, it is noted that in actual formations, that is not always the case. When fracturing to increase the production of hydrocarbons, it is generally desirable to fracture into a region of higher permeability, such as region 510. The region of high permeability 510, however, reduces stress in the direction toward the region 510 so that a fracture will tend to extend in parallel to the region 510. In the fracturing implementation shown in FIG. 5, a first fracture 515 is induced substantially perpendicular to the direction of minimum stress. The first fracture 515 alters the stress field in the formation 505 so that a second fracture 520 can be initiated in the direction of the region 510. Once the fracture 520 reaches the region 510 it may tend to follow the region 510 due to the stress field inside the region 510. In this implementation, the first fracture 515 may be referred to as a sacrificial fracture because its main purpose was simply to temporarily alter the stress field in the formation 505, allowing the second fracture 520 to propagate into the region 510. Even though first fracture 515 is referred to as a sacrificial fracture, in present day technology prior to using this technique, first fracture 515 is the result of a conventionally placed fracture; thus offering conventional level of benefits.

Figure 6:
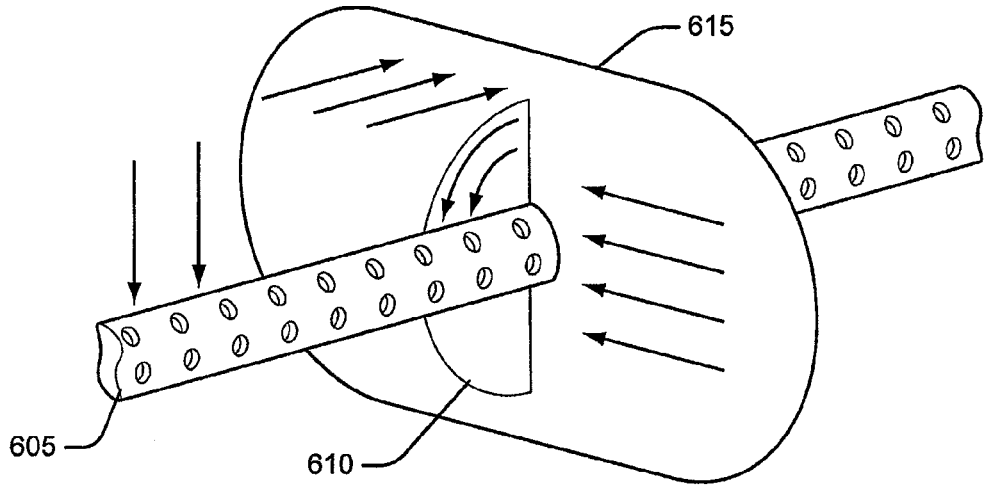
FIG. 6 is a graphical representation of drainage into a horizontal wellbore fractured at different angular orientations.

FIG. 6 illustrates fluid drainage from a formation into a horizontal wellbore 605 that has been fractured according to method 100. In this situation, the effective surface area for drainage into the wellbore 605 is increased substantially by fracture 615. However, production flow through this fracture has to travel radially to the wellbore, thus creating a massive constriction at the wellbore. In the example shown in FIG. 6, a second, smaller fracture is created allowing fluid flow along fractures 610 and 615 are able to enter the wellbore 605. In addition, flow in fracture 615 does not have to enter the wellbore radially. FIG. 6 also shows flow entering the fracture 615 in a parallel manner; which then flows through the fracture 615 in a parallel fashion into fracture 610. This scenario causes very effective flow channeling into the wellbore.

Figure 8:
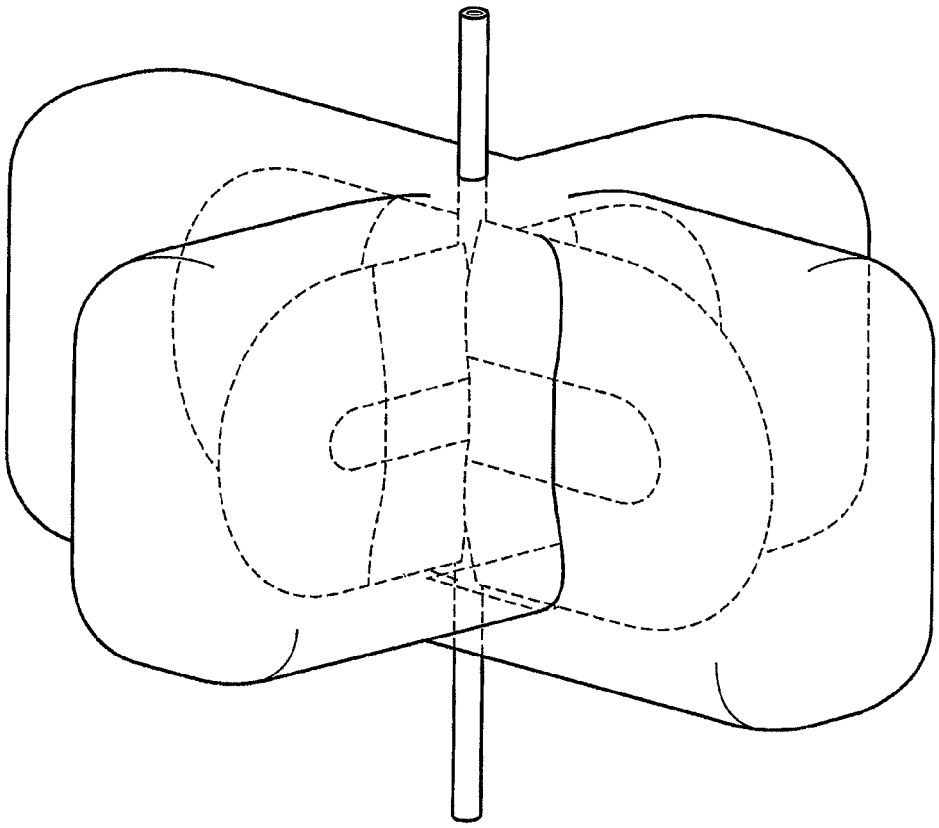
FIG. 8 is a graphical representation of the drainage of a vertical wellbore fractured at different angular orientations.

In general, additional fractures, regardless of their orientation, provide more drainage into a wellbore. Each fracture will drain a portion of the formation. Multiple fractures having different angular orientations, however, provide more coverage volume of the formation, as shown by the example drainage areas illustrated in FIG. 8. The increased volume of the formation drained by the multiple fractures with different orientations may cause the well to produce more fluid per unit of time.

Figure 7A:
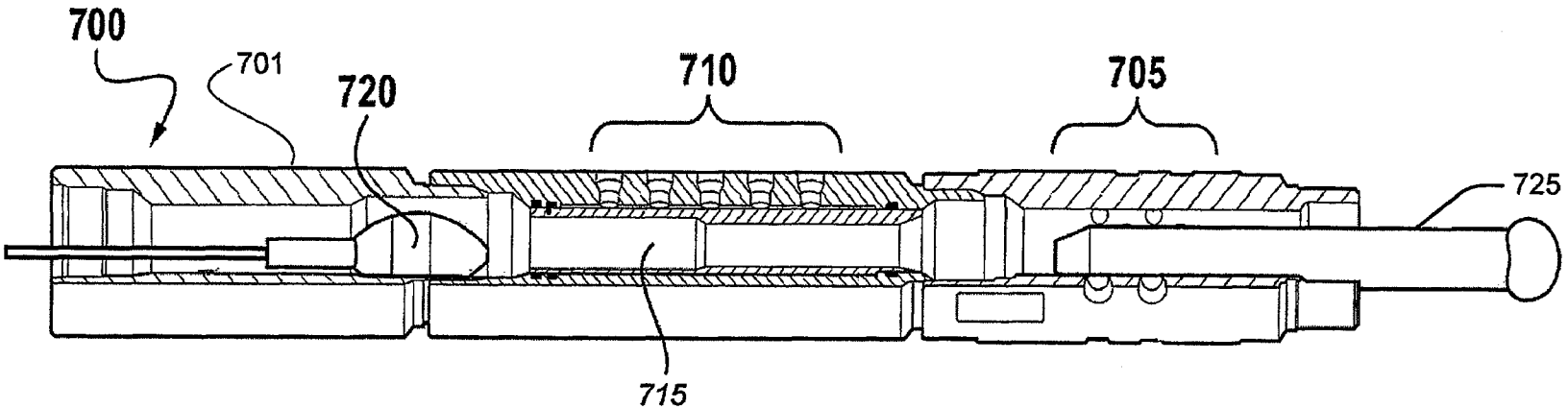
FIGS. 7A, 7B, and 7C illustrate a cross-sectional view of a fracturing tool showing certain optional features in accordance with one example implementation.
Figure 7B:
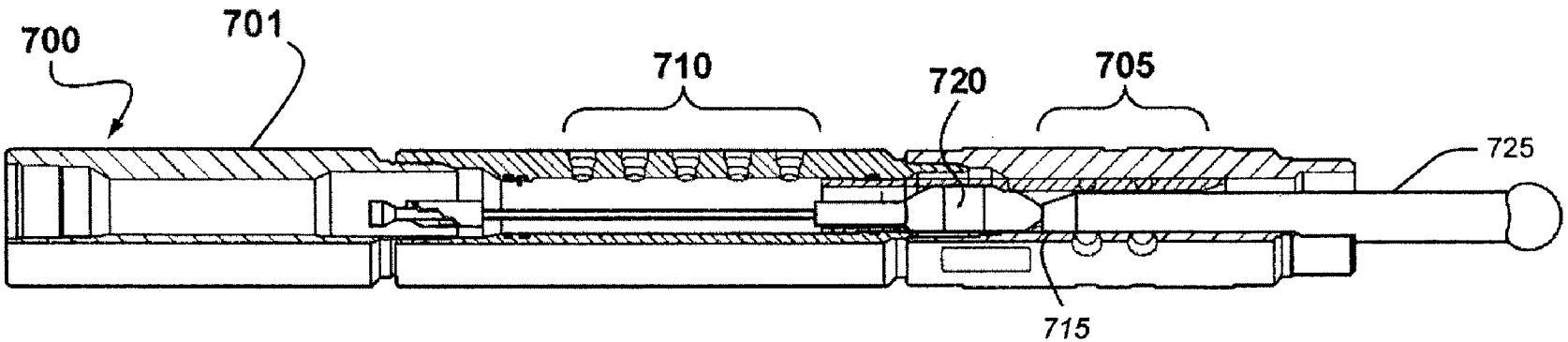
Figure 7C:
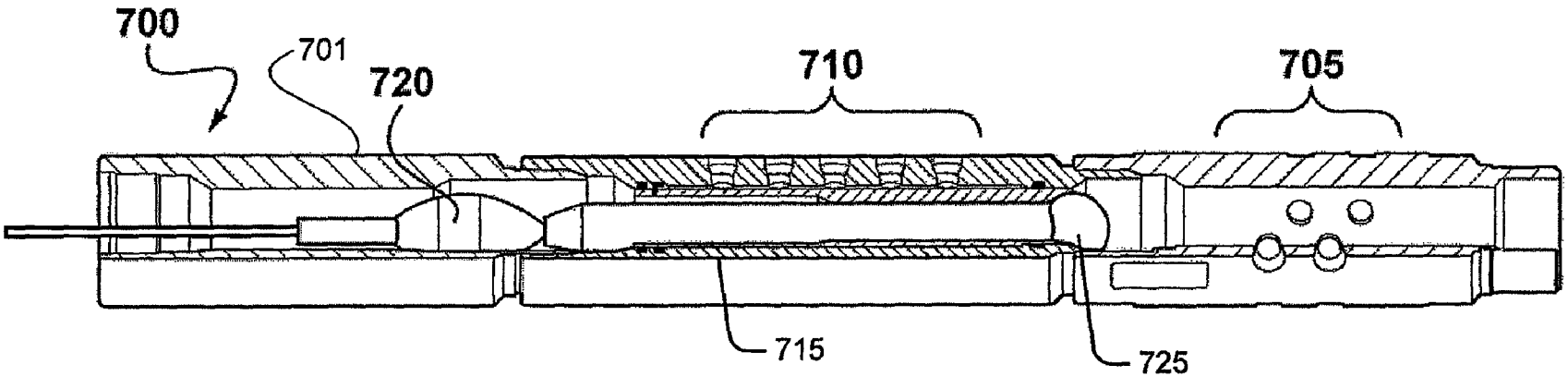

A cut-away view of an example fracturing tool 125, shown generally at 700, that may be used with method 300 is shown in FIGS. 7A-7C. The fracturing tool 700 includes at least two fracturing sections, such as fracturing sections 705 and 710. Each of sections 705 and 710 are configured to fracture at an angular orientation, based on the design of the section. In one example implementation, fluid flowing from section 710 may be oriented obliquely, such as between 45° to 90°, with respect to fluid flowing from section 705. In another implementation fluid flow from sections 705 and 710 are substantially perpendicular.

The fracturing tool includes a selection member 715, such as sleeve, to activate or arrest fluid flow from one or more of sections 705 and 710. In the illustrated implementation selection member 715 is a sliding sleeve, which is held in place by, for example, a detent. While the selection member 715 is in the position shown in FIG. 7A, fluid entering the tool body 701 exits though section 705.

A valve, such as ball valve 725 is at least partially disposed in the tool body 701. The ball valve 725 includes an actuating arm allowing the ball valve 725 to slide along the interior of tool body 701, but not exit the tool body 701. In this way, the ball valve 725 prevents the fluid from exiting from the end of the fracturing tool 125. The end of the ball valve 725 with actuating arm may be prevented from exiting the tool body 701 by, for example, a ball seat (not shown).

The fracturing tool further comprises a releasable member, such as dart 720, secured behind the sliding sleeve. In one example implementation, the dart is secured in place using, for example, a J-slot.

In one example implementation, once the fracture is induced by sections 705, the dart 720 is released. In one example implementations, the dart is released by quickly and briefly flowing the well to release a j-hook attached to the dart 720 from a slot. In other example implementations, the release of the dart 720 may be controlled by the control unit 135 activating an actuator to release the dart 720. As shown in FIG. 7B, the dart 720 causes the selection member 715 to move forward causing fluid to exit though section 710.

As shown in FIG. 7C, the ball valve 725 with actuating arm may reset the tool by forcing the dart 720 back into a locked state in the tool body 701. The ball valve 725 also may force the selection member 715 back to its original position, before fracturing was initiated. The ball valve 725 may be forced back into the tool body 701 by, for example, flowing the well.

Figure 9:
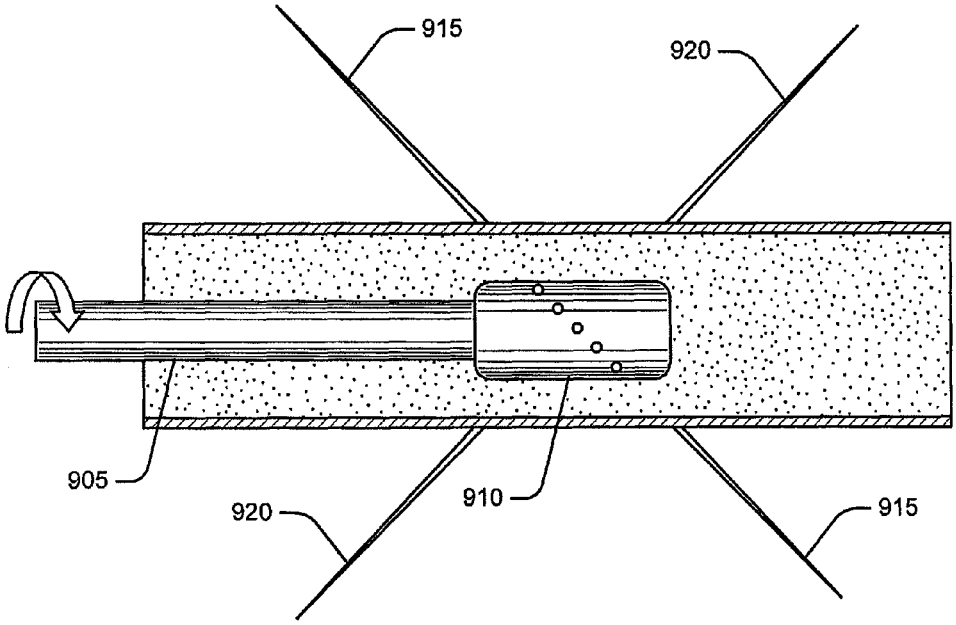
FIG. 9 is a graphical representation of a fracturing tool rotating in a horizontal wellbore and fractures induced by the fracturing tool.

Another example fracturing tool 125 is shown in FIG. 9. Tool body 910 receives fracturing fluid though a drill string 905. The tool body has an interior and an exterior. Fracturing passages pass from the interior to the exterior at an angle, causing fluid to exit from the tool body 910 at an angle, relative to the axis of the wellbore. Because of the angular orientation of the fracturing passages, multiple fractures with different angular orientations may be induced in the formation by reorienting the tool body 910. In one example implementation, the tool body is rotated to reorient the tool body 910 to fracture at different orientations and create fractures 915 and 920. For example, the tool body 910 may be rotate about 180°. In the example implementation shown in FIG. 9 where the fractures 915 and 920 are induced in a horizontal or deviated portion of a wellbore, the drill string 905 may be rotated more than the desired rotation of the tool body 910 to account for friction.

Figure 10A:
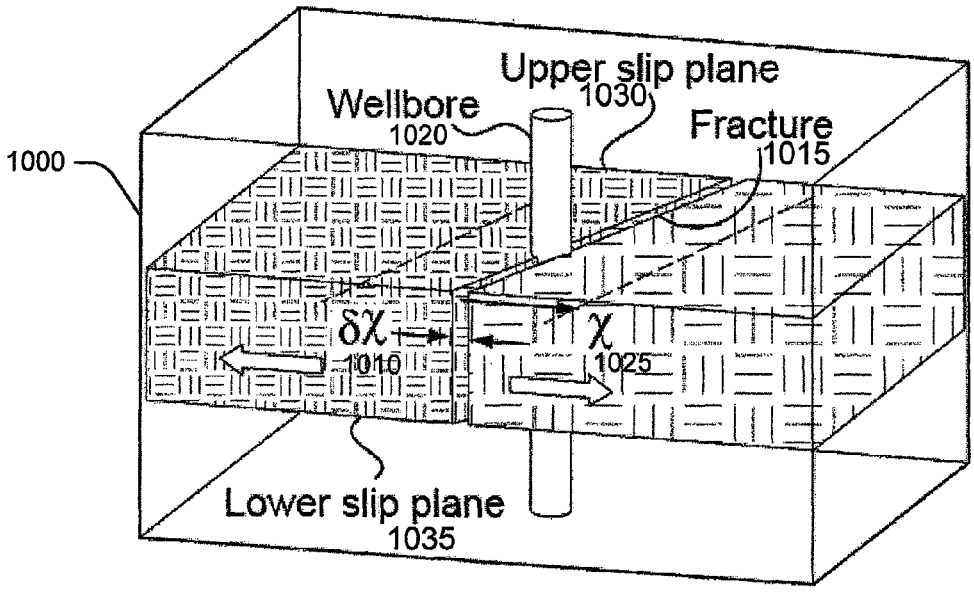
FIG. 10*a* is a graphical representation of fracture generation.

Conventional fracturing does not generally consider the time factor between each subsequent fracture. In fact subsequent fractures are sometimes initiated many hours or even days apart. The plasticity of the formation has also not been considered conventionally as a major factor in the behavior of fracture development in the formation. When plasticity or creep is factored into evaluation of stimulating a well bore, time becomes a major factor as to where a fracture will initiate and extend. FIG. 10*a* illustrates a more realistic "plastic" behavior for fracture generation given formation 1000 with wellbore 1020. As a layer or group of layers in the formation 1000 is being fracture stimulated, the fracture faces will part from each other as shown. As the fracture faces move δX 1010 from each other; the boundary of the layer separates for a distance of X 1025 from the fracture 1015. The rock beyond X 1025 is held by friction on the upper slip plane 1030 and lower slip plane 1035 as shown. At point X 1025, the rock has not moved and hence, compression forces cause the rock to expand upwards; lifting the massive mass above it. After some time, due to plastic creep, the front X 1025 will slowly move to the right; opening the fracture 1015 somewhat while relaxing the overburden stress increase.

Figure 10B:
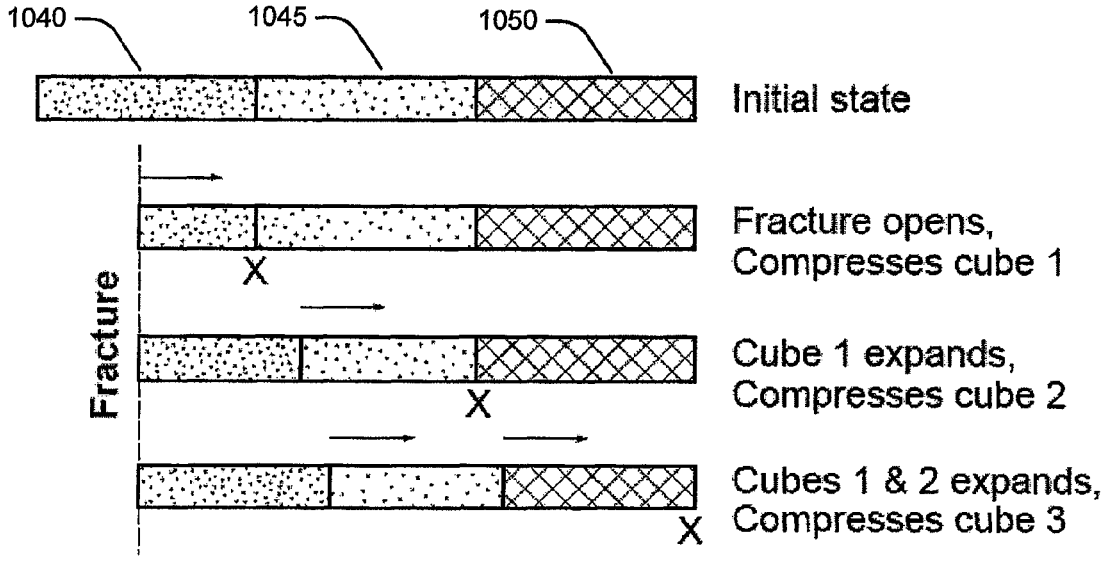
FIG. 10*b* is a graph depicting the compression creep process.

FIG. 10*b* is a graph depicting the compression creep process. A small section of the formation 1000 is divided into three sections, 1040, 1045, and 1050. As the fracture 1015 opens, compression only affects the first section 1040. Front "X" is held in position at that instant. After a first period of time, the second section 1045 begins to compress plastically and quickly followed by shearing of the bond to the bordering formations. The shearing stops just before reaching section 1050. Section 1045 quickly compresses elastically while section 1040 expands accordingly. Similarly, after a second period of time, longer than the first period of time, section 1050 begins to compress plastically. This process repeats itself until no further expansion occurs.

Figure 11:
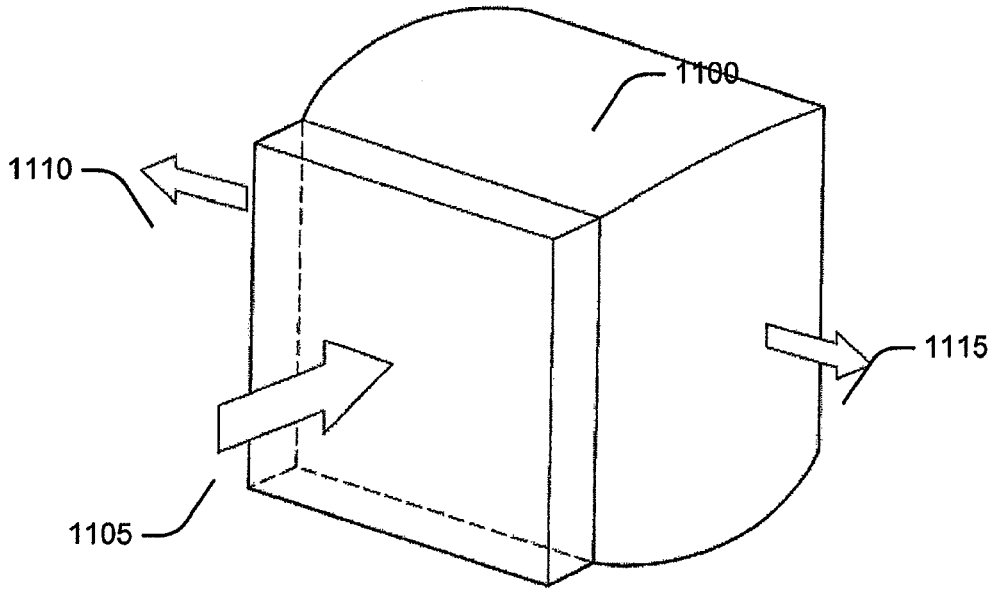
FIG. 11 is a graphical representation of stress redirection by a fracture.
Figure 12:
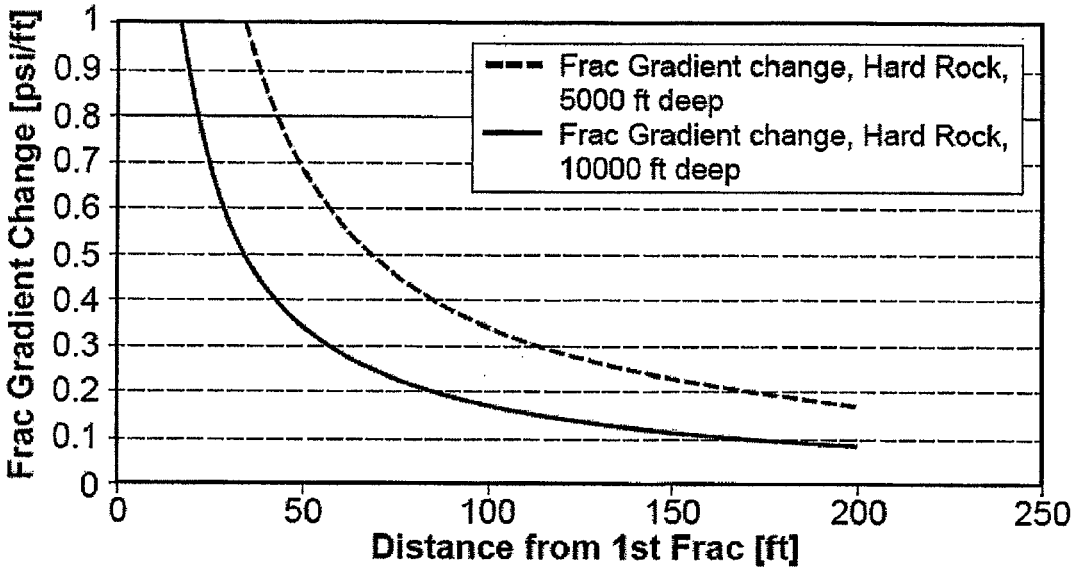
FIG. 12 is a graph depicting fracture gradient change for hard rock.

In general, FIG. 11 depicts stress redirection by a fracture. FIG. 11 shows two phenomena in the process depicted in FIG. 10*a* and FIG. 10*b*. As a fracture (not shown) opens up, the formation 1100 is being compressed directly into the direction of arrow 1105. A smaller amount of compression (as determined by the Poisson's ratio) is directed into the direction of the fracture itself as indicated by arrows 1110 and 1115. The modification of stresses into directions 1110 and 1115 depends upon the compressibility of the formation 1100 itself and is not dependent upon the location of the fracture. Frac gradients are depth dependent. Therefore, modification of frac gradients are inversely dependent to the depth of the fracture. FIG. 12 shows the fracture gradient change for hard rock (with compressibilities of 1.8E-7/psi) for two depths and the direct inverse dependency of the frac gradient effects. For the plots of FIG. 12, the fracture half-length was assumed to be 200 ft. and the fracture width during the stimulation job was 0.75" (prior to closure).

Figure 13:
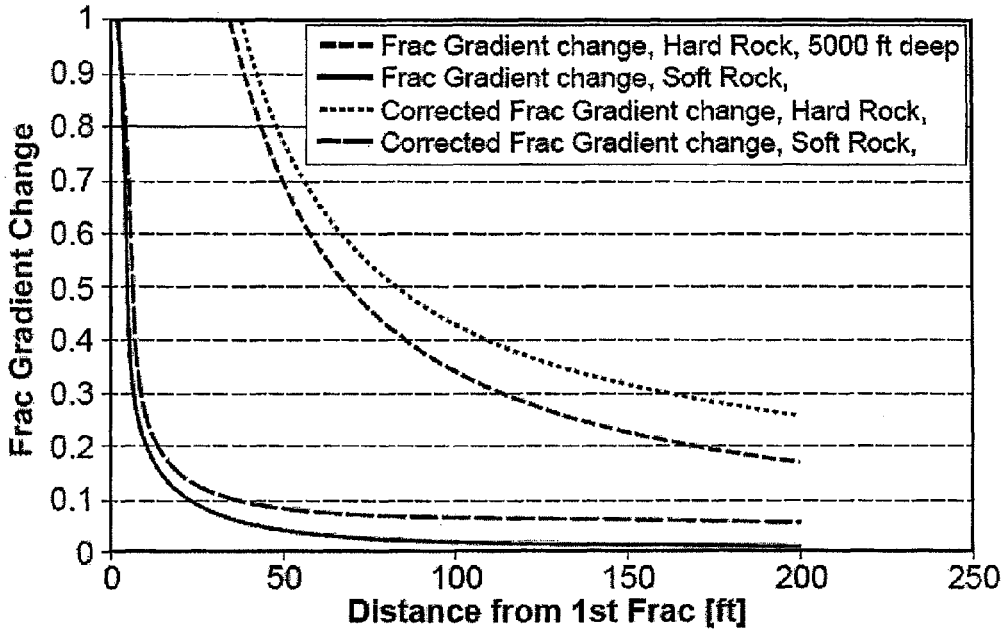
FIG. 13 is a graph depicting corrected stress change.

The second phenomenon that can be described in FIG. 11 is when a second fracture is created perpendicular to the first fracture. As the second fracture opens and extends, as per FIG. 12, the fracture stress gradient differential continues to drop with distance. For example, if the minimum and maximum stress gradients differ by 0.2 and the depth of the fracture is 10,000 ft, at approximately 90 ft the fracture will start to turn into the original fracture direction (parallel to the first fracture). However, based upon FIG. 11, the opening of the second fracture also pushes sideways as indicated by arrow 1105. Again, a smaller amount of creep movement pushes into the direction of the fracture extension as indicated by arrows 1110 and 1115. This latter "minor" push adds the maximum straight fracture extension to a few feet longer than 90 ft., as shown in FIG. 13. For sandstone formations, since it is a dilatant material and it has a volumetric creep less than zero, the "minor" push above extends the fracture even further than the previously discussed rock formations. FIG. 13 shows the added "push" that maintains the fracture to extend somewhat longer into the unnatural minimum stress direction. It should be noted, that stress modification in softer rock is much less than in harder rock. However, stress differentials in softer rocks are also much less than in harder rock. Thus, the effectiveness of this process is equally acceptable in both soft and hard rock applications.

Figure 14:
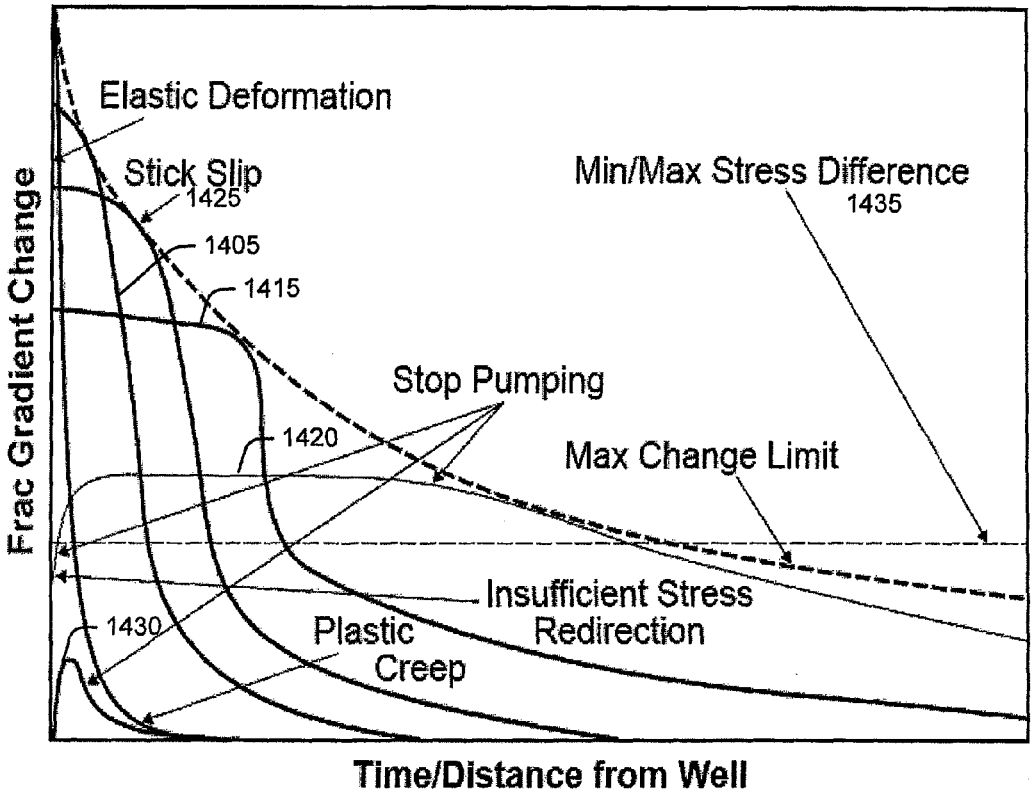
FIG. 14 is a graphical representation of creep effects in fracture development.

Plasticity relates to time. Placement of a 200 ft. fracture takes some time to perform and to allow for some occurrence of plastic creep motion. Even though the true plastic creep takes a much longer time, stick-slip motion can be characterized as behaving like plastic motion. The primary mechanics behind stick-slip motion is purely elastic and hence stick-slip motion occurs at a faster pace than true plastic creep. FIG. 12 shows that the near wellbore fracture gradient change is tremendously high. The fracture gradient change occurs during the hydraulic fracturing process. When pumping stops, the near wellbore opening can collapse so as to rapidly and significantly reduce stresses, as shown in FIG. 14. The horizontal axis and vertical of axis of FIG. 14 are the same as those shown in FIG. 12. The difference between FIG. 12 and FIG. 14 is that the time factor is normalized in order to fit the distance curve perfectly.

FIG. 14 shows that initially frac gradient changes substantially, but also elastically as represented in the first step in FIG. 10(*b*). At this time, the near wellbore rock has not yet deformed plastically, although some plastic deformation occurs throughout a certain distance from the fracture (see the bottom of line 1415). If no time delay is taken for a major plastic deformation to occur and pumping is stopped, the fracture immediately collapses, even though some minor frac gradient change occurs nearby (see line 1430). With time, the deformation front moves away from the wellbore as a result primarily of the stick-slip process as shown by lines 1405, 1410, and 1415. The maximum slip distance can be limited by some "max change limit" which basically represents the true elastic limit for the formation. For example, assume that the stress gradient difference is represented by line 1435 and that the pumping stops at a time depicted by line 1420. Then, since every position away from the wellbore has been deformed plastically, stress differences remain high with the exception of the near wellbore which drops considerably. This drop could fall below the "Min/Max Stress Difference" level 1435 and hence, fracturing using conventional fracturing processes would re-open the first fracture. However, using a hydrajet fracturing process, deep hydrajetting could cause the perforation to bypass the near-wellbore stress effects and respond to the far-field stress condition.

FIG. 15 is a graphical representation of maximizing the second fracture length based on the first fracture gradient change in order to achieve maximum fracturing. As the first fracture opens (starting from line 1505) the stress effects of the first fracture jump down from the first line 1505 to the right. This is due to the "stick-slip" process plus some of the pure "Maxwell" type creep effects. The stress effects of the first fracture continue to move to the right (lines 1510 through 1540). If pumping is stopped when stresses are as shown by line 1545 and no other fracturing is performed, the stress lines will continue to move to the right while dying off as shown by lines 1550-1555. Observing the Min/Max stress difference (line 1560), it is desirable to start the second fracture on or before the line 1540 condition. As FIG. 15 shows, line 1540 starts crossing the Min/Max difference line 1560. It is theorized, that even though line 1540 is slightly below the Min/Max difference line 1560, when using hydrajetting methods, such as SURGIFRAC$^{SM}$ techniques, introduced by Halliburton Energy Services, Inc. of Duncan, Okla., an orthogonal fracture can be created because the method could extend a little beyond the near wellbore condition. The condition depicted by line 1550 is quite too low for any process and the redirection technique will fail. On the other hand, it may be safe to start the second fracture to follow the condition depicted by line 1525. Using the condition depicted by line 1525, however, the second fracture is completed too early resulting in only a short fracture extension before the fracture bends to the natural fracture direction. The conditions depicted in FIG. 15 illustrate that compressional effects translate to upward shift in the rock which provides some condition that is detectable using tilt meters, microseismic receivers, and other equipment known to one skilled in the art. By detecting the upward shift in real time, the extension of the fracture can be sped up or slowed down to provide a maximum length second fracture.

In one embodiment, the second fracture length is less optimized by inducing the second fracture at a time delay from the inducement of the first fracture as shown byline 1540.

In another embodiment obtaining a maximum length fracture for the formation requires inducing the second fracture at a time delay from the inducement of the first fracture as shown by line 1550 in order to achieve maximum extension of the fracture of the formation.

In yet another embodiment, in order to obtain the maximum fracture length the second fracture length is optimized by inducing the second fracture at a time delay from the inducement of the first fracture as shown by line 1540 but then slowing down the fracture tip to wait for the condition depicted by line 1550 to occur.

Figure 17:
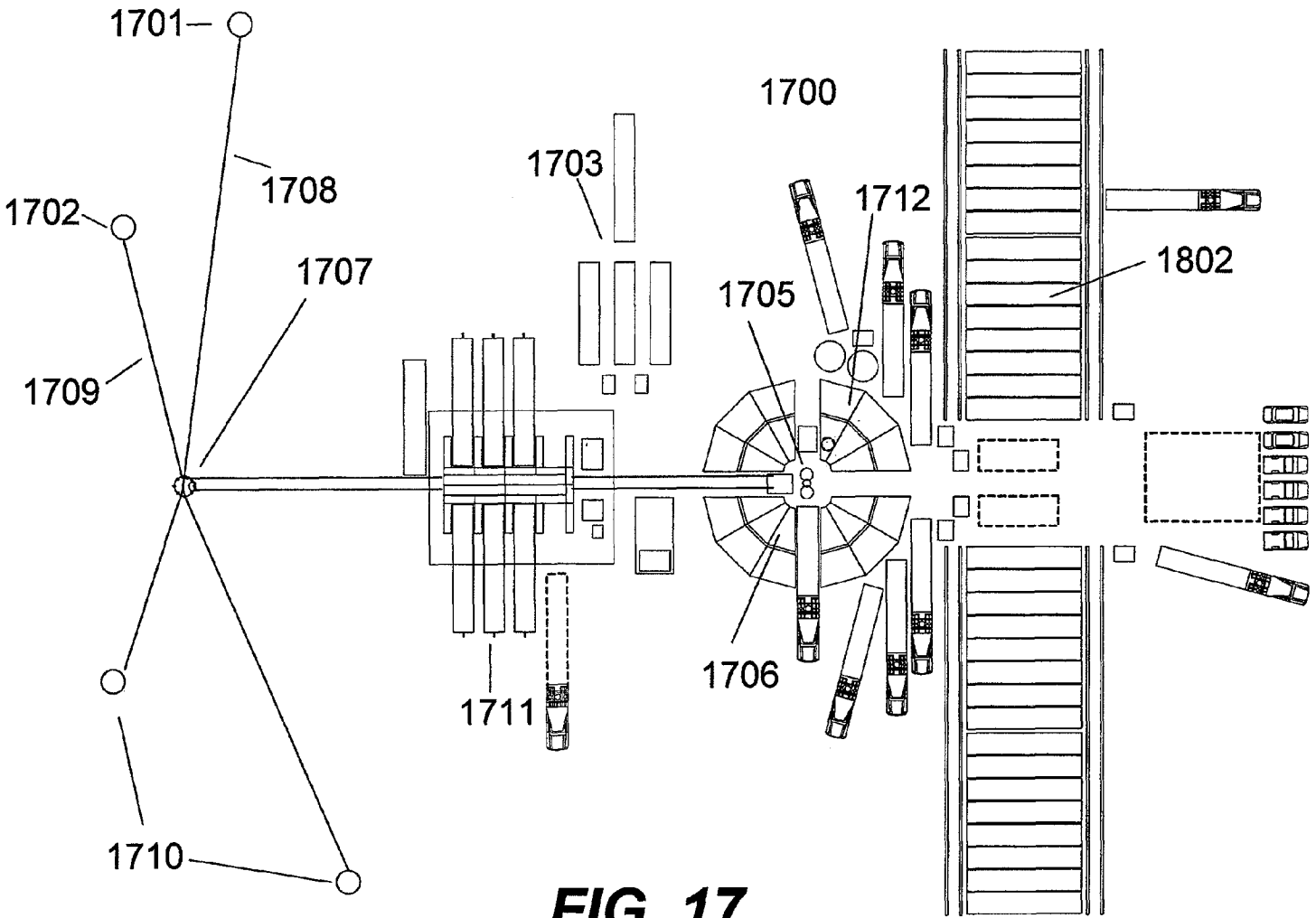
FIG. 17 is a diagram of a centralized well treatment facility.

In reference to FIG. 17, in one embodiment, a well treatment operations factory 1700 includes one or more of the following: a centralized power unit 1703; a pumping grid 1711; a central manifold 1707; a proppant storage system 1706; a chemical storage system 1712; and a blending unit 1705. In this and other embodiments, the well treatment factory may be set upon a pad from which many other wellheads on other pads 1710 may be serviced. The well treatment operations factory may be connected via the central manifold 1707 to at least a first pad 1701 containing one or more wellheads via a first connection 1708 and at least a second pad 1702 containing one or more wellheads via a second connection 1709. The connection may be a standard piping or tubing known to one of ordinary skill in the art. The factory may be open, or it may be enclosed at its location in various combinations of structures including a supported fabric structure, a collapsible structure, a prefabricated structure, a retractable structure, a composite structure, a temporary building, a prefabricated wall and roof unit, a deployable structure, a modular structure, a preformed structure, or a mobile accommodation unit. The factory may be circular and may incorporate alleyways for maintenance access and process fluid flow. The factory, and any or all of its components can be climate controlled, air ventilated and filtered, and/or heated. The heating can be accomplished with radiators, heat plumbing, natural gas heaters, electric heaters, diesel heaters, or other known equivalent devices. The heating can be accomplished by convection, radiation, conduction, or other known equivalent methods.

In one embodiment of the centralized power unit 1703, the unit provides electrical power to all of the subunits within the well operations factory 1700 via electrical connections. The centralized power unit 1703 can be powered by liquid fuel, natural gas, or other equivalent fuel and may optionally be a cogeneration power unit. The unit may comprise a single trailer with subunits, each subunit with the ability to operate independently. The unit may also be operable to extend power to one or more outlying wellheads.

Figure 24:
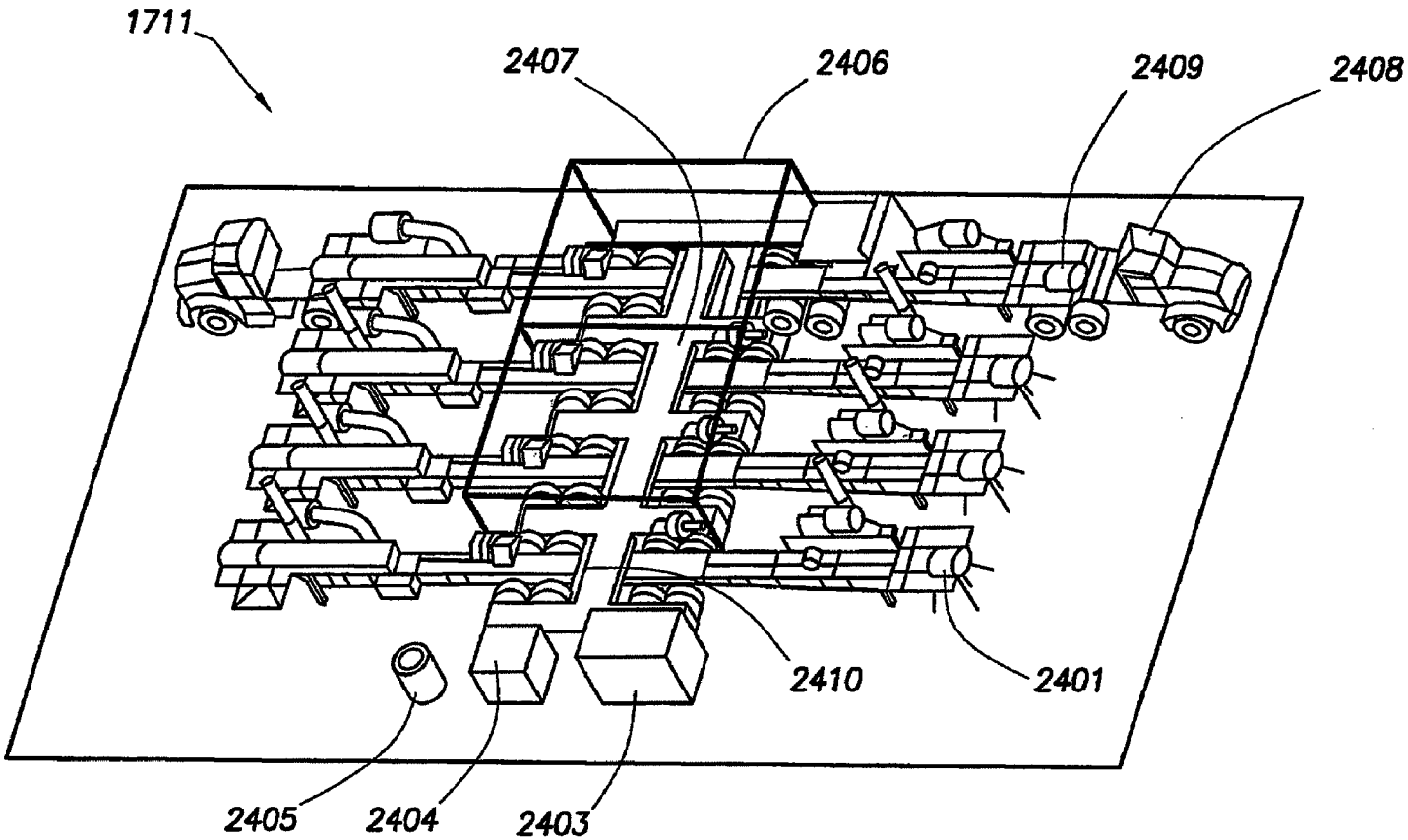
FIG. 24 is an aerial view of the pumping grid apparatus.

In one embodiment, the proppant storage system 1706 is connected to the blending unit 1705 and includes automatic valves and a set of tanks that contain proppant. Each tank can be monitored for level, material weight, and the rate at which proppant is being consumed. This information can be transmitted to a controller or control area. Each tank is capable of being filled pneumatically and can be emptied through a calibrated discharge chute by gravity. Gravity can be the substantial means of delivering proppant from the proppant tank. The tanks may also be agitated in the event of clogging or unbalanced flow. The proppant tanks can contain a controlled, calibrated orifice. Each tank's level, material weight, and calibrated orifice can be used to monitor and control the amount of desired proppant delivered to the blending unit. For instance, each tank's orifice can be adjusted to release proppant at faster or slower rates depending upon the needs of the formation and to adjust for the flow rates measured by the change in weight of the tank. Each proppant tank can contain its own air ventilation and filtering. In reference to FIG. 17, the tanks 1706 can be arranged around each blending unit 1705 within the enclosure, with each tank's discharge chute located above the blending unit 1705. The discharge chute can be connected to a surge hopper. In one embodiment, proppant is released from the proppant storage unit 1706 through a controllable gate in the unit. When the gate is open, proppant travels from the proppant storage unit into the discharge chute. The discharge chute releases the proppant into the surge hopper. In this embodiment, the surge hopper contains a controlled, calibrated orifice or aperture that releases proppant from the surge hopper at a desired rate. The amount of proppant in the surge hopper is maintained at a substantially constant level. Each tank can be connected to a pneumatic refill line. The tanks' weight can be measured by a measurement lattice 2406 (shown in FIG. 24) or by weight sensors or scales. The weight of the tanks can be used to determine how much proppant is being used during a well stimulation operation, how much total proppant was used at the completion of a well stimulation operation, and how much proppant remains in the storage unit at any given time. Tanks may be added to or removed from the storage system as needed. Empty storage tanks may be in the process of being filled by proppant at the same time full or partially full tanks are being used, allowing for continuous operation. The tanks can be arranged around a calibrated v-belt conveyor. In addition, a resin-coated proppant may be used by the addition of a mechanical proppant coating system. The coating system may be a Muller System.

In one embodiment, the chemical storage system 1712 is connected to the blending unit and can include tanks for breakers, gel additives, crosslinkers, and liquid gel concentrate. The tanks can have level control systems such as a wireless hydrostatic pressure system and may be insulated and heated. Pressurized tanks may be used to provide positive pressure displacement to move chemicals, and some tanks may be agitated and circulated. The chemical storage system can continuously meter chemicals through the use of additive pumps which are able to meter chemical solutions to the blending unit 1705 at specified rates as determined by the required final concentrations and the pump rates of the main treatment fluid from the blending unit. The chemical storage tanks can include weight sensors that can continuously monitor the weight of the tanks and determine the quantity of chemicals used by mass or weight in real-time, as the chemicals are being used to manufacture well treatment fluid. Chemical storage tanks can be pressurized using compressed air or nitrogen. They can also be pressurized using variable speed pumps using positive displacement to drive fluid flow. The quantities and rates of chemicals added to the main fluid stream are controlled by valve-metering control systems. The valve-metering can be magnetic mass or volumetric mass meters. In addition, chemical additives could be added to the main treatment fluid via aspiration (Venturi Effect). The rates that the chemical additives are aspirated into the main fluid stream can be controlled via adjustable, calibrated apertures located between the chemical storage tank and the main fluid stream. In the case of fracturing operations, the main fluid stream may be either the main fracture fluid being pumped or may be a slip stream off of a main fracture fluid stream. In one embodiment, the components of the chemical storage system are modularized allowing pumps, tanks, or blenders to be added or removed independently.

Figure 18:
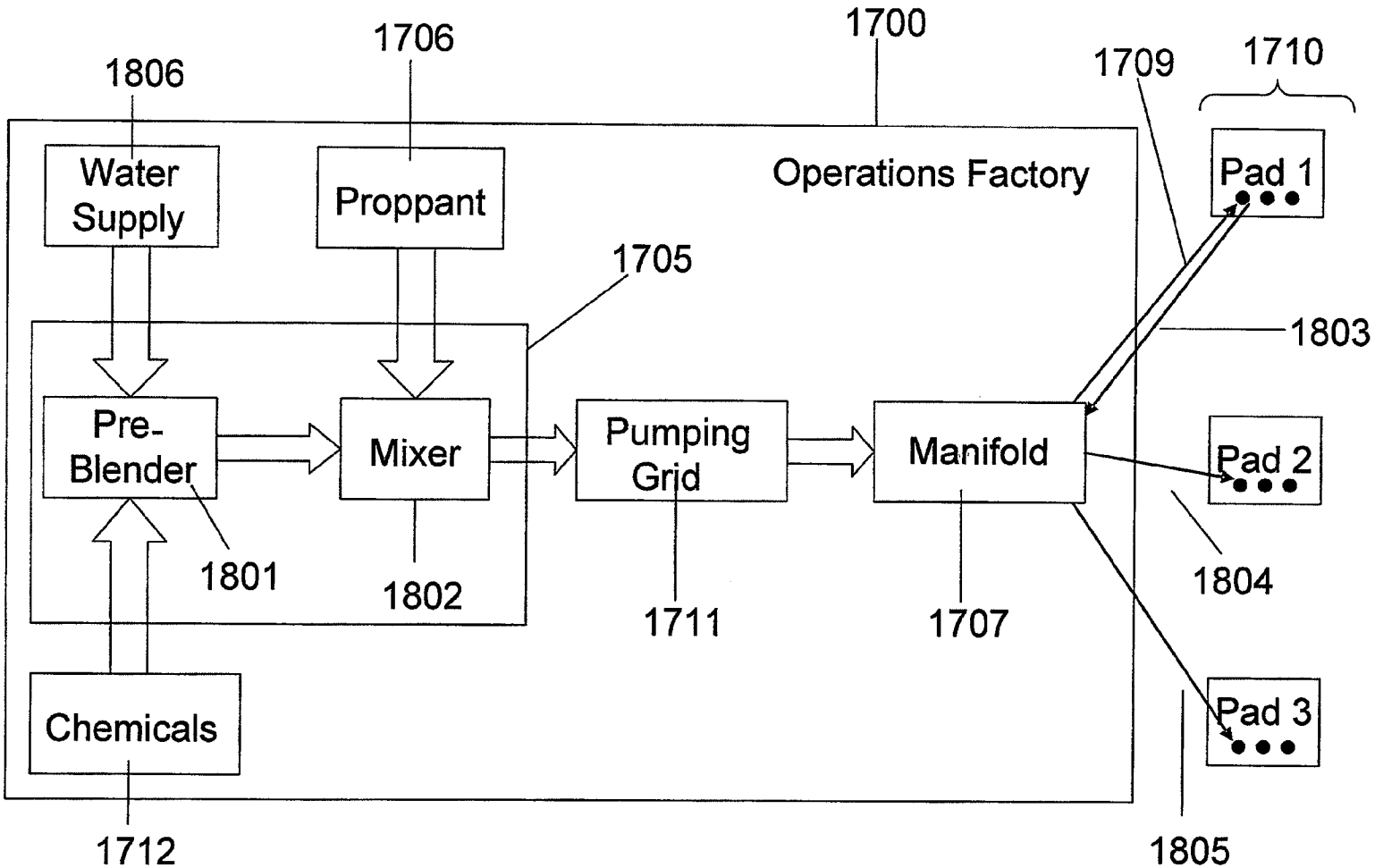
FIG. 18 is a flow diagram of a centralized well treatment facility.

In reference to FIG. 18, in one embodiment, the blending unit 1705 is connected to the chemical storage system 1712, the proppant storage system 1706, a water supply 1806, and a pumping grid 1711 and may prepare a fracturing fluid, complete with proppant and chemical additives or modifiers, by mixing and blending fluids and chemicals at continuous rates according to the needs of a well formation. The blending unit 1705 comprises a preblending unit 1801 wherein water is fed from a water supply 1806 and dry powder (guar) or liquid gel concentrate can be metered from a storage tank by way of a screw conveyor or pump into the preblender's fluid stream where it is mixed with water and blended with various chemical additives and modifiers provided by the chemical storage system 1712. These chemicals may include crosslinkers, gelling agents, viscosity altering chemicals, pH buffers, modifiers, surfactants, breakers, and stabilizers. This mixture is fed into the blending unit's hydration device, which provides a first-in-first-out laminar flow. This now near fully hydrated fluid stream is blended in the mixer 1802 of the blending unit 1705 with proppant from the proppant storage system to create the final fracturing fluid. This process can be accomplished at downhole pump rates. The blending unit can modularized allowing its components to be easily replaced. In one embodiment, the mixing apparatus is a modified Halliburton Growler mixer modified to blend proppant and chemical additives to the base fluid without destroying the base fluid properties but still providing ample energy for the blending of proppant into a near fully hydrated fracturing fluid. The final fluid can be directed to a pumping grid 1711 and subsequently directed to a central manifold 1707, which can connect and direct the fluid via connection 1709, 1804, or 1805 to multiple pads 1710 simultaneously. In one embodiment, the fracturing operations factory can comprise one or more blending units each coupled to one or more of the control units, proppant storage system, the chemical storage system, the pre-gel blending unit, a water supply, the power unit, and the pumping grid. Each blending unit can be used substantially simultaneously with any other blending unit and can be blending well treatment fluid of the same or different composition than any other blending unit.

In one embodiment, the blending unit does not comprise a pre-blending unit. Instead, the fracturing operations factory contains a separate pre-gel blending unit. The pre-gel blending unit is fed from a water supply and dry powder (guar) can be metered from a storage tank into the preblender's fluid stream where it is mixed with water and blended and can be subsequently transferred to the blending unit. The pre-gel blending unit can be modular, can also be enclosed in the factory, and can be connected to the central control system.

Figure 19:
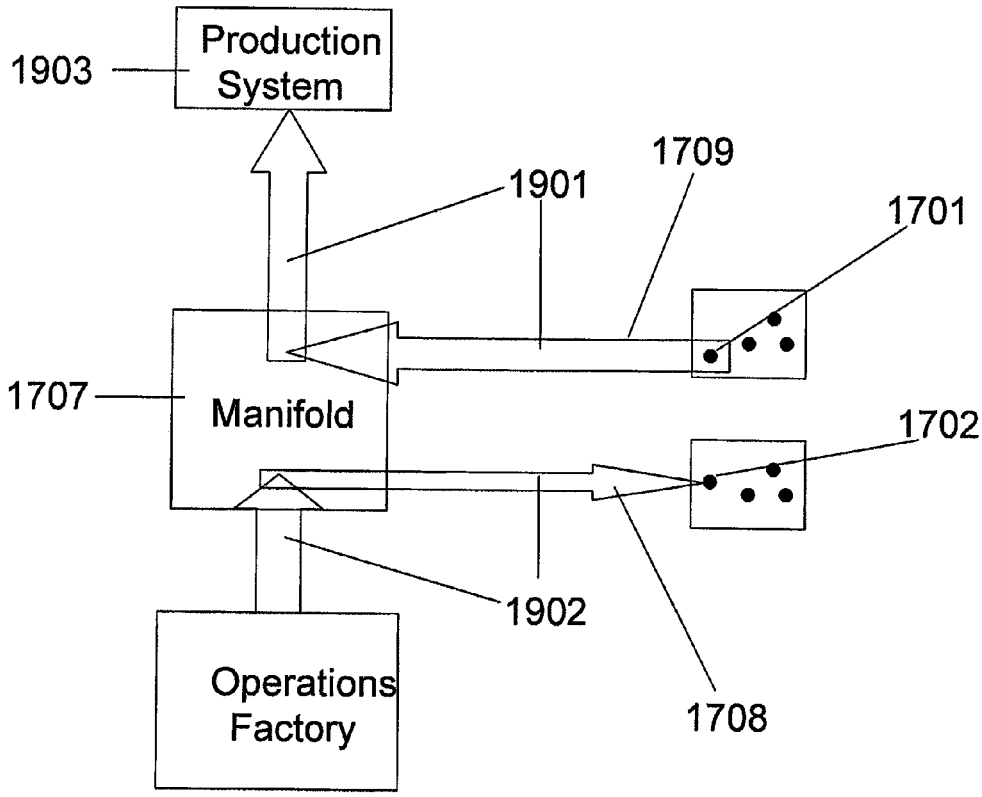
FIG. 19 is a flow diagram of central manifold used to treat wells and recover production fluid.

In one embodiment, the means for simultaneously flowing treatment fluid is a central manifold 1707. The central manifold 1707 is connected to the pumping grid 1711 and is operable to flow stimulation fluid, for example, to multiple wells at different pads simultaneously. The stimulation fluid can comprise proppant, gelling agents, friction reducers, reactive fluid such as hydrochloric acid, and can be aqueous or hydrocarbon based. The manifold 1707 is operable to treat simultaneously two separate wells, for example, as shown in FIG. 18 via connections 1804 and 1805. In this example, multiple wells can be fractured simultaneously, or a treatment fluid can be flowed simultaneously to multiple wells. The treatment fluid flowed can be of the same composition or different. These flows can be coordinated depending on a well's specific treatment needs. In addition, in reference to FIG. 19, the connection 1709 between the central manifold 1707 and a well location can be used in the opposite direction as shown in FIG. 18 to flow a production fluid, such as water or hydrocarbons, or return the well treatment fluid 1901 from the well location to the manifold. From the central manifold 1707, the production fluid can be directed to a production system 1903 where it can be stored or processed or, in the case of the returning well treatment fluid, to a reclamation system that can allow components of returning fluid to be reused. The manifold is operable to receive production fluid or well treatment fluid from a first well location 1701 while simultaneously flowing treatment fluid 1902 using a second connection 1709 to a second well location 1702. The central manifold 1707 is also operable to receive production fluid from both the first well location and the second well location simultaneously. In this embodiment, the first and second well locations can be at the same or different pads (as shown in FIG. 19). The manifold is also operable to extend multiple connections to a single well location. In reference to FIG. 18, in one embodiment, two connections are extended from the manifold to a single well location. One connection 1709 may be used to deliver well treatment fluid to the well location while the other connection 1803 may be used to deliver production fluid or return well treatment fluid from the well location to the central manifold 1707.

Figure 20:
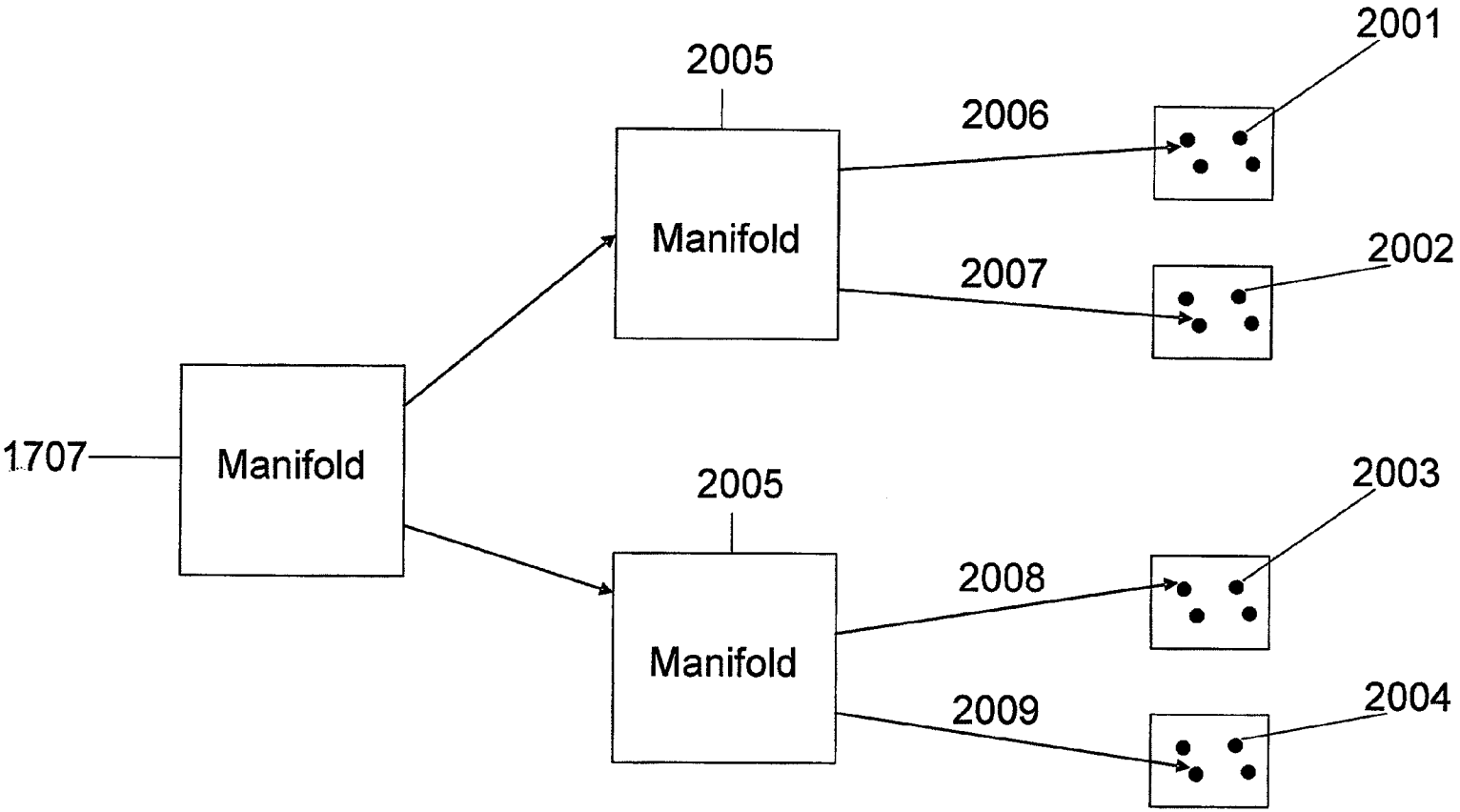
FIG. 20 is a diagram of a multiple manifold well treatment system.

In reference to FIG. 20, in one embodiment, the central manifold 1707 can be connected to one or more additional manifolds 2005. The additional manifolds are operable to connect to multiple well locations 2001-2004 and deliver well treatment fluids and receive production fluids via connections 2006-2009, respectively, in the same way as the central manifold 1707 described above in reference to FIGS. 18 and 19. The additional manifolds can be located at the well pads.

Figure 21:
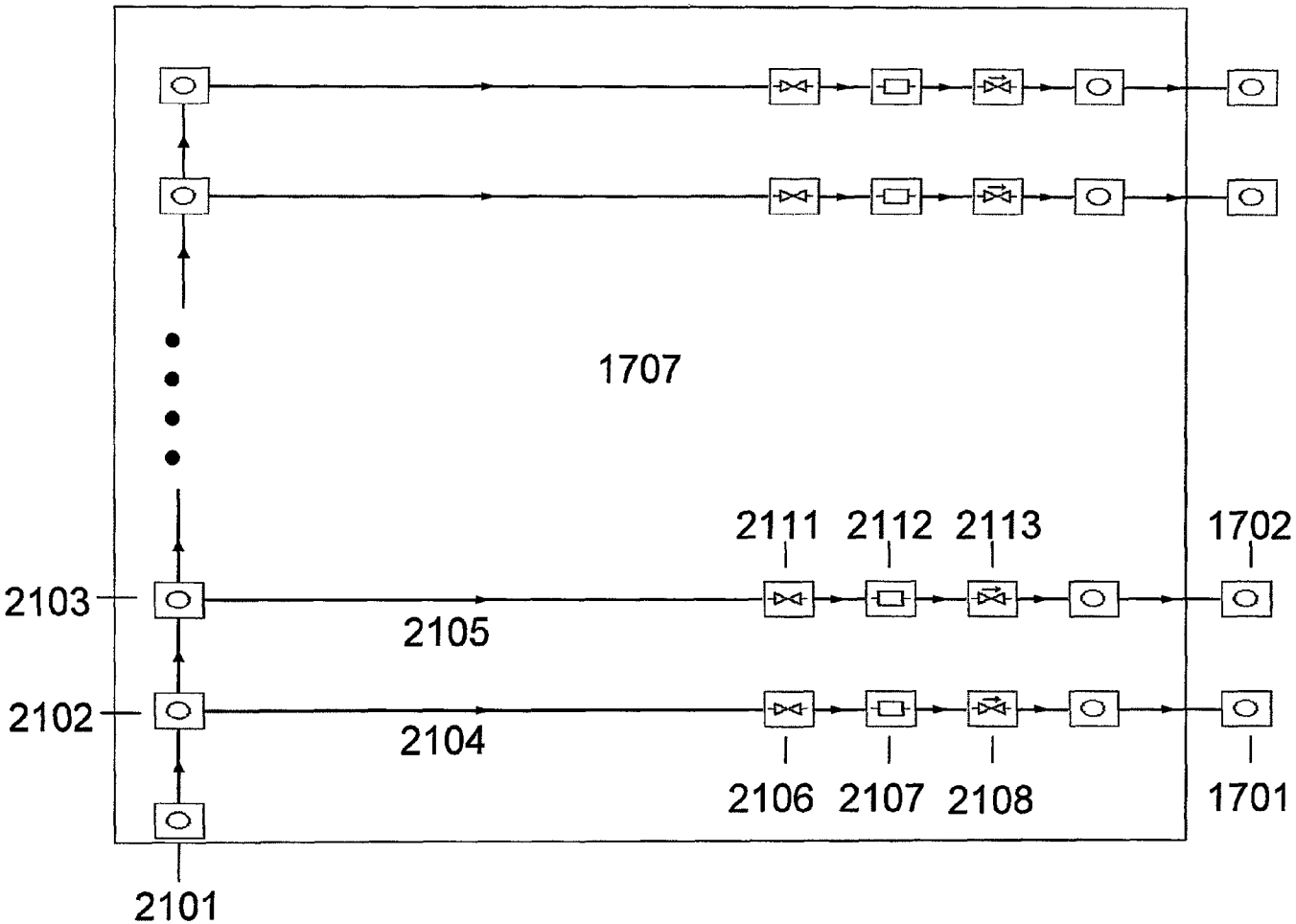
FIG. 21 is a schematic of a manifold apparatus for directing treatment fluid.

In reference to FIG. 21, in one embodiment, the central manifold has an input 2101 that accepts pressurized stimulating fluid, fracturing fluid, or well treatment fluid from a pump truck or a pumping grid 1711. The fluid flows into input 2101 and through junctions 2102 and 2103 to lines 2104 and 2105. Line 2104 contains a valve 2106, a pressure sensor 2107, and an additional valve 2108. The line is connected to well head 1701. Line 2105 contains a valve 2111, a pressure sensor 2112, and an additional valve 2113. These valves may be either plug valves or check valves and can be manually or electronically monitored and controlled. The pressure sensor may be a pressure transducer and may also be manually or electronically monitored or controlled. Line 2104 is connected to well head 1701 and line 2105 is connected to well head 1702. This configuration allows wells 1701 and 1702 to be stimulated individually and at a higher rate, by opening the valves along the line to the well to be treated while the valves along the other line are closed, or simultaneously at a lower rate, by opening the valves on both lines at the same time. As shown in FIG. 21, this architecture can be easily expanded to accommodate additional wells by the addition of junctions, lines, valves, and pressure sensors as illustrated. This architecture also allows monitoring the operations of the manifold and detecting leaks. By placing pressure sensors 2107 and 2112 between valves 2106 and 2108 and valves 2111 and 2113 respectively, the pressure of lines 2104 and 2105 can be readily determined during various phases of operation. For instance, when the manifold is configured to stimulate only well 1701, valves 2111 and 2113 are closed. Pressure sensor 2107 can detect the pressure within the active line 2104, and pressure sensor 2112 can be used to detect if there is any leakage, as it would be expected that the pressure in line 2105 in this configuration would be minimal. In another embodiment, only a single valve is used along each of lines 2104 and 2105. This embodiment can be used to stimulate wells simultaneously or singly as well. Furthermore, as described in reference to FIG. 20, the manifold of this embodiment can also work in reverse and transfer fluid from the wellhead back through the manifold and to the central location. In this configuration, input 2101 can be connected to a production system or reclamation system, for example, and the valves along the line connected to the wellhead in which it is desirable to recover fluid are open. The valves along the other lines may be open or closed depending on whether it is desirable to recover fluids from the wellheads connected to those lines. Production fluid or stimulation fluid can be returned from the wellhead to those systems respectively. This manifold can be located at the central location or at a remote pad.

Figure 22:
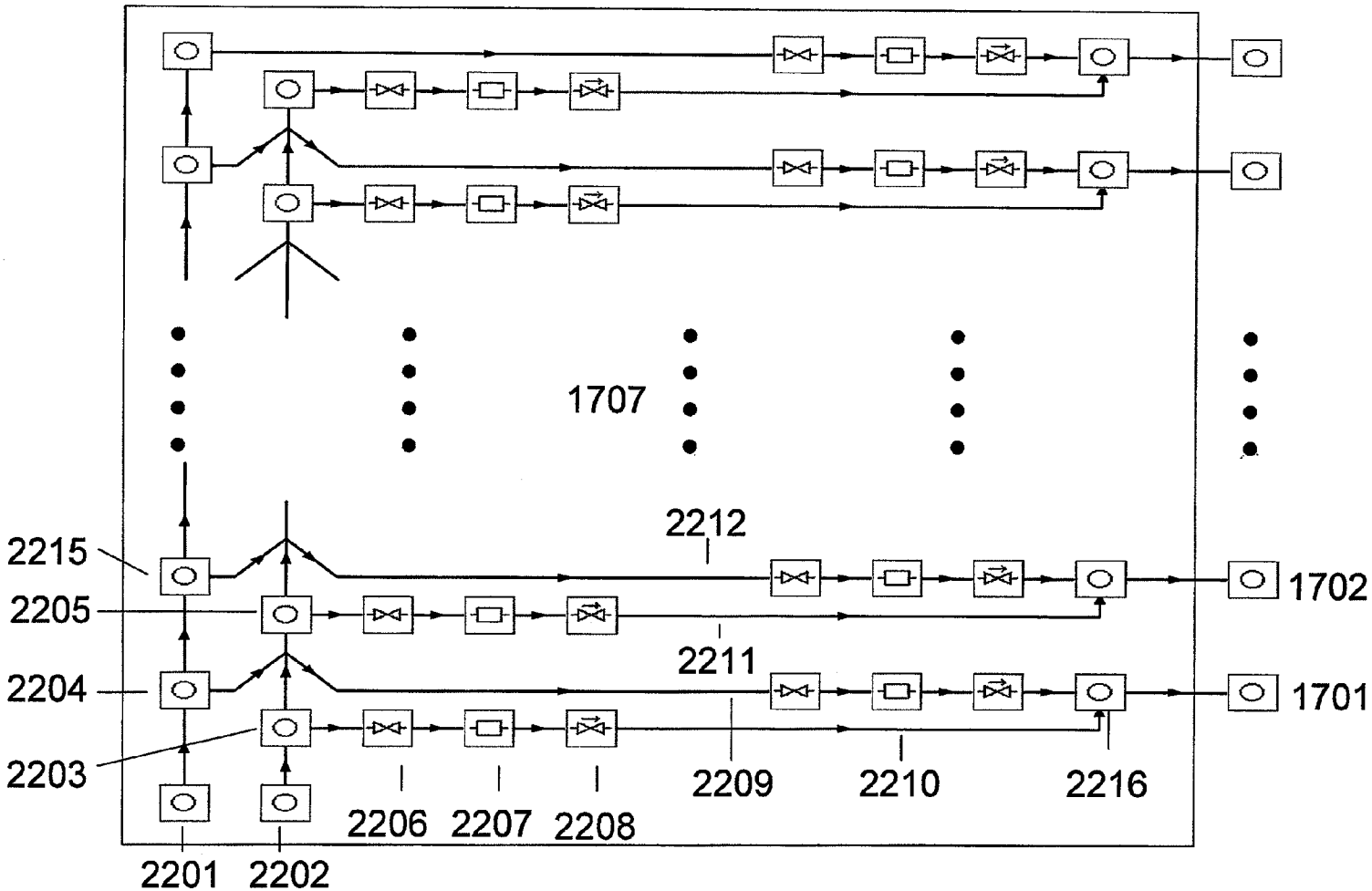
FIG. 22 is a schematic of a manifold apparatus for directing treatment fluid.

In reference to FIG. 22, in one embodiment, the central manifold contains two inputs 2201 and 2202 that accept pressurized stimulating fluid, fracturing fluid, or well treatment fluid from pump trucks or a pumping grid 1711. Inputs 2201 and 2202 can accept fluid of different or the same compositions at similar or different pressures and rates. The fluid pumped through input 2202 travels through junctions 2203 and 2205. The junctions are further connected to lines 2210 and 2211. The fluid pumped through input 2201 travels through junctions 2204 and 2215. The junctions are further connected to lines 2209 and 2212. Lines 2209, 2210, 2211, and 2212 may each contain a valve 2206, a pressure sensor 2207, and an additional valve 2208, or may contain only a single valve. These valves may be either plug valves or check valves and can be manually or electronically monitored and controlled. The pressure sensor may be a pressure transducer and may also be manually or electronically monitored or controlled. When, for example, the fluid from input 2202 is desired to be delivered to well 1701 only, the valves on line 2210 are open and the valves on line 2211 are closed. When the fluid from input 2201 is desired to be delivered to well 1701 only, the valves on line 2209 are open and the valves on line 2212 are closed. When it is desired that fluid from both inputs 2201 and 2202 are to be delivered to well 1701 only, the valves on lines 2209 and 2210 are open and the valves on lines 2211 and 2212 are closed. Lines 2209 and 2210 are coupled to wellhead 1701 through junction 2216. When it is desired that fluid from input 2202 be delivered to both wells 1701 and 1702 simultaneously, the valves on lines 2210 and 2211 are both open. Fluid from input 2201 can be delivered to well 1701 and fluid from input 2202 can be delivered to well 1702 simultaneously by closing the valves on lines 2210 and 2212 and opening the valves on lines 2211 and 2209. The delivery of fluid to well 1702 works analogously. As shown in FIG. 22, the manifold can be easily expanded to include additional wells through additional junctions, lines, and valves. Furthermore, as described in reference to FIG. 20, the manifold of this embodiment can also work in reverse and transfer fluid from the wellhead back through the manifold and to the central location. In this configuration, either or both inputs 2201 and 2202 can be connected to a production system or reclamation system, for example, and the valves along the line connected to the wellhead in which it is desirable to recover fluid are open. The valves along the other lines may be open or closed depending on whether it is desirable to recover fluids from the wellheads connected to those lines. Production fluid or stimulation fluid can be returned from the wellhead to those systems respectively. This manifold can be located at the central location or at a remote pad.

Figure 23:
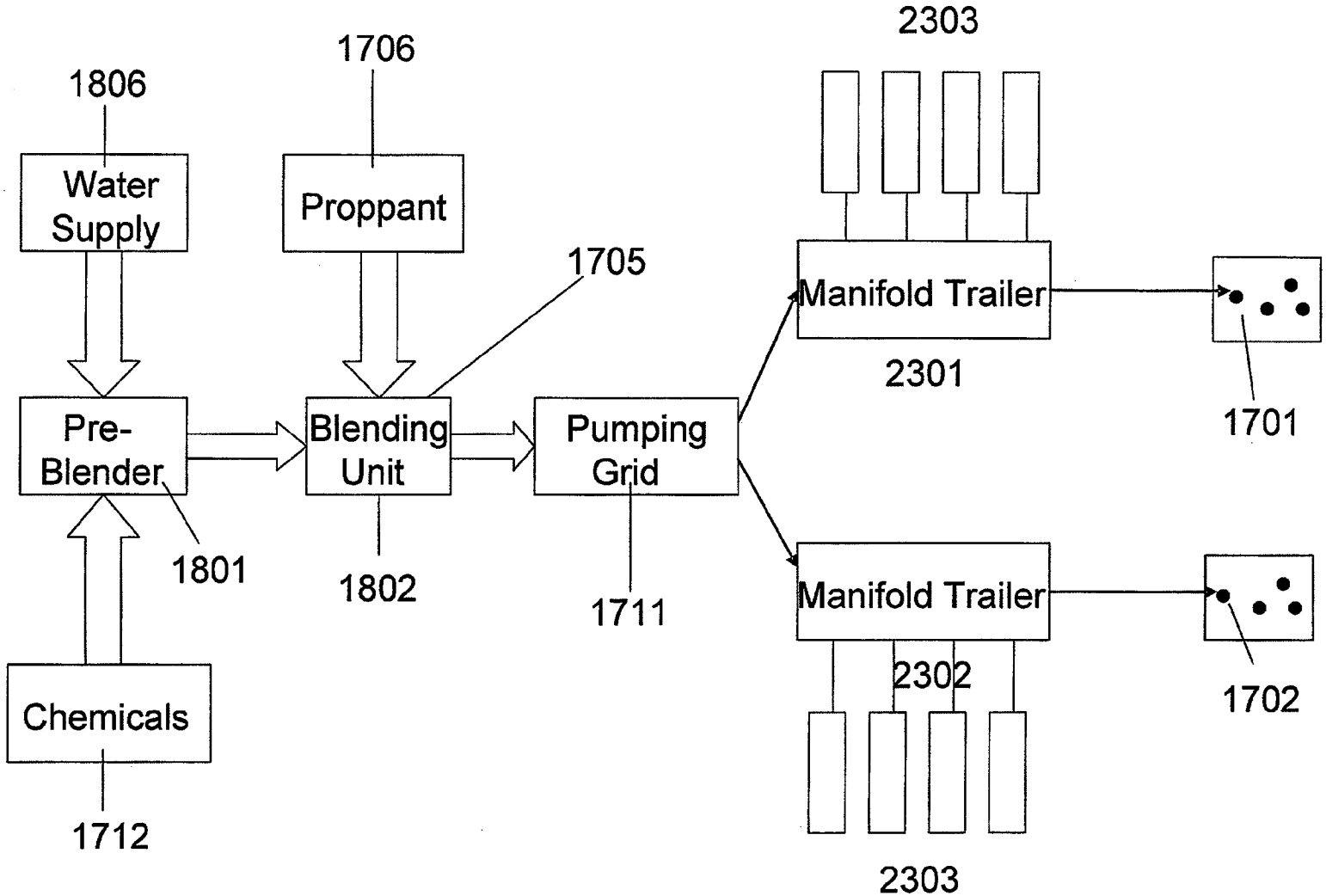
FIG. 23 is a schematic of a simultaneous fracturing method.

In reference to FIG. 23, in one embodiment, multiple manifold trailers 2301 and 2302 may be used at the central location where the stimulation fluid is manufactured and pressurized. The manifold trailers themselves are well known in the art. Each manifold trailer is connected to pressurized stimulating fluid through pump trucks 2303 or a pumping grid 1711. A line from each manifold trailer can connect directly to a well head to stimulate it directly, or it can further be connected to the manifolds described that are further connected to well locations.

Figure 25:
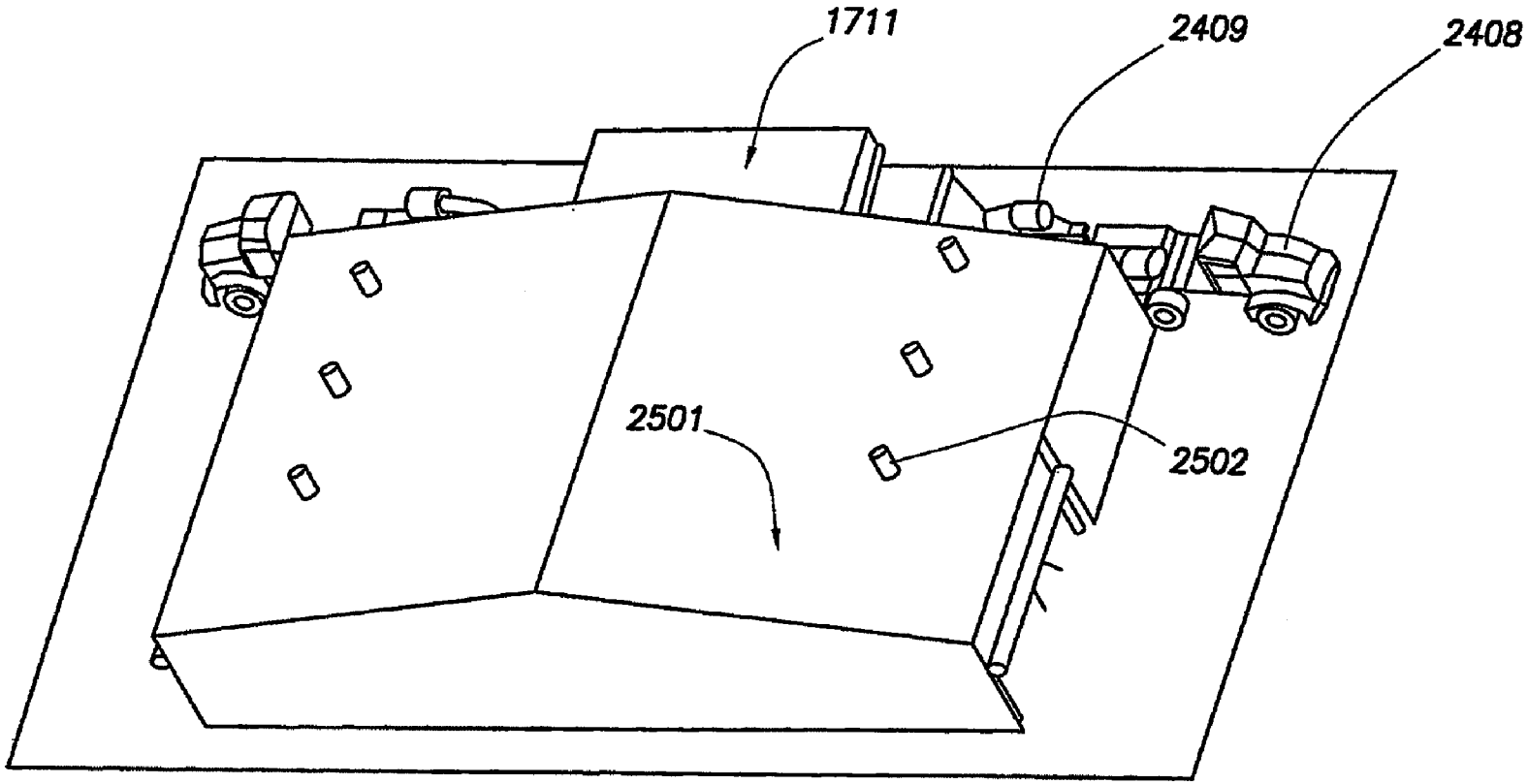
FIG. 25 is an aerial view of a structure that can enclose the pumping grid apparatus.
Figure 26:
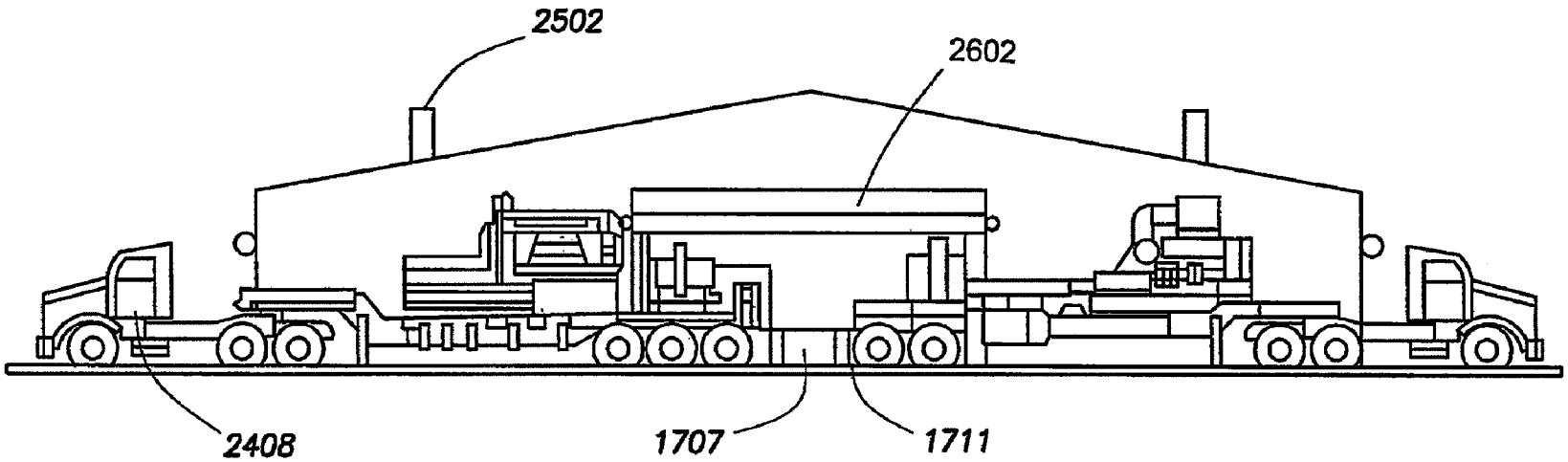
FIG. 26 is a side view of the pumping grid apparatus.

In one embodiment, of the pumping grid system 1711, pumping modules can be hauled to the fracturing operation factory site by truck, and pinned or bolted or otherwise located together on the ground. Pumping equipment grid modules can be added or taken away to accommodate the number of pumping units to be used on site. The pressure manifold will interface with the pumping equipment grid modules and support a crane. The grid system can be configured with various piping or electrical connections that each pumping unit may require for power, fuel, cooling, and lubrication. The grid system would incorporate space to allow access to the pumping units' main components for easy maintenance. In reference to FIG. 24, in one embodiment of the pumping grid 1711, the grid comprises one or more pumps 2401 that can be electric, gas, diesel, or natural gas powered. The grid can also contain spaces or docks 2410 operable to receive equipment, such as pumps and other devices, modularized to fit within such spaces. The pumping grid 1711 can include walkways 2407 that provide access to pumps or any other equipment docked in the grid spaces. The grid's spaces or docks 2410 can be prewired and preplumbed and can contain lube oil, fueling, power, and cooling capabilities and connections for the pumps 2401 to manifold 1707 (shown in FIG. 26). The pumps 2401 that connect to the grid 1711 can be freestanding such as pumps 2401, or the pumps 2409 can be attached to trucks 2408. Pumps 2409 can each contain its own fueling, cooling, lubrication, and power sources. Pumps 2401 can rely on centralized fuel, coolant, lubrication, and power sources. The fuel for the pumps 2401 can be supplied to the pumps 2401 from a single central fueling system 2403 through piping or tubing well known in the art. The pumps 2401 can include hydraulic starting mechanisms. Hydraulic power for the starting mechanisms can be supplied to the pumps 2401 from a single central power system 2404 using tubing or piping well known in the art. In the event electric pumps are used, the power system 2404 can provide electricity to the pumps via wires. The lubrication of the pumps 2401 can also be centralized. Lubrication fluid can be supplied from a central lubrication system 2405 to the pumps 2401 using tubing or piping well known in the art. Coolant for the pumps can be provided from a central source such as a coolant or water tower that can generate less noise than local fans. The grid is operable to accept connections to proppant storage and metering systems, chemical storage and metering systems, and blending units. The pumping grid can also have a crane 2602 that can assist in the replacement or movement of pumps, manifolds, or other equipment. In reference to FIG. 25, the pumping grid 1711 can be enclosed in a structure 2501. The structure can be a supported fabric structure, a collapsible structure, a prefabricated structure, a retractable structure, a composite structure, a temporary structure, a prefabricated wall and roof structure, a deployable structure, a modular structure, a preformed structure, a mobile accommodation structure, and combinations thereof. The pumping grid 1711 can also be partially enclosed by structure 2501 and partially exposed, as shown by pump trucks 2408, which are connected to the pumping grid outside of the structure 2501. The pumping grid 1711 can also include a ventilation system 2502 that can release exhaust from the pumps and/or ventilate the inside of the structure 2501. FIG. 26 shows the pumping grid 1711, the crane 2602, the pressure manifold 1707, and the enclosing structure 2501. A central manifold 1707 can accept connections to wells and can be connected to the pumping grid. In one embodiment, the central manifold and pumping grid are operable to simultaneously treat both a first well head connected via a first connection and a second well head connected via a second connection with the stimulation fluid manufactured by the factory and connected to the pumping grid.

Figure 27:
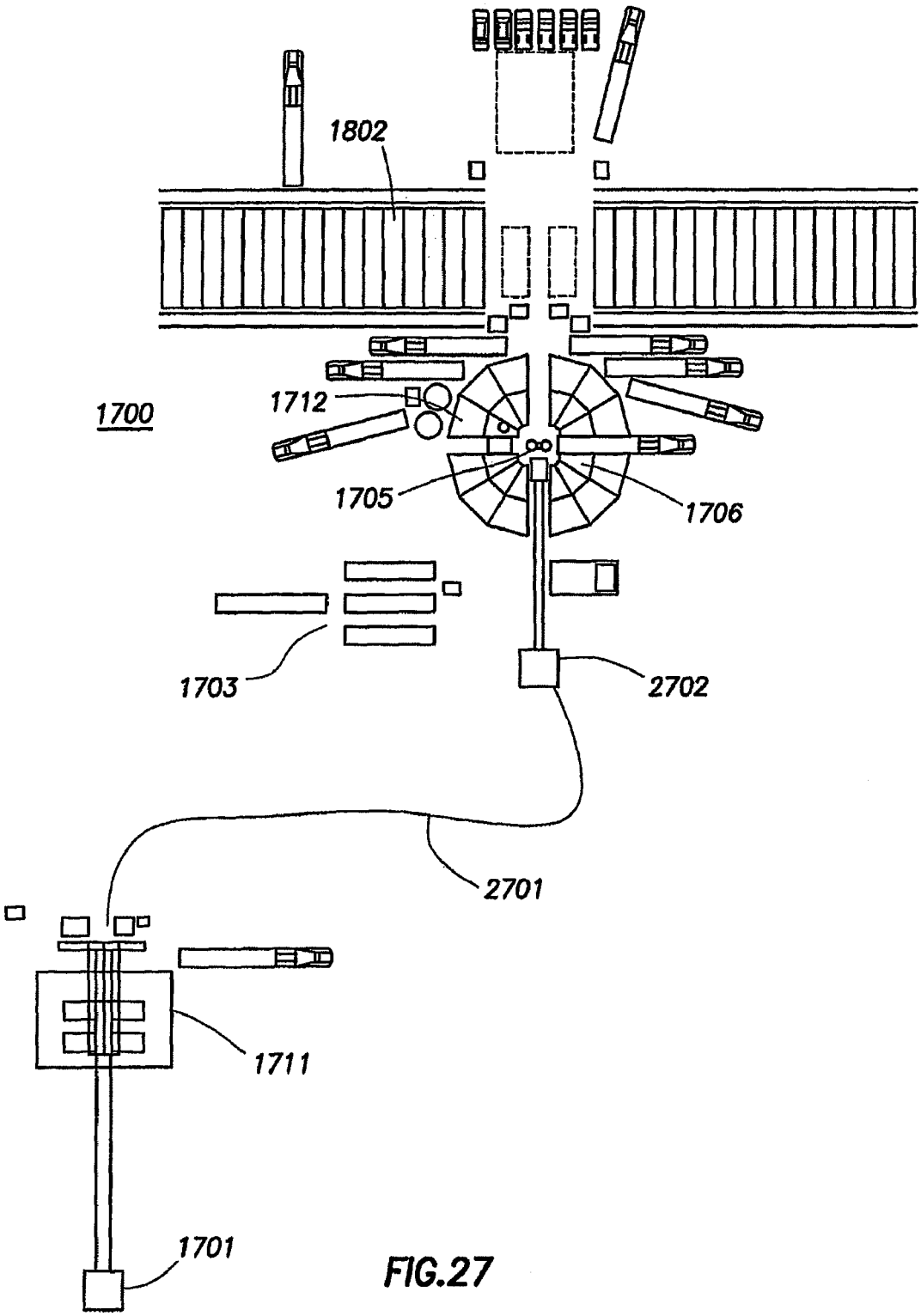
FIG. 27 is an aerial view of the fracturing operations factory and a remote pumping grid apparatus.

In reference to FIG. 27, in some embodiments, the pumping grid can be located at a different pad miles away from the fracturing operations factory 1700. An auxiliary pumping system 2702, which itself can include pumping trucks, manifold trailers 1703 shown in FIG. 23, or standalone pumps, can pump fracturing fluid from the fracturing operations factory 1700 through connection 2701 to the pumping grid 1711. The pumping grid 1711 can next pump the fluid to production site 1701, for example. In this way, the operations of the fracturing factory 1700 can be extended to remote pads through assembly and reassembly of the pumping grid 1711 and connection 2701.

In some embodiments, the operations of the chemical storage system, proppant storage system, blending unit, pumping grid, power unit, and manifolds are controlled, coordinated, and monitored by a central control system. The central control system can be an electronic computer system capable of receiving analog or digital signals from sensors and capable of driving digital, analog, or other variety of controls of the various components in the fracturing operations factory. The control system can be located within the factory enclosure, if any, or it can be located at a remote location. The central control system may use all of the sensor data from all units and the drive signals from their individual subcontrollers to determine subsystem trajectories. For example, control over the manufacture, pumping, gelling, blending, and resin coating of proppant by the control system can be driven by desired product properties such as density, rate, viscosity, etc. Control can also be driven by external factors affecting the subunits such as dynamic or steady-state bottlenecks. Control can be exercised substantially simultaneously with both the determination of a desired product property, or with altering external conditions. For instance, once it is determined that a well treatment fluid with a specific density is desired, a well treatment fluid of the specific density can be manufactured virtually simultaneously by entering the desired density into the control system. The control system will substantially simultaneously cause the delivery of the proppant and chemical components comprising a well treatment fluid with the desired property to the blending unit where it can be immediately pumped to the desired well location. Well treatment fluids of different compositions can also be manufactured substantially simultaneously with one another and substantially simultaneously with the determination of desired product properties through the use and control of multiple blending units each connected to the control unit, proppant storage system, chemical storage system, water source, and power unit. The central control system can include such features as: (1) virtual inertia, whereby the rates of the subsystems (chemical, proppant, power, etc.) are coupled despite differing individual responses; (2) backward capacitance control, whereby the tub level controls cascade backward through the system; (3) volumetric observer, whereby sand rate errors are decoupled and proportional ration control is allowed without steady-state error. The central control system can also be used to monitor equipment health and status. Simultaneously with the manufacture of a well treatment fluid, the control system can report the quantity and rate usage of each component comprising the fluid. For instance, the rate or total amount of proppant, chemicals, water, or electricity consumed for a given well in an operation over any time period can be immediately reported both during and after the operation. This information can be coordinated with cost schedules or billing schedules to immediately compute and report incremental or total costs of operation.

The present invention can be used both for onshore and offshore operations using existing or specialized equipment or a combination of both. Such equipment can be modularized to expedite installation or replacement. The present invention may be enclosed in a permanent, semipermanent, or mobile structure.

In another example embodiment, the combination of the concepts the well treatment operations factory 1700 shown generally at FIGS. 17-27 with the concept of maximizing a second fracture length shown generally at FIGS. 1-16 is expanded upon to provided for maximized production flow from a plurality of well locations utilizing a minimal number of fractures within a region. The well treatment operations factory 1700 is a technology where one or more clusters of pumping "spreads" are used to stimulate a plurality of wells, one at a time, in rapid succession. The centralized service factory allows for stimulating a plurality of wells at the same time. The wells selected for fracturing may be coupled through a network of low/high pressure lines which could ultimately be used for drilling, cementing, stimulation, production, and rework service. The lines are channeled through complex manifolding which are controlled by manual or automated valves as described with respect to FIGS. 17-27. The centralized well treatment fluid center may be configured to provide for fracturing a plurality of wells at sequentially or substantially simultaneously. The operations of the centralized well treatment fluid center may be automation through the use of a computer.

The computer may receive outputs from sensors distributed about the region including sensors disposed about the subterranean or disposed about the surface of the region. These outputs may be used to calculate time delays and effects of stress fields from fracturing as described with respect to FIGS. 1-17. The concepts of maximizing the second fracture within the same wellbore at a given well location described with respect to FIGS. 1-16 may be combined with the centralized well treatment factory described with respect to FIGS. 17-27 in such a manner as to maximize a second fracture or any number of subsequent fractures at a well location other than the first fracture well location. The technology associated with maximizing the second and subsequent fracture focuses on fracture direction modification by means of temporary formation stress manipulation using measured effects of stress fields from previously induced fractures. It is well known to those of ordinary skill in the art that fractures in a well or nearby wells affect fracture direction in a subsequent induced fracture at least to some measurable extent. By combining the centralized well treatment fluid center with optimization of fracture length techniques, multiple fractures may be induced substantially simultaneously or in rapid succession so as to orchestrate fracture placement in order to optimize the number of fractures required to productively develop a region. Reducing the number of fractures required in a region reflects favorably on the cost of development of the region.

Figure 28:
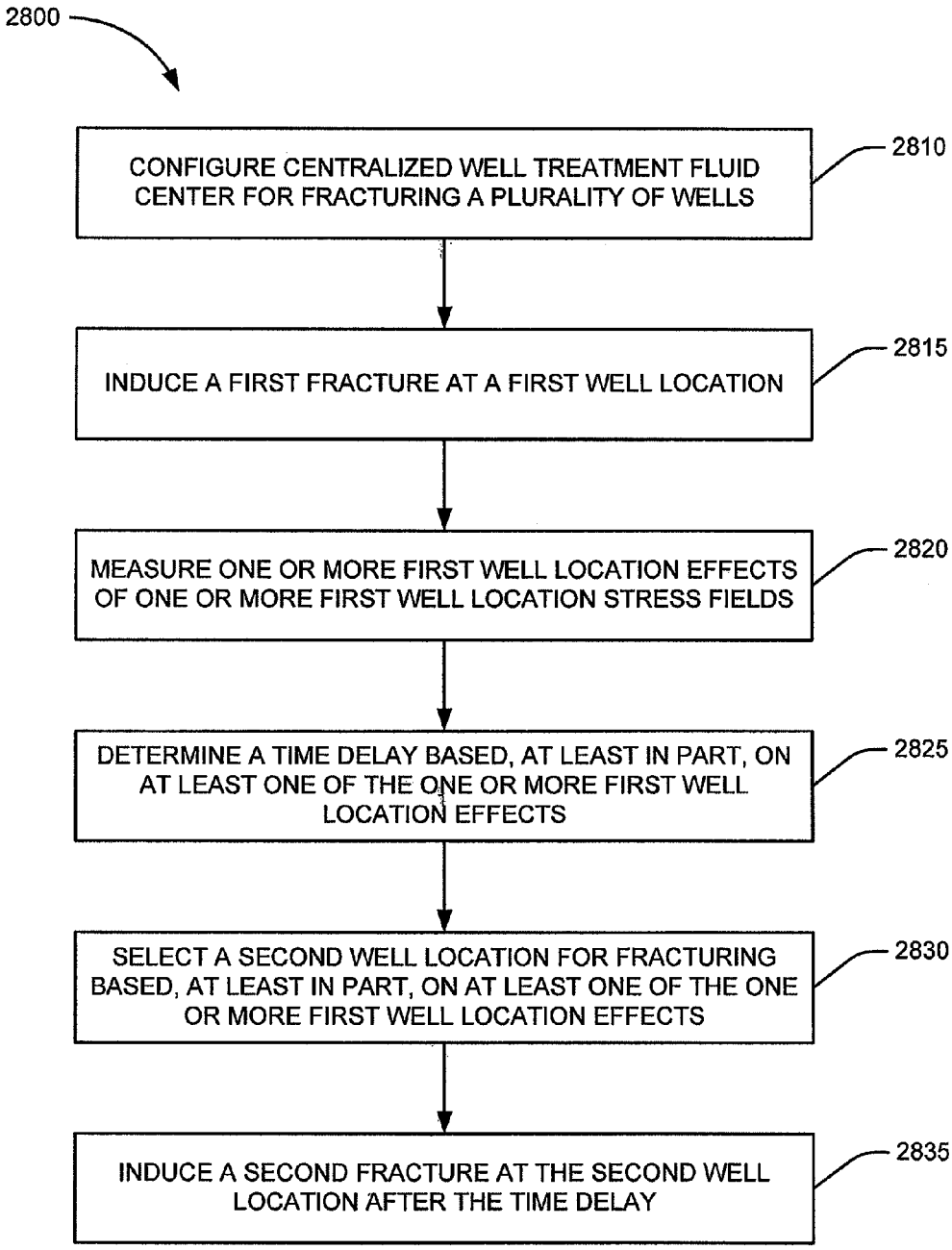
FIG. 28 is a flow diagram of fracturing multiple well locations from a centralized well fluid center within a region.

FIG. 28 is a flow chart illustration of an example implementation, shown generally at 2800. The method includes configuring a centralized well treatment fluid center for fracturing a plurality of wells in step 2810. The centralized well treatment fluid center may be a factory such as the well treatment operations factory 1700 configured to provide proppant and other well treatment fluids to a plurality of well locations for multiple well operations. For instance, the centralized well treatment fluid center may be configured to receive production fluid from a plurality of wells in the region. Also, the centralized well treatment fluid center may be configured to flow proppant in order to induce fracturing in a plurality of wells. The centralized well treatment fluid center may be configured to allow for multiple wells to be treated substantially simultaneously or sequentially.

At step 2815, a first fracture is induced at a first well location by flowing well treatment fluid from the centralized well treatment fluid center to the first well location as demonstrated in FIG. 18. The selection of the first well location may be based on any number of factors known to one or ordinary skill in the art. In one example implementation, the type of subterranean formation along with information previously obtained from other wells located in proximity to the selected region may be utilized to select the first fracture location. Next, one or more first well location effects of one or more first well location stress fields are measured at step 2820. The stress fields associated with a fracture may be measured using the techniques described with respect to FIG. 1 such as tilt meters 140, microseismic receivers 145, and any other device known to one of ordinary skill in the art. The measured effects may be calculated from a combination of outputs from one or more sensors. The measured effects may include, but are not limited to, those described with respect FIG. 3: magnitude, orientation, shear, stick-slip velocity, Maxwell creep, pseudo-Maxwell creep, lapse of time between initiating a prior fracture and closure of the prior fracture, length of fracture of the prior fracture in an inward direction and any other effect known to one or ordinary skill in the art of the stress fields associated with a fracture.

Next, at step 2825 a time delay is determined based, at least in part, on at least one of the one or more first well location effects. A fracture for a given well immediately followed by another fracture may be directed into the "unnatural" direction according to the permeability of the formation. As a result, a time delay between fractures may increase the effectiveness of the second fracture. This time delay may be determined using the method described with respect to FIG. 3 at step 312. In one example embodiment, a computer comprising one or more processors and a memory may be used to calculate the measured effects. The memory includes executable instructions that, when executed, cause the one or more processors to determine the time delay between inducing multiple fractures.

A second well location is selected at step 2830 based, at least in part, on at least one of the one or more first well location effects. The second fracture is induced at step 2835 after the time delay in order to take advantage of the altered stress fields from the first fracture so as to maximize the effects of the second fracture.

Figure 29:
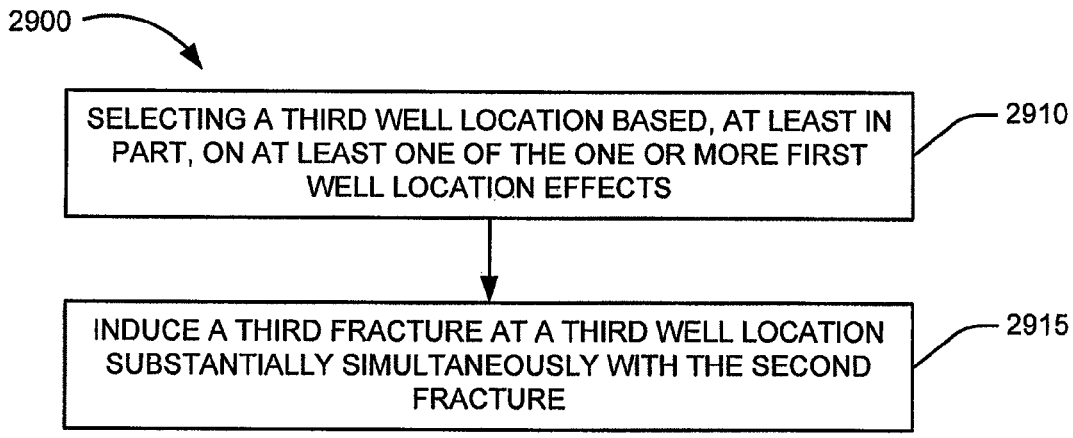
FIG. 29 is a flow diagram of fracturing multiple well locations from a centralized well fluid center within a region.

FIG. 29 depicts a flow chart illustration of an example implementation, shown generally at 2900. After inducing a second fracture as described with respect to step 2835 of FIG. 28, a third well location is selected based, at least in part, on at least one of the one or more first well location effects, at step 2910. The third well location may be the same location as the first fracture or may be at another location within a given field or region. The third fracture is then induced at step 2915 substantially simultaneously with the second fracture. It is contemplated by the present invention that multiple well locations may be selected based on at least one of the one or more first well location effects. Fractures may be induced at each of the multiple well locations substantially simultaneously with the second and third fractures. The number of fractures induced may be limited by the configuration, capacity, and capabilities of the centralized well treatment fluid center.

Figure 30:
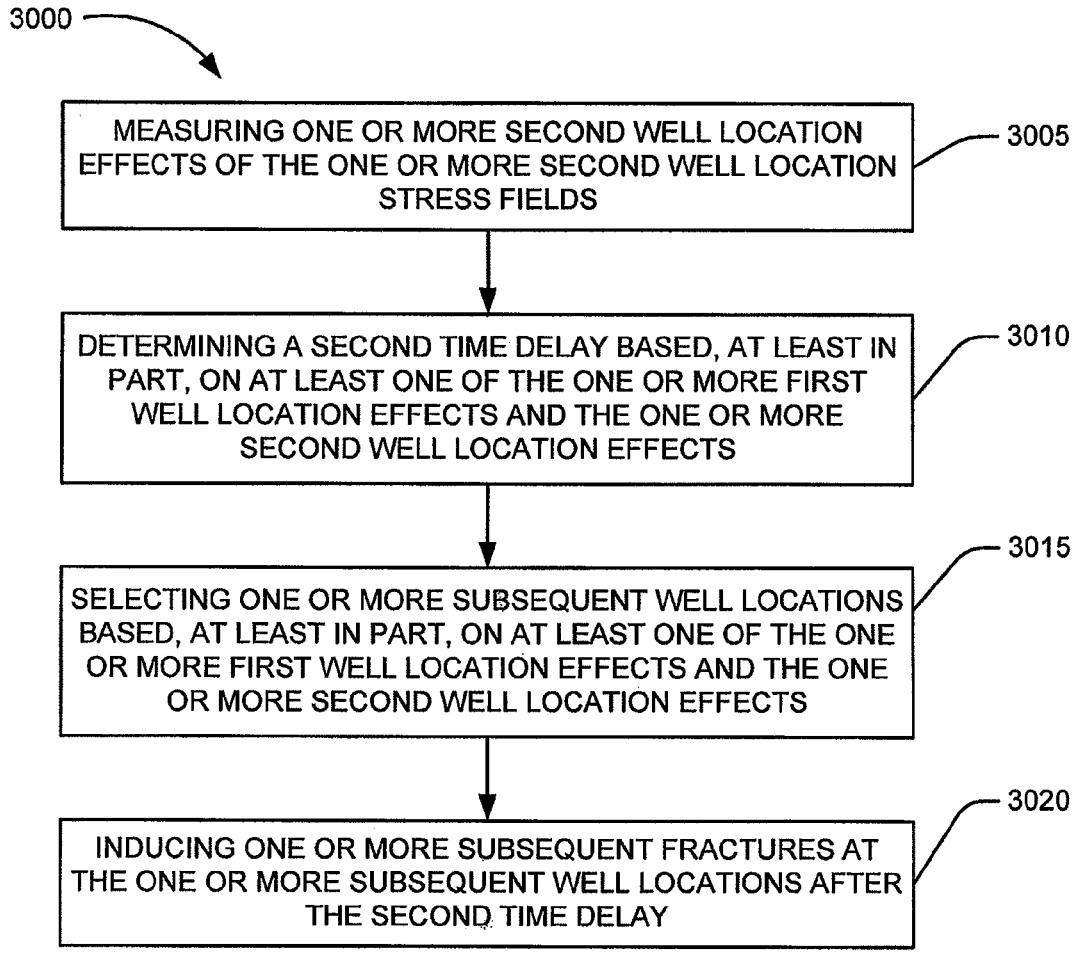
FIG. 30 is a flow diagram of fracturing multiple well locations from a centralized well fluid center within a region.

FIG. 30 depicts a flow chart illustration of an example implementation, shown generally at 3000. After inducing the second fracture as described in FIG. 28, one or more second well location effects of the one or more second well location stress fields may be measured at step 3005. A second time delay is determined based, at least in part, on at least one of the one or more first well location effects and the one or more second well location effects at step 3010. At step 3015, one or more subsequent well locations are selected based, at least in part, on at least one of the one or more first well location effects and the one or more second well location effects. One or more subsequent fractures are induced at step 3020 at the one or more subsequent well locations after the second time delay. One or more of the subsequent fractures may be induced substantially simultaneously with each other. Also, one or more of the subsequent fractures may be induced sequentially where after each fracture a new time delay is determined based, at least in part, on the one or more effects of one or more of the previous fractures, for instance the first well location effects and the second well location effects. In one example embodiment, one or more combined effects of one or more combined stress fields in a region are measured. The one or more combined effects are based, at least in part, on the one or more first well location effects and one or more second well location effects of the one or more second well location stress fields from the second fracture. The orientation line of the third fracture may then be based, at least in part, on the one or more combined effects.

Figure 31:
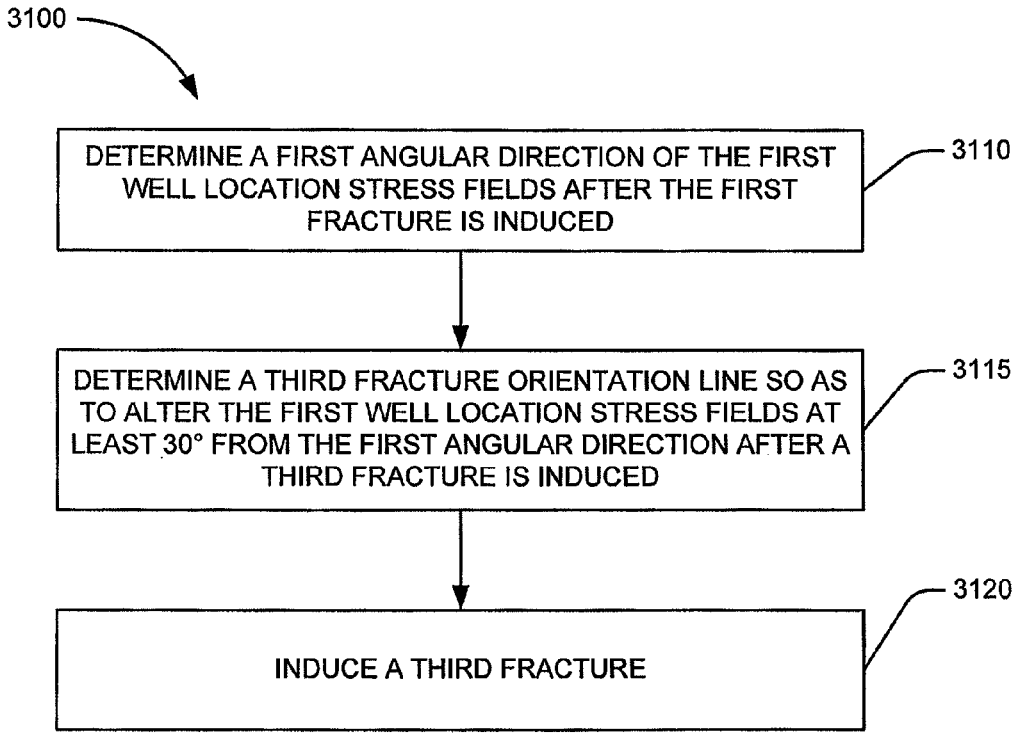
FIG. 31 is a flow diagram of fracturing multiple well locations from a centralized well fluid center within a region.

FIG. 31 depicts a flow chart illustration of another example implementation, shown generally at 3100. After performing the steps in FIG. 28, a first angular direction of the first well location stress fields may be determined at step 3110 after the first fracture has been induced. A third fracture orientation line may be determined at step 3115 in order to provide, after the inducement of the third fracture, alteration of the first well location stress fields at least thirty degrees from the first angular direction. An optimum alteration would be ninety degrees from the first angular direction. The orientation line of the third fracture may be based, at least in part, on the one or more first well location effects from the first fracture. In one example embodiment, a computer comprising one or more processors and a memory may be used to determine the angular direction of the stress fields. The memory includes executable instructions that, when executed, cause the one or more processors to receive output from sensors configured to measure the angular direction of the stress fields associated with fractures in a region and to calculate the angular direction based, at least in part, on these outputs. Next, at step 3120 the third fracture is induced at the determined third fracture orientation line by flowing well treatment fluid from the centralized well treatment fluid center.

In another example embodiment, the centralized well treatment fluid center is configured to produce the well treatment fluid that is flowed to the plurality of wells in a region. The centralized well treatment fluid center may also be configured to receive production fluid from the plurality of wells in the region. Also, the received well treatment fluid may be reconditioned. Further, the centralized well treatment fluid center may be configured to receive production fluid or any other type of fluid known to one of ordinary skill in the art from the plurality of wells.

FIGS. 32A-D are an illustration of the orchestration of multiple fractures from a centralized well treatment fluid center in a region. The primary interest of orchestrating multiple fractures is to place a set of fractures with a maximum amount of north-south fracture components using the minimum number of fractures as possible. Reducing the needed fractures to establish the same amount of north-south exposure translates into tremendous savings in overall costs, manpower, equipment, etc. to the operator of the region. Rather than performing multiple fractures at each well location as in previous orchestrations, the current method contemplates utilizing the effects of the stress fields associated with each fracture in order to determine well locations and fracture locations and orientation so as to reduce the number of fractures per well. Thus, in a given region certain wells may provide maximum production after the induction of a single fracture rather than the induction of multiple fractures by utilizing the benefit of the altered stress fields from other fractures in the region.

Assuming that the natural fracture direction is east-west for the wells depicted in FIGS. 32A-D, then fracturing in a north-south direction would generate maximum production results. One of ordinary skill in the art would readily recognize that if the intent is to penetrate natural fracture swarms, fracturing into north-west-south-east would also generate maximum results. In FIG. 4A, a first fracture 3210 is induced from the centralized well treatment fluid center such as the factory depicted in FIG. 17 as element 1700. The centralized well treatment fluid center is configured such that a second fracture 3215 may be induced immediately. If the first fracture 3210 is induced in an effective manner in a favorable rock formation so as to maximize the fracture length of the first fracture 3210, then the effects of the first fracture 3210 may allow for the second fracture 3215 to be completed in the desired manner shown in FIG. 32A. If conditions are not as suitable as in FIG. 32A, then a first fracture 3220 followed by a second fracture 3225 may result in the situation shown in FIG. 32B. The completion of the fractures as shown FIG. 32B, though not at an optimal orchestration, are still considered adequate results as compared to, for instance, a purely east-west second fracture. The north-west/south-east portion of the second fracture 3225 has a better probability to intersect natural fractures which would not be accessible via a purely east-west fracture.

Figure 32A:
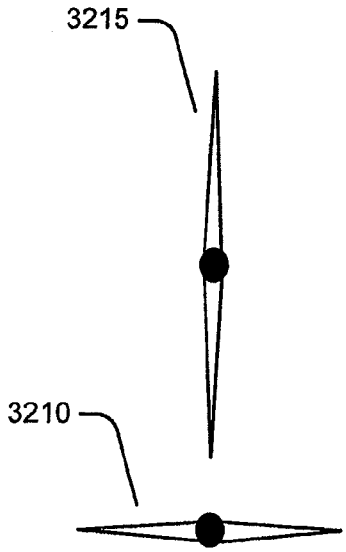
FIGS. 32A-32D are diagrams illustrating the orchestration of performing multiple fractures within a region.
Figure 32B:
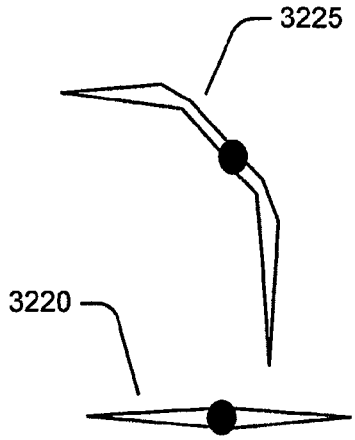
Figure 32C:
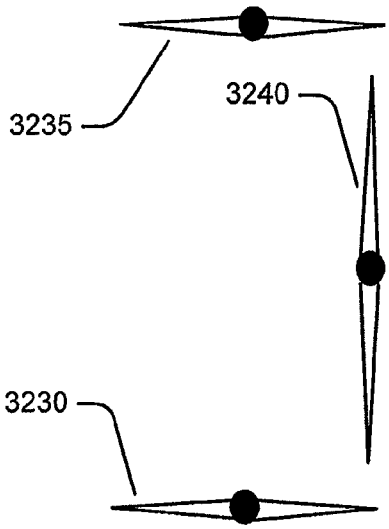

In comparison, FIGS. 32C and D depict three fractures at three different wells. FIG. 32C depicts a first fracture 3230 at a first well location completed together with a second fracture 3235 at a second well location. The stimulation schedule and volumes for the first fracture 3230 and the second fracture 3235 must be substantially the same. If not, two separate manifolding would necessarily be required and certain risks would result. For instance, one risk is the possibility of the extension of one fracture preventing the initiation of the other fracture located at a separate well location. One method of avoiding such a possibility is to use a high enough flow rate from the centralized well treatment fluid center so that the friction pressure drops during the stimulation to a point so as to offset the pressure difference between fracture initiation and extension. Another method would be to install pressure reducing equipment in the two lines to the well bore. In this latter approach, the two chokes could be high pressure chokes (ceramic) or for a better result the two lines could be low strength steel chokes so as to erode out the initial fracture during the sand stages. As the first fracture 3230 and the second fracture 3235 are complete, a third fracture 3240 is inducted at a third well location resulting in a north-south fracture completion for the third fracture 3240. The latter approach may drastically increase the life of pumps, as the pumps would not have to operate at very high pressures for long periods of time in the "dirty" mode.

Figure 32D:
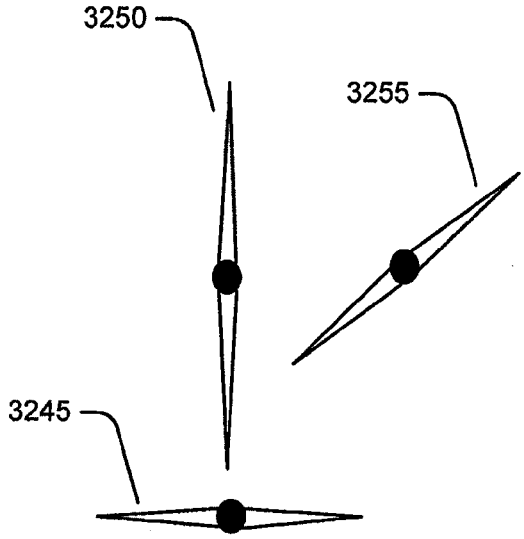

FIG. 32D depicts another implementation of a three fracture orchestration. A first fracture 3245 is followed by a second fracture 3250. Due to the interaction of stress contribution from fracture 3250 and the decaying contribution of the first fracture 3245, the third fracture 3255 at the third well location is created in an angular position northeast-southwest (or rather more to the east-west direction). The direction of the third fracture 3255 is based, at least in part, on the decay rate of the effects of the stress fields from the second fracture and possibly the stress fields from the first fracture. A fourth fracture within the region depicted in FIG. 32D would require evaluation of the effects mainly associated with the stress fields from the third fracture and possibly the first and second fractures as well.

Figure 33:
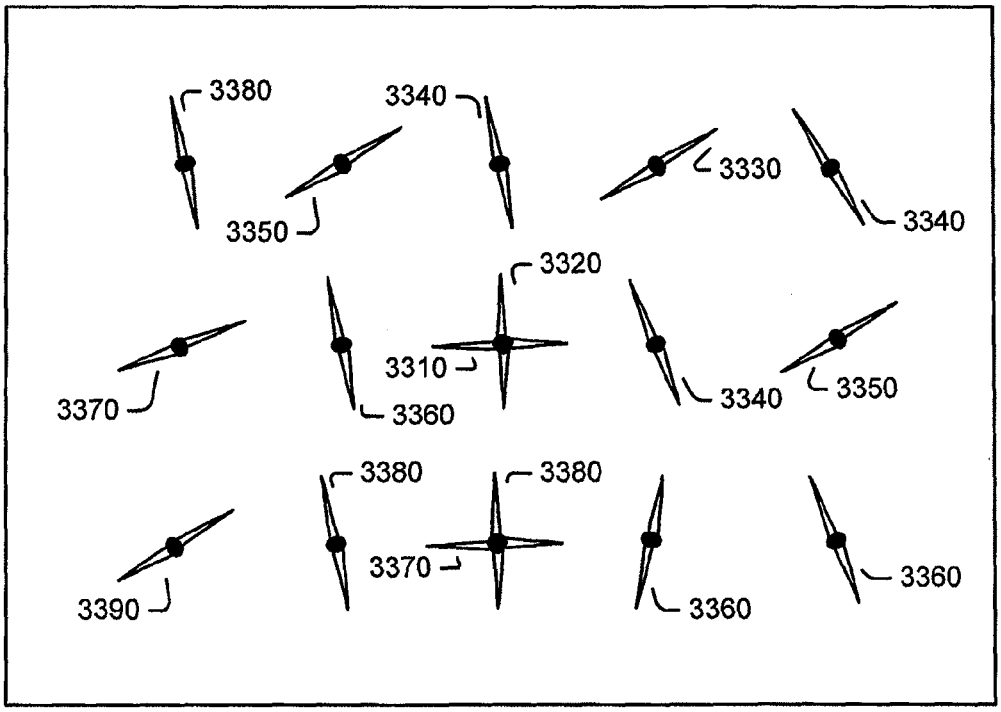
FIG. 33 is a diagram of the orchestration of performing multiple fractures within a region.

FIG. 33 depicts another implementation of orchestration of fractures in a region utilizing a centralized well treatment fluid center such as that depicted in FIG. 17 generally shown as 1700. The goal of the orchestration in FIG. 33 is to obtain optimized production from a region by inducing a minimum number of fractures. For example illustration, it is assumed that the minimum stress direction north-south. Accordingly, a north-south fracture direction is preferred.

A first well location is selected and a first fracture 3310 is induced. Immediately following the first fracture 3310, a second fracture 3320 is induced. A third fracture 3330 is subsequently induced after a determined time delay. Due to the effects of the stress fields associated with the first fracture 3310 and the second fracture 3320, the third fracture 3330 will be angularly placed as depicted in FIG. 33. After another time delay a fourth set of fractures 3340 are induced. While the fourth set of fractures 3340 consists of three fractures as depicted in FIG. 33, the number of fractures in any given set is limited by the configuration, capacity, and capabilities of the centralized well treatment fluid center. The three fractures of the fourth set of fractures 3340 are induced substantially simultaneously with each other. Subsequently a fifth set 3350, sixth set 3360, seventh set 3370, eighth set 3380, and ninth set 3390 are induced. Each set of fractures may consist of any number fractures that are supportable by the centralized well treatment fluid center.

The orchestration of fractures depicted in FIG. 33 illustrates how the effects of stress fields from prior fractures may reduce the need for multiple fractures at a given well location. By implementing subsequent fractures substantially simultaneously with each other and at determined time delays which are based, at least in part, on the effects of the stress fields from prior fractures in the region multiple well locations may only require one fracture in order to obtain optimal production flow results. In the illustration of FIG. 33, the traditional number of fractures is reduced by thirteen fractures, assuming that two fractures per well location would ordinarily be required to produce the same results, providing a substantial time and cost benefit to the operator of the region.

Figure 34:
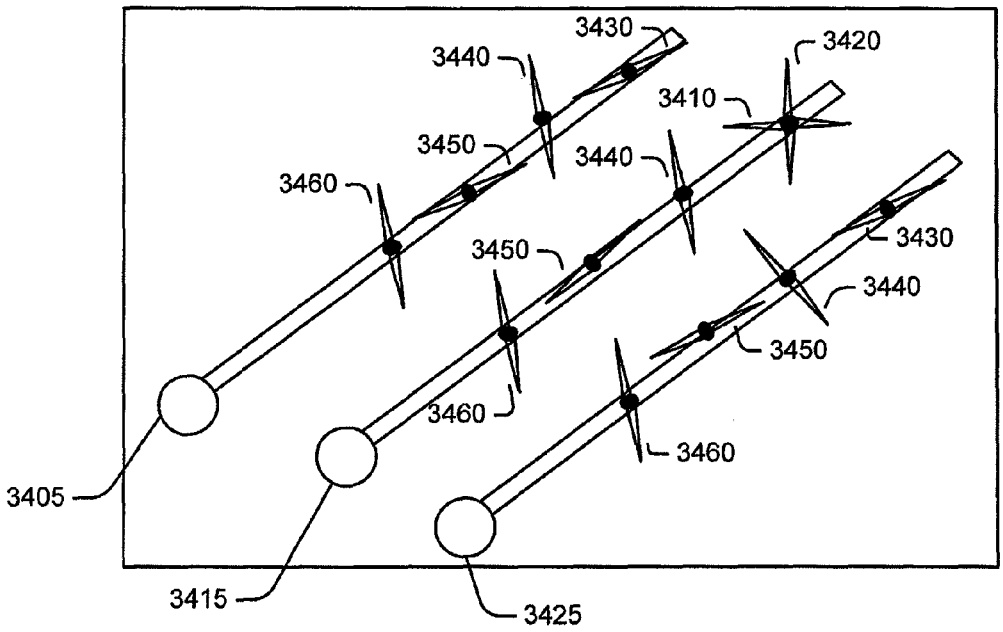
FIG. 34 is a diagram of the orchestration of performing multiple fractures within three horizontal well bores.

FIG. 34 depicts another implementation of orchestration of fractures in a region utilizing a centralized well treatment fluid center such as that depicted in FIG. 17 generally shown as 1700. The region in FIG. 34 is penetrated by a set of wells 3405, 3415, and 3425. The goal of the orchestration in FIG. 34 is to obtain optimized production from a region by inducing a minimum number of fractures. For example illustration, it is assumed that the minimum stress direction north-south. Accordingly, a north-south fracture direction is preferred.

A first well location is selected and a first fracture 3410 is induced. Immediately following the first fracture 3410, a second fracture 3420 is induced. A set of third fractures 3430 is subsequently induced after a determined time delay. Due to the effects of the stress fields associated with the first fracture 3410 and the second fracture 3420, the set of third fractures 3430 will be angularly placed as depicted in FIG. 34. While the third set of fractures 3430 consists of two fractures as depicted in FIG. 34, the number of fractures in any given set is limited by the configuration, capacity, and capabilities of the centralized well treatment fluid center. After another time delay a fourth set of fractures 3440 are induced. While the fourth set of fractures 3440 consists of three fractures as depicted in FIG. 34, the number of fractures in any given set is limited by the configuration, capacity, and capabilities of the centralized well treatment fluid center. The three fractures of the fourth set of fractures 3440 are induced substantially simultaneously with each other. Subsequently a fifth set 3450 and a sixth set 3460 are induced. Each set of fractures may consist of any number fractures that are supportable by the centralized well treatment fluid center.

The orchestration of fractures depicted in FIG. 34 illustrates how the effects of stress fields from prior fractures may reduce the need for multiple fractures at a given well location. By implementing subsequent fractures substantially simultaneously with each other and at determined time delays which are based, at least in part, on the effects of the stress fields from prior fractures in the region multiple well locations may only require one fracture in order to obtain optimal production flow results. In the illustration of FIG. 34, the traditional number of fractures is reduced by two fractures, assuming that two fractures per well location would ordinarily be required to produce the same results, providing a substantial time and cost benefit to the operator of the region.

Traditionally fracturing relies on sophisticated and complex bottomhole assemblies. Associated with this traditional method of fracturing are some high risk processes in order to achieve multi-interval fracturing. One major risk factor associated with traditional fracturing is early screen outs. By implementing the sleeves depicted in FIGS. 35A-B, some of these risks may be reduced or eliminated as a single trip into the well provides for multi-interval fracturing operations and a screened completion after all intervals have been stimulated.

Figure 35A:
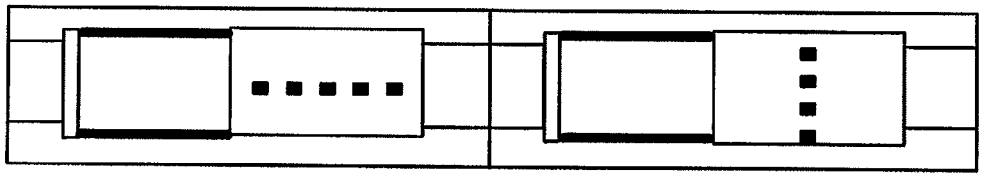
FIGS. 35A and 35B are graphical representations of dual sleeves suitable for use in a horizontal well bore.
Figure 35B:
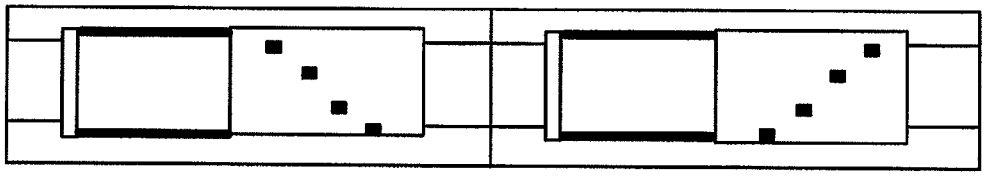

FIGS. 35A-35B illustrate, generally, graphical representations of sleeves. In certain embodiments, one or more sleeves may be disposed about a liner. In FIG. 35A, the sleeve is a dual sleeve with horizontal and vertical ports. The ports allow for fluid, such as production fluid, to flow through the sleeves. In FIG. 35B, the sleeve is a dual sleeve with angular ports. The ports allow for fluid, such as production fluid, to flow through the sleeves. Examples of suitable sleeves are commercially available from Halliburton Energy Services, Inc., of Duncan Okla., under the trade name DELTASTIM™ Sleeves. The sleeves may be disposed around a liner as part of an isolation assembly previously discussed.

Figure 36A:
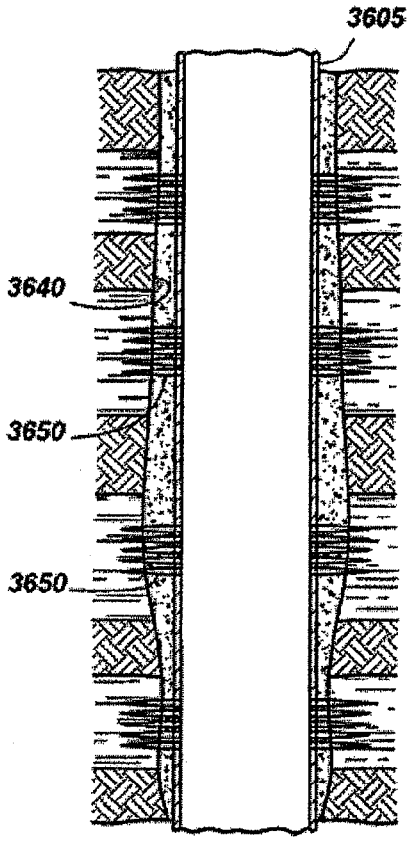
FIG. 36A (PRIOR ART)
FIG. 36A illustrates a well bore having a casing string disposed therein.

FIG. 36A illustrates a typical well bore completion that may be used in the orchestration of fractures in a region utilizing a centralized well treatment fluid center such as that depicted in FIG. 17 generally shown as 1700. In FIG. 36, casing string 3605 is disposed in well bore 3640. Perforations 3650 through casing string 3605 permit fluid communication through casing string 3605. In such a completion, treating or retreating a specific interval may be problematic, because each interval is no longer isolated from one another. To address this problem, FIG. 36B shows one embodiment of an apparatus for reestablishing isolation of previously unisolated well bore intervals of a longitudinal portion of a well bore.

Figure 36B:
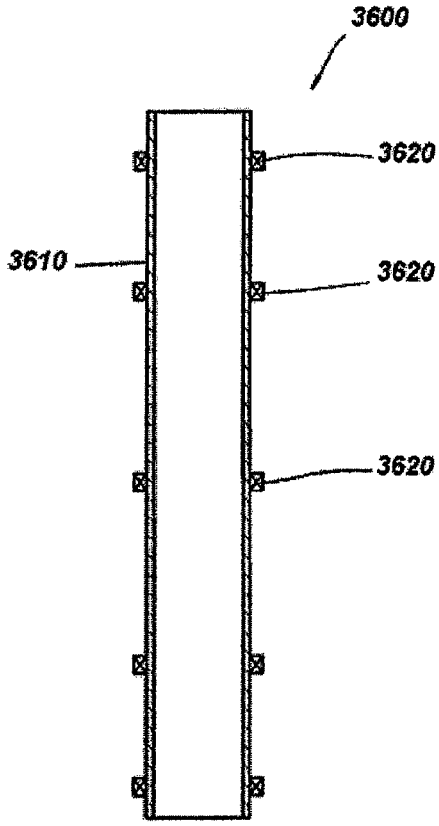
FIG. 36B illustrates a cross-sectional view of an isolation assembly comprising a liner and a plurality of swellable packers, the plurality of swellable packers being disposed about the liner at selected spacings in accordance with one embodiment of the present invention.

In particular, FIG. 36B illustrates a cross-sectional view of isolation assembly 3600 comprising liner 3610 and plurality of swellable packers 3620. Plurality of swellable packers 3620 may be disposed about the liner at selected spacings.

In certain embodiments, liner 3610 may be installed permanently in a well bore, in which case, liner 3610 may be made of any material compatible with the anticipated downhole conditions in which liner 3610 is intended to be used. In other embodiments, liner 3610 may be temporary and may be made of any drillable or degradable material. Suitable liner materials include, but are not limited to, metals known in the art (e.g. aluminum, cast iron), various alloys known in the art (e.g. stainless steel), composite materials, degradable materials, or any combination thereof. The terms "degradable," "degrade," "degradation," and the like, as used herein, refer to degradation, which may be the result of, inter alia, a chemical or thermal reaction or a reaction induced by radiation. Degradable materials include, but are not limited to dissolvable materials, materials that deform or melt upon heating such as thermoplastic materials, hydralytically degradable materials, materials degradable by exposure to radiation, materials reactive to acidic fluids, or any combination thereof. Further examples of suitable degradable materials are disclosed in U.S. Pat. No. 7,036,587, which is herein incorporated by reference in full.

Swellable packers 3620 may be any elastomeric sleeve, ring, or band suitable for creating a fluid tight seal between liner 3610 and an outer tubing, casing, or well bore in which liner 3610 is disposed. Suitable swellable packers include, but are not limited, to the swellable packers disclosed in U.S. Publication No. 2004/0020662, which is herein incorporated by reference in full.

It is recognized that each of the swellable packers 3620 may be made of different materials, shapes, and sizes. That is, nothing herein should be construed to require that all of the swellable packers 3620 be of the identical material, shape, or size. In certain embodiments, each of the swellable packers 3620 may be individually designed for the conditions anticipated at each selected interval, taking into account the expected temperatures and pressures for example. Suitable swellable materials include ethylene-propylene-copolymer rubber, ethylene-propylene-diene terpolymer rubber, butyl rubber, halogenated butyl rubber, brominated butyl rubber, chlorinated butyl rubber, chlorinated polyethylene, styrene butadiene, ethylene propylene monomer rubber, natural rubber, ethylene propylene diene monomer rubber, hydragenized acrylonitrile-butadiene rubber, isoprene rubber, chloroprene rubber, and polynorbornene. In certain embodiments, only a portion of the swellable packer may comprise a swellable material.

Figure 37:
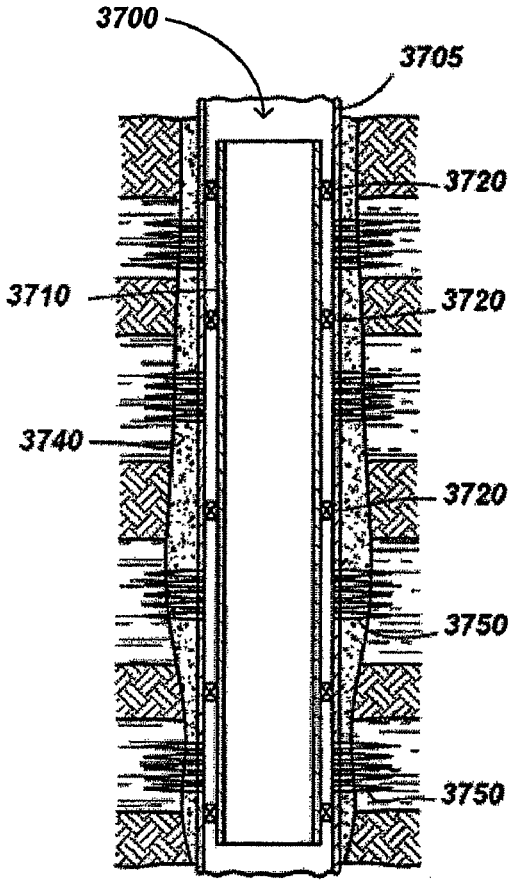
FIG. 37 illustrates a cross-sectional view of an isolation assembly in a well bore providing isolation of selected intervals of a well bore in accordance with one embodiment of the present invention.

FIG. 37 illustrates a cross-sectional view of isolation assembly 3700 disposed in casing string 3705 of well bore 3740 for reestablishing isolation of previously unisolated well bore intervals. This isolation assembly tool 3700 helps to optimize the number of fractures necessary in the subterranean formation by optimizing fracture length at a given location which may further decrease the number of fractures need in the region to obtain optimal production at a minimal or lower cost. Although well bore 3740 is depicted here as a vertical well, it is recognized that isolation assembly 3700 may be used in horizontal and deviated wells in addition to vertical wells. Additionally, it is expressly recognized that isolation assembly 3700 may extend the entire length of well bore 3740 (i.e., effectively isolating the entire casing string) or only along a longitudinal portion of well bore 3740 as desired. Additionally, isolation assembly 3700 may be formed of one section or multiple sections as desired. In this way, isolation may be provided to only certain longitudinal portions of the well bore. In certain embodiments, isolation assembly 3700 may be a stacked assembly.

As is evident from FIG. 37, casing string 3705 has perforations 3750, which allow fluid communication to each of the perforated intervals along the well bore. The fluid may flow to the perforations 3750 from a plurality of lines from a centralized well treatment fluid center such as that depicted in FIG. 17 generally shown as 1700. The isolation assembly (i.e. liner 3710 and swellable packers 3720) may be introduced into casing string 3710.

The swelling of plurality of swellable packers 3720 may cause an interference fit between liner 3710 and casing string 3705 so as to provide fluid isolation between selected intervals along the length of the well bore. The fluid isolation may provide zonal isolation between intervals that were previously not fluidly isolated from one another. In this way, integrity of a previously perforated casing may be reestablished. That is, the isolation assembly can reisolate intervals from one another as desired. By reestablishing the integrity of the well bore in this way, selected intervals may be treated as desired as described more fully below.

The swelling of the swellable packers may be initiated by allowing a reactive fluid, such as for example, a hydrocarbon to contact the swellable packer. In certain embodiments, the swelling of the swellable packers may be initiated by spotting the reactive fluid across the swellable packers with a suitable fluid. The reactive fluid may be placed in contact with the swellable material in a number of ways, the most common being placement of the reactive fluid into the well bore prior to installing the liner. The selection of the reactive fluid depends on the composition of the swellable material as well as the well bore environment. Suitable reaction fluids include any hydrocarbon based fluids such as crude oil, natural gas, oil based solvents, diesel, condensate, aqueous fluids, gases, or any combination thereof. U.S. Publication No. 2004/0020662 describes a hydrocarbon swellable packer, and U.S. Pat. No. 4,137,970 describes a water swellable packer, both of which are hereby incorporated by reference. Norwegian Patent 20042134, which is hereby incorporated by reference, describes a swellable packer, which expands upon exposure to gas. The spotting of the swellable packers may occur before, after, or during the introduction of the isolation assembly into the well bore. In some cases, a reservoir fluid may be allowed to contact the swellable packers to initiate swelling of the swellable packers.

After fluid isolation of selected intervals of the well bore has been achieved, fluid connectivity may be established to selected intervals of the well bore. Any number of methods may be used to establish fluid connectivity to a selected interval including, but not limited to, perforating the liner at selected intervals as desired.

Selected intervals may then be treated with a treatment fluid as desired. Selected intervals may include bypassed intervals sandwiched between previously producing intervals and thus packers should be positioned to isolate this interval even though the interval may not be open prior to the installation of liner 3710. Further, packers may be positioned to isolate intervals that will no longer be produced such as intervals producing excessive water.

As used herein, the terms "treated," "treatment," "treating," and the like refer to any subterranean operation that uses a fluid in conjunction with a desired function and/or for a desired purpose. The terms "treated," "treatment," "treating," and the like as used herein, do not imply any particular action by the fluid or any particular component thereof. In certain embodiments, treating of a selected interval of the well bore may include any number of subterranean operations including, but not limited to, a conformance treatment, a consolidation treatment, a sand control treatment, a sealing treatment, or a stimulation treatment to the selected interval. Stimulation treatments may include, for example, fracturing treatments or acid stimulation treatments.

Figure 38A:
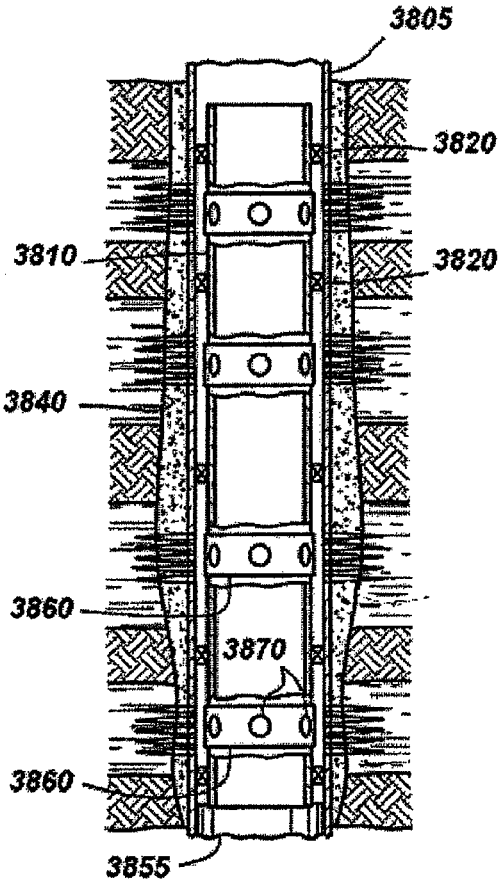
FIG. 38A illustrates a cross-sectional view of an isolation assembly in a well bore providing isolation of selected intervals of a well bore showing certain optional features in accordance with one embodiment of the present invention.

FIG. 38A illustrates a cross-sectional view of an isolation assembly in a well bore providing isolation of selected intervals of a well bore showing certain optional features in accordance with one embodiment of the present invention.

Liner 3810 may be introduced into well bore 3840 by any suitable method for disposing liner 3810 into well bore 3840 including, but not limited to, deploying liner 3810 with jointed pipe or setting with coiled tubing. If used, any liner hanging device may be sheared so as to remove the coiled tubing or jointed pipe while leaving the previously producing intervals isolated. Optionally, liner 3810 can include a bit and scraper run on the end of the liner for the purpose of removing restrictions in the casing while running liner 3810. In certain embodiments, liner 3810 may be set on the bottom of well bore 3840 until swellable packers 3820 have swollen to provide an interference fit or fluid seal sufficient to hold liner 3810 in place. Alternatively, liner 3810 may be set on bridge plug 3855 correlated to depth, or any suitable casing restriction of known depth. Here, liner 3805 is depicted as sitting on bridge plug 3855, which may be set via a wireline. In this way, bridge plug 3855 may serve as a correlation point upon which liner 3810 is placed when it is run into the casing. In certain embodiments, liner 3810 may a full string of pipe to the surface, effectively isolating the entire casing string 3810, or in other embodiments, liner 3810 may only isolate a longitudinal portion of casing string 3810.

As previously described, once liner 3810 is in place and the swellable packers have expanded to provide fluid isolation between the intervals, selected intervals may be isolated and perforated as desired to allow treatment of the selected intervals. Any suitable isolation method may be used to isolate selected intervals of the liner including, but not limited to, a ball and baffle method, packers, nipple and slickline plugs, bridge plugs, sliding sleeves, particulate or proppant plugs, or any combination thereof.

Before treatment of selected intervals, liner 3810 may be perforated to allow treating of one or more selected intervals. The term "perforated" as used herein means that the member or liner has holes or openings through it. The holes can have any shape, e.g. round, rectangular, slotted, etc. The term is not intended to limit the manner in which the holes are made, i.e. it does not require that they be made by perforating, or the arrangement of the holes.

Any suitable method of perforating liner 3810 may be used to perforate liner 3810 including but not limited to, conventional perforation such as through the use of perforation charges, preperforated liner, sliding sleeves or windows, frangible discs, rupture disc panels, panels made of a degradable material, soluble plugs, perforations formed via chemical cutting, or any combination thereof. In certain embodiments, a hydrajetting tool may be used to perforate the liner. Fluid for this hydrajetting tool may be provided by a centralized well treatment fluid center such as that depicted in FIG. 17 generally shown as 1700. In this way, fluid connectivity may be reestablished to each selected interval as desired. Here, in FIG. 38A, sliding sleeves 3860 may be actuated to reveal liner perforations 3870. Liner perforations 3870 may be merely preinstalled openings in liner 3810 or openings created by either frangible discs, degradation of degradable panels, or any other device suitable for creating an opening in liner 3810 at a desired location along the length of liner 3810.

In certain embodiments, sliding sleeves 3860 may comprise a fines mitigation device such that sliding sleeve 3860 may function so as to include an open position, a closed position, and/or a position that allows for a fines mitigation device such as a sand screen or a gravel pack to reduce fines or proppant flowback through the aperture of sliding sleeve 3860.

Figure 38B:
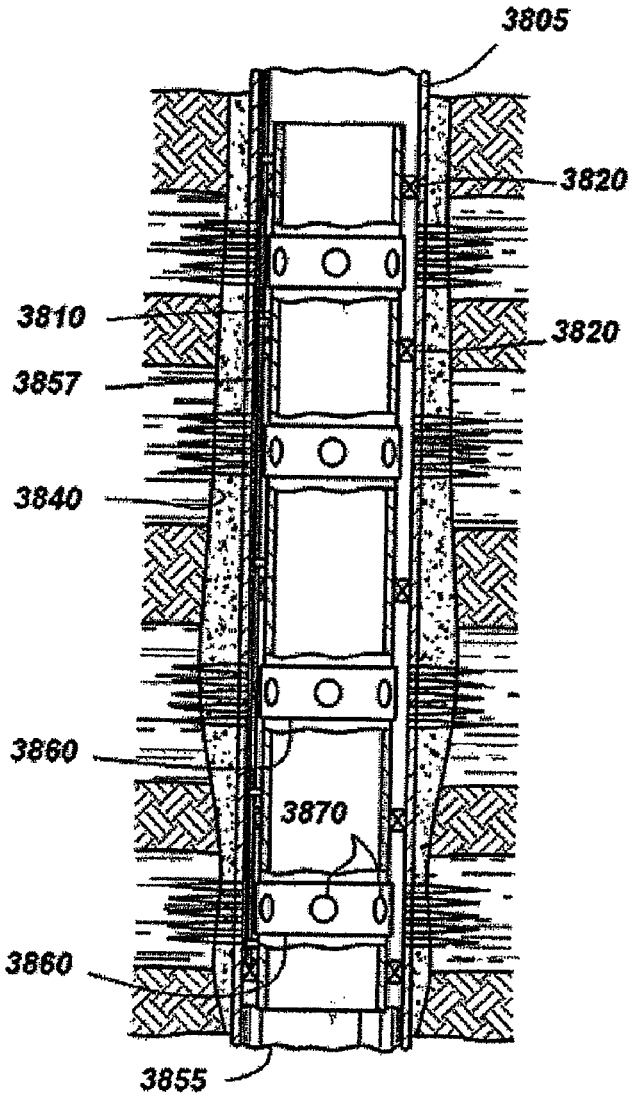
FIG. 38B illustrates a cross-sectional view of an isolation assembly in a well bore providing isolation of selected intervals of a well bore showing certain optional features in accordance with one embodiment of the present invention.

Certain embodiments may include umbilical line, wirelines, or tubes to the surface could be incorporated to provide for monitoring downhole sensors, electrically activated controls of subsurface equipment, for injecting chemicals, or any combination thereof. For example, in FIG. 38B, umbilical line 3857 could be used, to actuate remote controlled sliding sleeves 3860. Umbilical line 3857 may run in between liner 3810 and swellable packers 3820, or umbilical line 3857 may be run through swellable packers 3820 as depicted in FIG. 38B. Umbilical line 3857 may also be used as a chemical injection line to inject chemicals or fluids such as spotting treatments, nitrogen padding, $H_2S$ scavengers, corrosion inhibitors, or any combination thereof.

Although liner 3810 and swellable packers 3820 are shown as providing isolation along casing string 3805, it is expressly recognized that liner 3810 and swellable packers 3820 may provide isolation to an openhole without a casing string or to a gravel pack as desired. Thus, casing string 3805 is not a required feature in all embodiments of the present invention. In other words, the depiction of casing string 3805 in the figures is merely illustrative and should in no way require the presence of casing string 3805 in all embodiments of the present invention.

Figure 39:
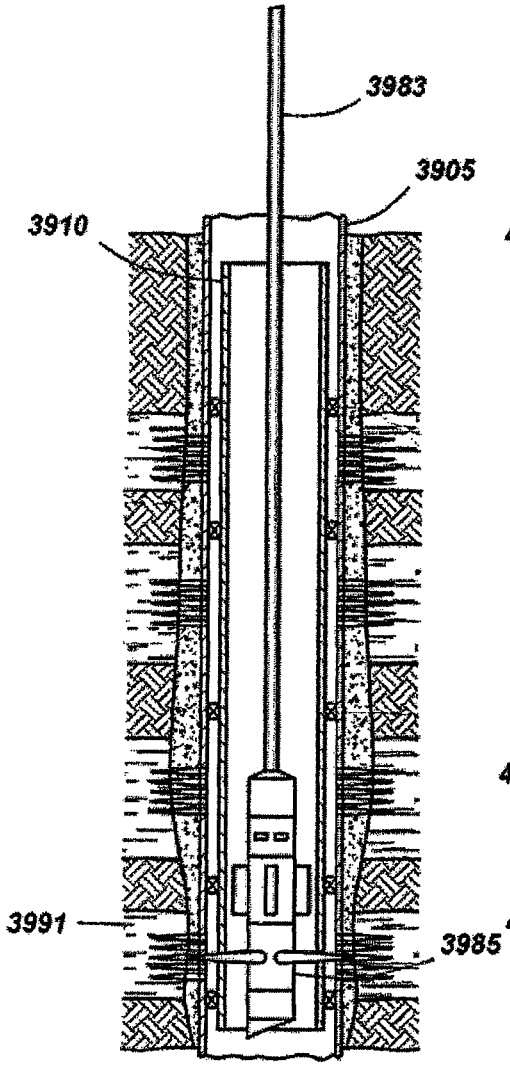
FIG. 39 illustrates a cross-sectional view of an isolation assembly in a well bore providing isolation of selected intervals of a well bore with hydra-jet perforating being performed on the lower most interval using coiled tubing.

As selected intervals are appropriately isolated and perforated using the isolation assembly, selected intervals may be treated as desired. FIG. 39 illustrates hydrajetting tool 3985 introduced into liner 3910 via coiled tubing 3983. As depicted here, hydrajetting tool 3985 may be used to perforate casing string 3905 and initiate or enhance perforations into first well bore interval 3991. Then, as desired, first interval 3991 may be stimulated with hydrajetting tool 3985 or by introducing a stimulation fluid treatment into liner 3905. As would be recognized by a person skilled in the art with the benefit of this disclosure, the isolation and perforation of selected intervals may occur in a variety of sequences depending on the particular well profile, conditions, and treatments desired. In certain embodiments, several intervals may be perforated before isolation of one or more selected intervals. Several methods of perforating and fracturing individual layers exist. One method uses select-fire perforating on wireline with ball sealer diversion in between treatments. Another method uses conventional perforating with drillable bridge plugs set between treatments. Yet another method uses sliding windows that are open and closed with either wireline or coiled tubing between treatments. Another method uses retrievable bridge plugs and hydrajetting moving the bridge plug between intervals. Other methods use limited-entry perforating, straddle packer systems to isolate conventionally perforated intervals, and packers on tubing with conventional perforating.

Examples of suitable treatments that may be apply to each selected interval include, but are not limited to, stimulation treatments (e.g. a fracturing treatment or an acid stimulation treatment), conformance treatments, sand control treatments, consolidating treatments, sealing treatments, or any combination thereof. Additionally, whereas these treating steps are often performed as to previously treated intervals, it is expressly recognized that previously bypassed intervals may be treated in a similar manner. Fluids for these treatments may be provided by a centralized well treatment fluid center such as that depicted in FIG. 17 generally shown as 1700

Figure 40A:
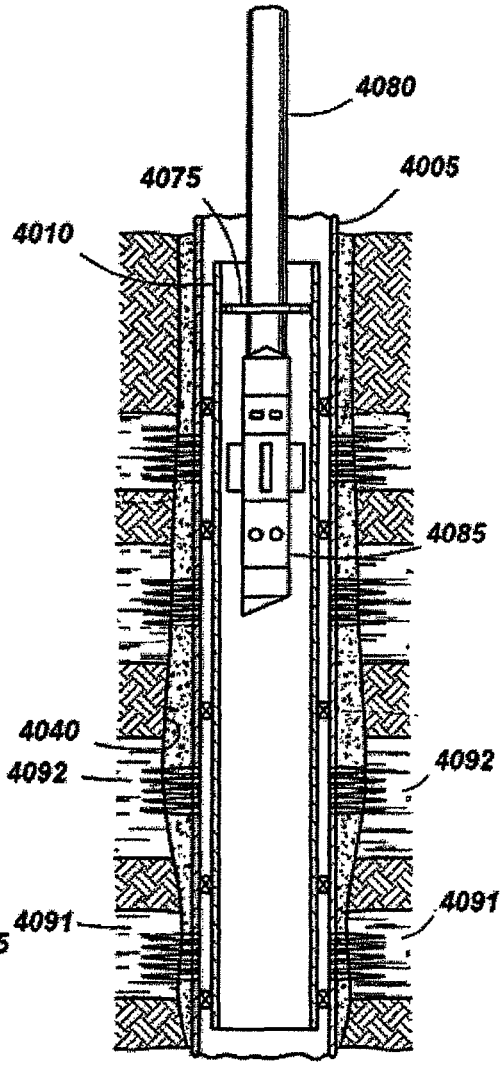
FIG. 40A illustrates placement of an isolation assembly into a well bore via a jointed pipe attached to a hydrajetting tool so as to allow a one trip placement and treatment of a multiple interval well bore in accordance with one embodiment of the present invention.

FIG. 40A illustrates placement of an isolation assembly into a well bore via a jointed pipe attached to a hydrajetting tool so as to allow a one trip placement and treatment of a multiple interval well bore in accordance with one embodiment of the present invention. One of the advantages of this implementation of the present invention includes the ability to set isolation assembly and perform perforation and treatment operations in a single trip in well bore 4040. Jointed pipe 4080 may be used to introduce liner 4010 into well bore 4040. More particularly, jointed pipe 4080 is attached to liner 4010 via attachment 4075. After liner 4010 is introduced into well bore 4040, swellable packers may be allowed to swell to create a fluid tight seal against casing string 4005 so as to isolate or reisolate the well bore intervals of well bore 4040. Once liner 4010 is set in place, attachment 4075 may be sheared or otherwise disconnected from liner 4010.

Figure 40B:
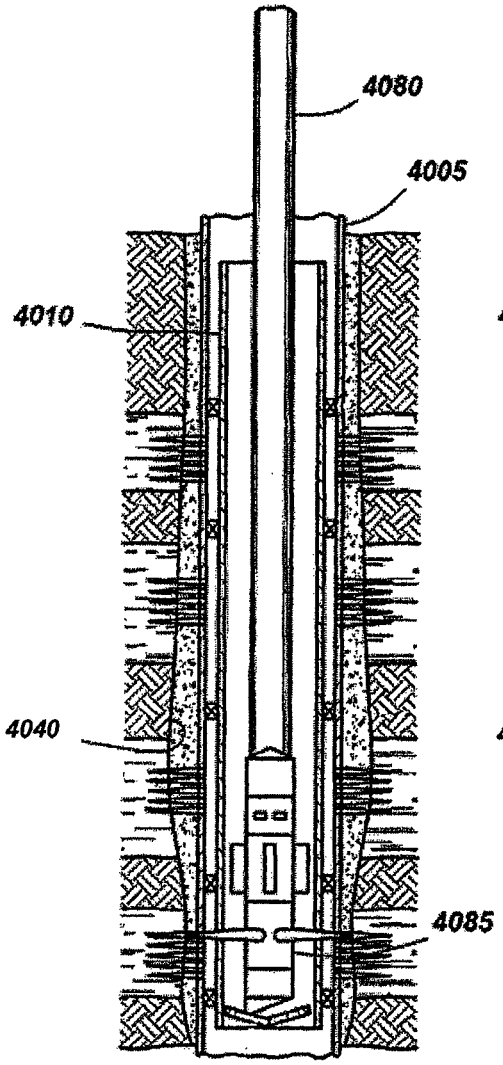
FIG. 40B illustrates a hydrajetting tool lowered to a well bore interval to be treated, the hydrajetting tool perforating the liner and initiating or enhancing perforations into a selected interval of a well bore.
Figure 40C:
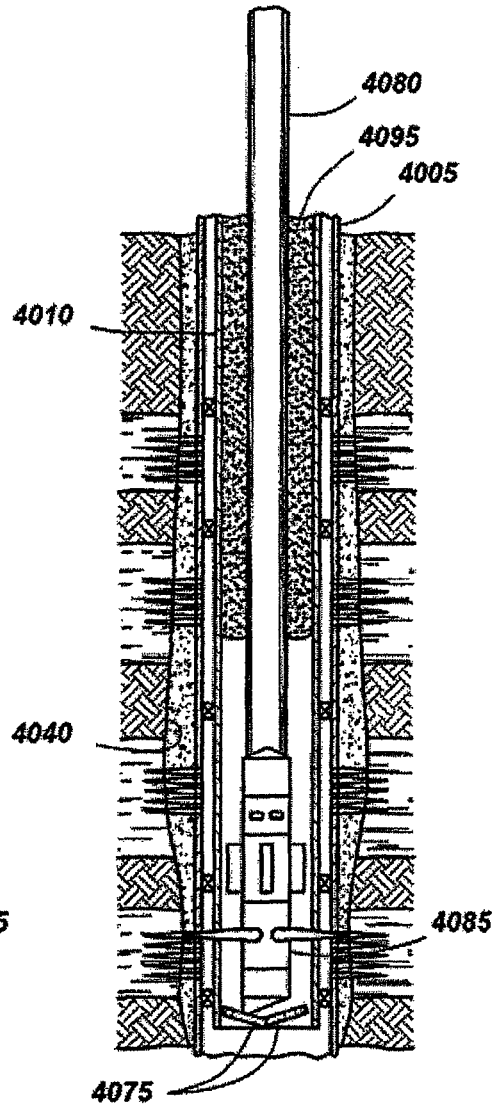
FIG. 40C illustrates the introduction of a fluid treatment to treat a selected interval of a multiple interval well bore.
Figure 40D:
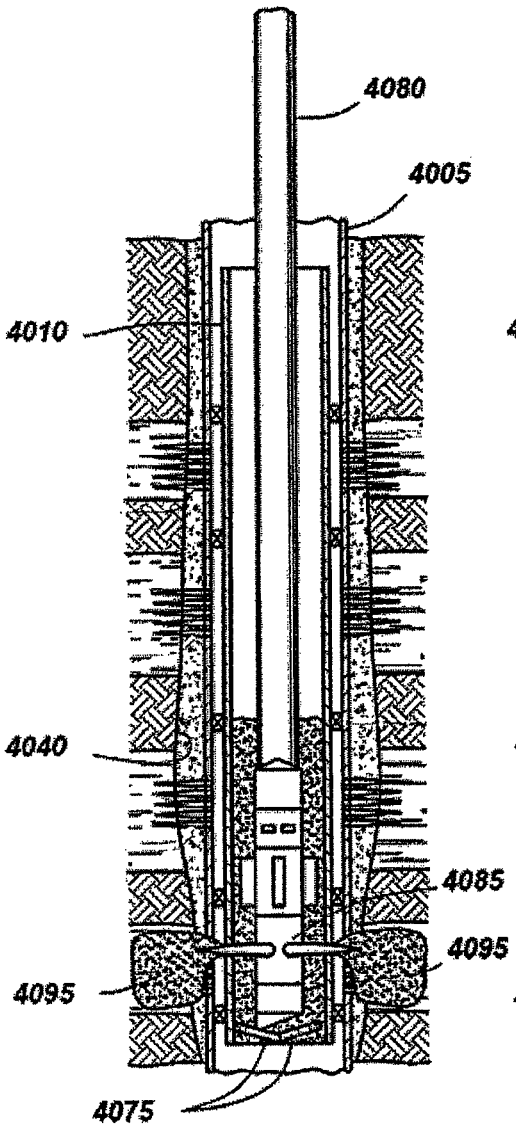
FIG. 40D illustrations treatment of a selected interval of a multiple interval well bore with a fluid treatment.
Figure 40E:
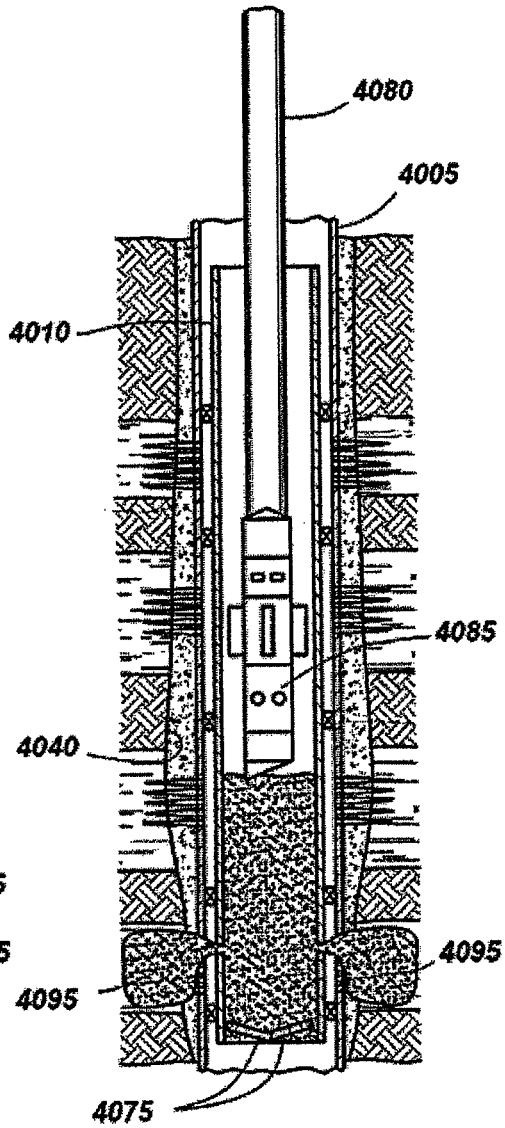
FIG. 40E illustrates hydrajetting tool retracted from first well bore interval 591 to above a diversion proppant plug of fracturing treatment.
Figure 40F:
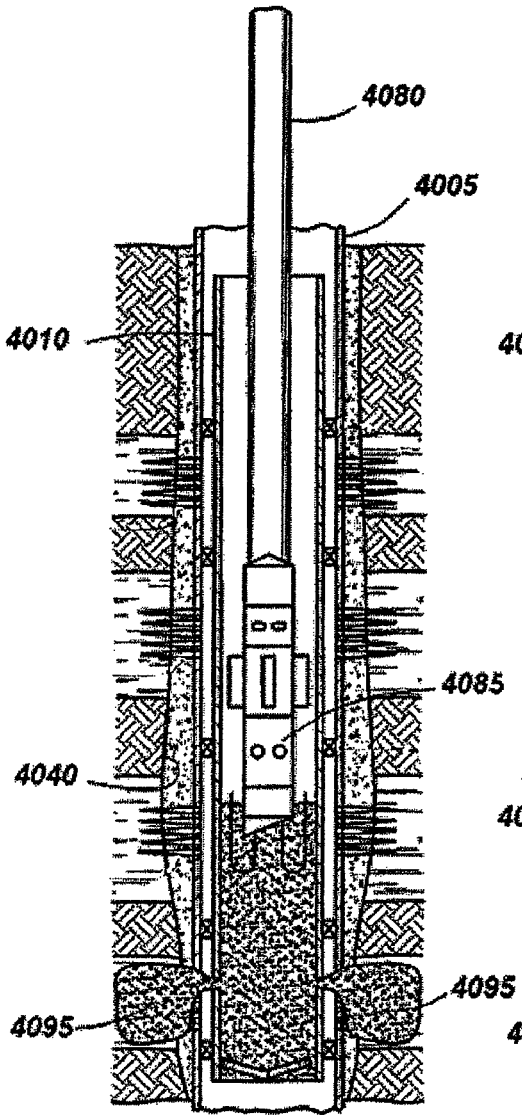
FIG. 40F illustrates excess proppant being removed by reversing out a proppant diversion plug to allow treatment of another selected well bore interval of interest.

Once attachment 4075 is sheared or otherwise disconnected, hydrajetting tool 4085 may be lowered to a well bore interval to be treated, in this case, first well bore interval 4091 as illustrated in FIG. 40B. As depicted here, hydrajetting tool 4085 may be used to perforate casing string 4005 and initiate or enhance perforations into first well bore interval 4091. Then, as illustrated in FIG. 40C, a fluid treatment (in this case, fracturing treatment 4095) may be introduced into liner 4010 to treat first well bore interval 4091. The fluid treatment may be provided by a centralized well treatment fluid center such as that depicted in FIG. 17 generally shown as 1700. In FIG. 40D, fracturing treatment 4095 is shown being applied to first well bore interval 4091. At some point, after perforating first well bore interval 4091 with hydrajetting tool 4085, hydrajetting tool 4085 may be retracted to a point above the anticipated top of the diversion proppant plug of the fracturing treatment. In FIG. 40E, hydrajetting tool 4085 is retracted from first well bore interval 4091 above the diversion proppant plug of fracturing treatment 4095. In FIG. 40F, excess proppant is removed by reversing out the proppant diversion plug to allow treatment of the next well bore interval of interest.

Figure 40G:
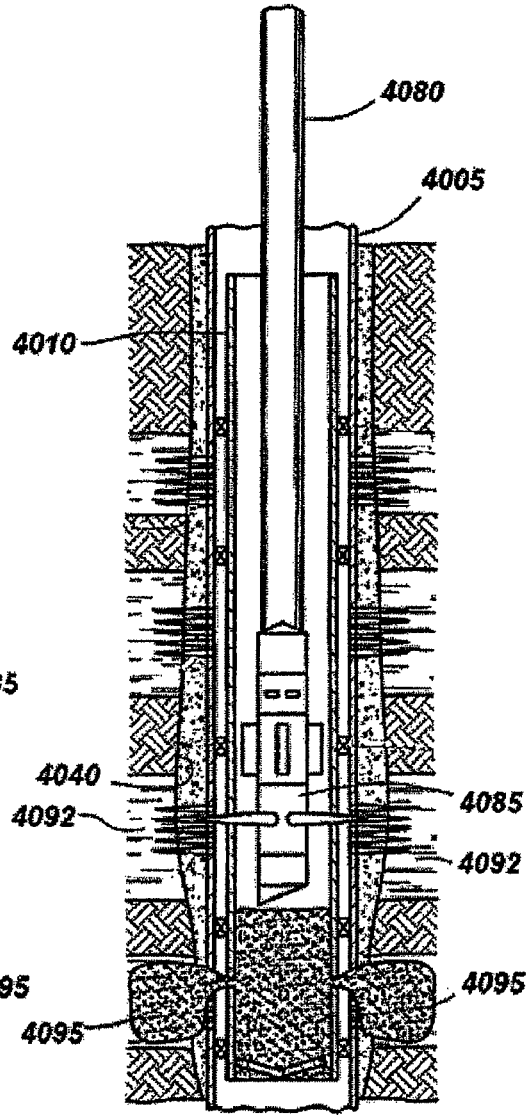
FIG. 40G illustrates a hydrajetting tool perforating the liner and initiating or enhancing perforations into a subsequent selected interval so as to allow treatment thereof.

After removal of the excess proppant, hydrajetting tool 4085 may be used to perforate casing string 4005 and initiate or enhance perforations into second well bore interval 4092 as illustrated in FIG. 40G. Fluid treatments may then be applied to second well bore interval 4092. The fluid treatments may be provided by a centralized well treatment fluid center such as that depicted in FIG. 17 generally shown as 1700. In a like manner, other well bore intervals of interest may be perforated and treated or retreated as desired. Additionally, it is expressly recognized that bypassed intervals between two producing intervals may likewise be perforated and treated as well.

As a final step in the process the tubing may be lowered while reverse circulating to remove the proppant plug diversion and allow production from the newly perforated and stimulated intervals.

Traditionally fracturing relies on sophisticated and complex bottomhole assemblies. Associated with this traditional method of fracturing are some high risk processes in order to achieve multi-interval fracturing. One major risk factor associated with traditional fracturing is early screen-outs. By implementing the sleeves and isolation assembly depicted in FIGS. 41-45, some of these risks may be reduced or eliminated as a single trip into the well provides for multi-interval fracturing operations and a screened completion after all intervals have been stimulated.

Figure 41A:
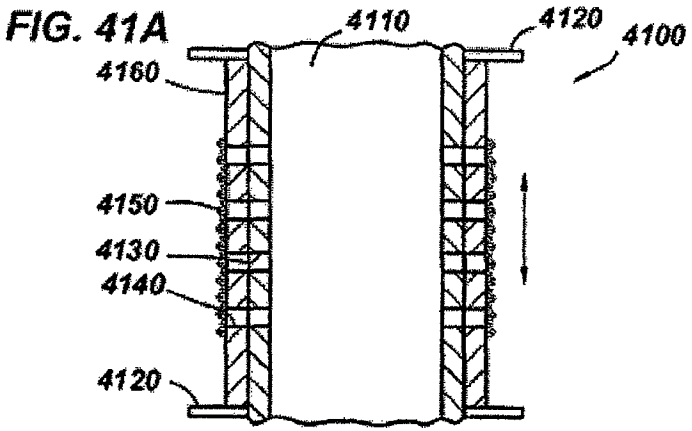
FIG. 41A illustrates a cross-sectional view of a screen-wrapped sleeve in a well bore in an open to screen position.

FIGS. 41A-41D illustrate, generally, cross-sectional views of a screen-wrapped sleeve in a well bore 4100. In FIG. 41A, screen-wrapped sleeve 4160 is a sleeve with a screen 4150 or other acceptable fines mitigation device covering ports 4140. The ports 4140 allow for fluid, such as production fluid, to flow through screens 4150 of the screen-wrapped sleeves 4160. The production fluid may be provided by a centralized well treatment fluid center such as that depicted in FIG. 17 generally shown as 1700. In certain embodiments, screens 4150 may be disposed about the outside of the screen-wrapped sleeve 4160 so as to provide a screened covering all ports 4140. In other example embodiments, screens 4150 may be placed within the openings of the ports 4140 or in any other manner suitable for preventing proppant flowback through the screen-wrapped sleeves 4160. The screens 4150 act to prevent proppant flowback or sand production. Providing prevention of proppant flowback issues is of special importance in the North Sea, Western Africa, and the Gulf Coast. For instance, in the North Sea, conductivity endurance materials are black-listed. Providing a solution to proppant flowback issues leads to better fractured completions and addresses environmental concerns.

To prevent the walls of the well bore from damaging the screens 4150, one or more centralizers 4120 may be disposed about the screen-wrapped sleeve 4160 or liner 4110. As shown in FIG. 41A, centralizers 4120 may be positioned above and below the screen-wrapped sleeve 4160. In certain embodiments, one or more centralizers 4120 may be positioned only above, only below, above and below, or any location along the liner 4110 or the screen-wrapped sleeve 4160.

Screen-wrapped sleeve 4160 is disposed around a liner 4110 as part of an isolation assembly discussed below with respect to FIGS. 41A and 41B. In certain embodiments, liner 4110 may have preformed ports 4130. In other embodiments, ports 4130 may be formed after the isolation assembly has been inserted into the well bore.

As indicated in FIG. 41A, screen-wrapped sleeve 4160 may be displaced longitudinally a selected spacing along the liner 4110 to an open to screen position so as to align ports 4130 and 4140 with each other. In certain embodiments, adjusting the screen-wrapped sleeve 4160 to an open to screen position allows fluids to flow from the well bore through the ports 4140 of the screen-wrapped sleeve 4160 and through the ports 4130 and into the liner 4110. In one embodiment, production fluids are received into the liner 4110 from ports 4140 and 4130 from a selected interval. Multiple selected intervals may receive fluids at the same time. The multiple selected intervals may be contiguous, non-contiguous or any combination thereof.

Figure 41B:
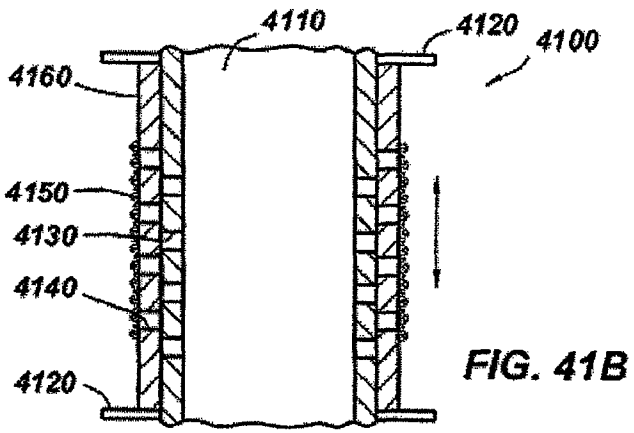
FIG. 41B illustrates a cross-sectional view of a screen-wrapped sleeve in a well bore in a closed position.
Figure 41C:
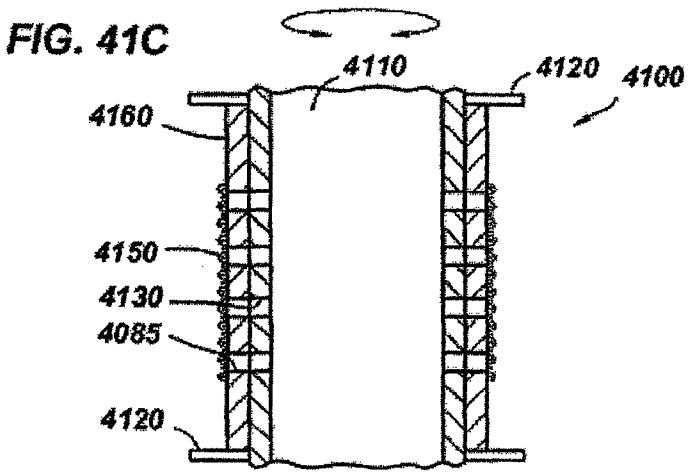
FIG. 41C illustrates a cross-sectional view of a screen-wrapped sleeve in a well bore in an open to screen position.
Figure 41D:
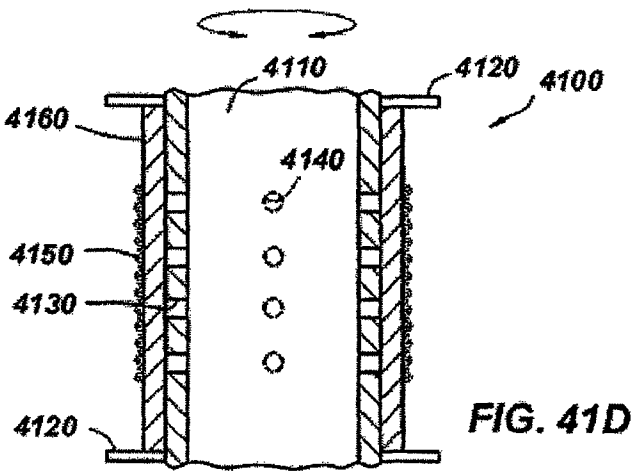
FIG. 41D illustrates a cross-sectional view of a screen-wrapped sleeve in a well bore in a closed position.

FIG. 41B illustrates the screen-wrapped sleeve 4160 displaced longitudinally along the liner 4110 to a closed position (ports 4130 and 4140 are not aligned with each other) preventing any fluid from the well bore to flow through ports 4140 and 4130 and into the liner 4110. In certain embodiments and as shown in FIG. 41C, the screen-wrapped sleeve 4160 is displaced to an open to screen position by rotating the screen-wrapped sleeve 4160 in a clockwise or counter-clockwise manner so as to allow fluid to flow from the well bore through ports 4140 and 4130 and into liner 4110. FIG. 41D illustrates the screen-wrapped sleeve 4160 rotated in a clockwise or counter-clockwise manner to a closed position preventing any fluid from the well bore to flow through ports 4140 and 4130 and into the liner 4110. In one example embodiment, screen-wrapped sleeve 4160 may be displaced by actuating a shifting tool to adjust positioning of the screen-wrapped sleeve 4160.

Figure 42A:
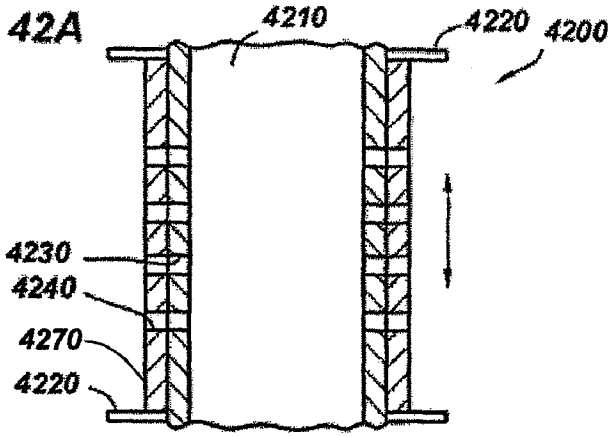
FIG. 42A illustrates a cross-sectional view of a sleeve in a well bore in an open position.

FIGS. 42A-42D illustrate, generally, cross-sectional views of a sleeve in a well bore 4200. In FIG. 42A, sleeve 4270 is a sleeve with ports 4240. A screen is not necessary for sleeve 4270. Unlike the screen-wrapped sleeves 4170 there is no need to prevent proppant flowback as sleeve 4270 allows for the flowing of fluid out of the liner and into the well bore at the selected interval. The fluid may be provided by a centralized well treatment fluid center such as that depicted in FIG. 17 generally shown as 1700. Sleeve 4270 is disposed around a liner 4210 as part of an isolation assembly discussed below with respect to FIGS. 45A and 45B. In certain embodiments, liner 4210 may have preformed ports 4230. In other embodiments, ports 4230 may be formed after the liner 4210 has been inserted into the well bore.

To prevent the walls of the well bore from damaging the screens of screen-wrapped sleeves (not shown) such as screen-wrapped sleeves 4160 of FIG. 41, one or more centralizers 4220 may be disposed about the sleeve 4270 or liner 4210. As shown in FIG. 42A, centralizers 4220 are positioned above and below the sleeve 4270. In certain embodiments, one or more centralizers 4220 may be positioned only above, only below, above and below, or any location along the liner 4210 or the sleeve 4270.

As indicated in FIG. 42A, sleeve 4270 may be displaced longitudinally a selected spacing along the liner 4210 to an open position so as to align ports 4230 and 4240 with each other. In certain embodiments, sleeve 4270 is adjusted to an open position (ports 4230 and 4240 are aligned with each other) allowing fluids to flow through the liner 4210 and through ports 4230 and 4240 into the well bore. For instance, fracturing fluids may be flowed through ports 4230 and 4240 so as to stimulate a selected interval. Multiple selected intervals may be stimulated at the same time. The multiple selected intervals may be contiguous, non-contiguous or any combination thereof.

Figure 42B:
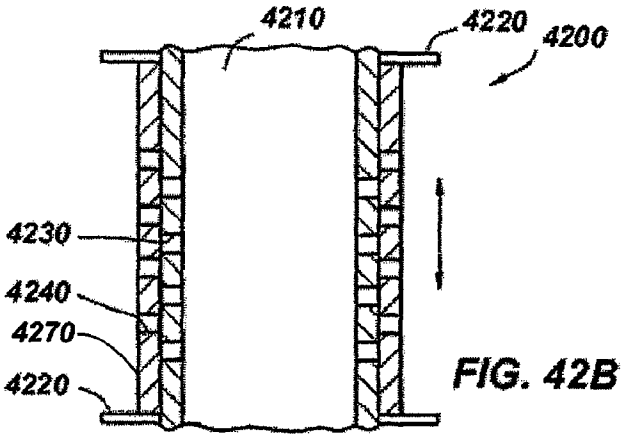
FIG. 42B illustrates a cross-sectional view of a sleeve in a well bore in a closed position.

FIG. 42B illustrates the sleeve 4270 displaced longitudinally along the liner 4210 to a closed position (ports 4230 and 4240 are not aligned with each other). When sleeve 4270 is adjusted to the closed position, fluids are prevented from flowing through the liner 4210 and through ports 4230 and 4250 and into the well bore. In the closed position, sleeve 4270 reestablishes zonal isolation of the selected interval.

Figure 42C:
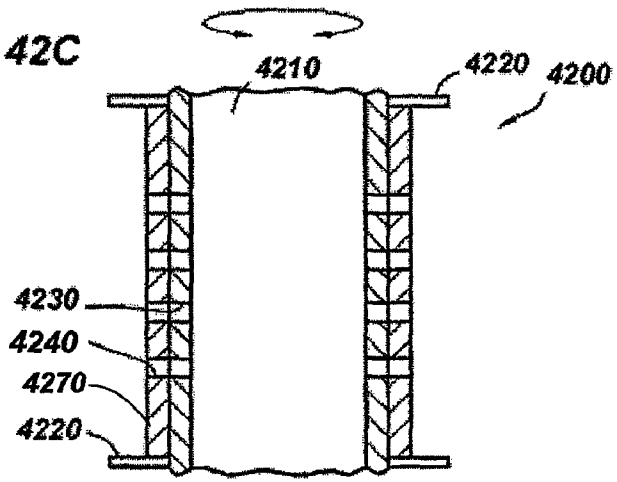
FIG. 42C illustrates a cross-sectional view of a sleeve in a well bore in an open position.
Figure 42D:
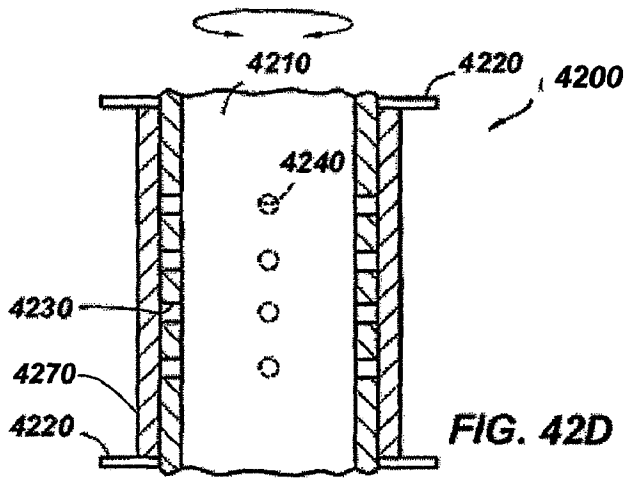
FIG. 42D illustrates a cross-sectional view of a sleeve in a well bore in a closed position.

In certain embodiments and as shown in FIG. 42C, the sleeve 4270 is displaced about the liner 4210 to an open position by rotating the sleeve 4270 in a clockwise or counter-clockwise manner so as to allow fluid to flow from the liner 4210 through ports 4230 and 4240 and into the well bore. FIG. 42D illustrates the sleeve 4270 rotated in a clockwise or counter-clockwise manner to a closed position preventing any fluid from the liner 4210 to flow through ports 4230 and 4240 and into the well bore. In one example embodiment, sleeve 4270 may be displaced by actuating a shifting tool to adjust positioning of the sleeve 4270.

Figure 43A:
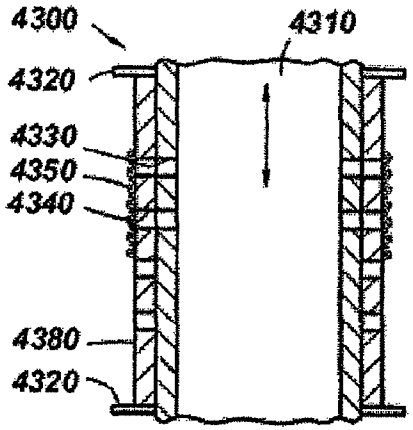
FIG. 43A illustrates a cross-sectional view of a sleeve in a well bore in an open to screen position.

In certain embodiments the functionality of screen-wrapped sleeve 4160 and the sleeve 4270 may be combined as illustrated in FIGS. 43A-43F. FIGS. 43A-43F depict, generally, cross-sectional views of a sleeve in a well bore 4300 having a screened section, a non-screened section, and a non-screened section with openings. Such a multi-functional sleeve is depicted in FIG. 43A as sleeve 4380. Sleeve 4380 may have ports 4340. Some of the ports 4340 may be covered with a screen 4350. The screened portion of sleeve 4380 operates in a similar manner to the screen-wrapped sleeve 4160 of FIG. 41. The non-screened portion of sleeve 4380 operates in a similar manner to sleeve 4270. Sleeve 4380 is disposed around a liner 4310 as part of an isolation assembly discussed with respect to FIGS. 45A and 45B.

Figure 43B:
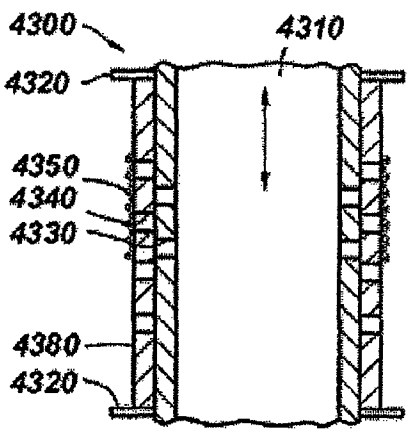
FIG. 43B illustrates a cross-sectional view of a sleeve in a well bore in a closed position.
Figure 43C:
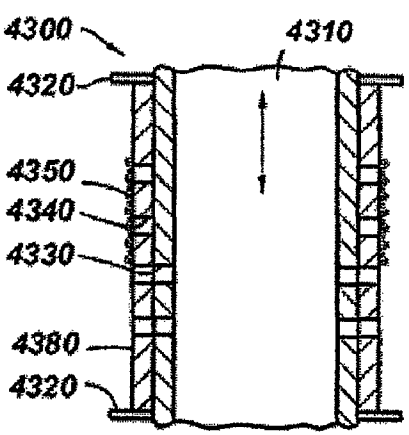
FIG. 43C illustrates a cross-sectional view of a sleeve in a well bore in an open position.

In certain embodiments, liner 4310 may have preformed ports 4330. In other embodiments, ports 4330 may be formed after the liner 4310 has been inserted into the well bore. To prevent the walls of the well bore from damaging the screens 4350, one or more centralizers 4320 may be disposed about the sleeve 4380 or liner 4310. As shown in FIG. 43A, centralizers 4320 are positioned above and below the sleeve 4380. In certain embodiments, one or more centralizers 4320 may be positioned only above, only below, above and below, or any location along the liner 4310 or the sleeve 4380. As indicated in FIG. 43A, sleeve 4380 may be displaced longitudinally a selected spacing along the liner 4310 to an open to screen position so as to align ports 4330 and 4340 with each other. In certain embodiments, sleeve 4380 is adjusted to an open to screen position which allows fluids to flow from the well bore through the ports 4340 of the sleeve 4380 and through the ports 4330 of the liner 4310. The fluids may be provided by a centralized well treatment fluid center such as that depicted in FIG. 17 generally shown as 1700. FIG. 43B illustrates the sleeve 4380 displaced longitudinally along the liner 4310 to a closed position preventing any fluid from the well bore to flow through ports 4340 and 4330 and into the liner 4310 and also prevents fluids from flowing through the liner 4310 and out ports 4330 and 4340. FIG. 43C illustrates the sleeve 4380 displaced longitudinally along the liner 4310 to an open position to allow fluid to flow from the liner 4310 and through ports 4330 and 4340 and into the well bore.

Figure 43D:
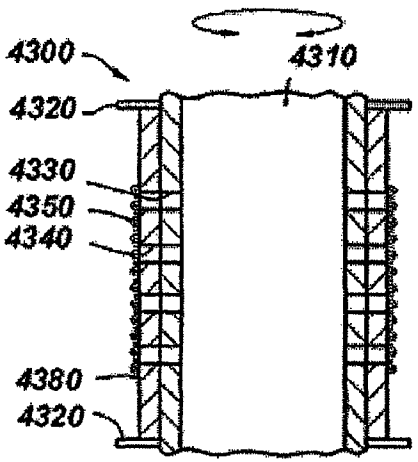
FIG. 43D illustrates a cross-sectional view of a sleeve in a well bore in an open to sleeve position.
Figure 43E:
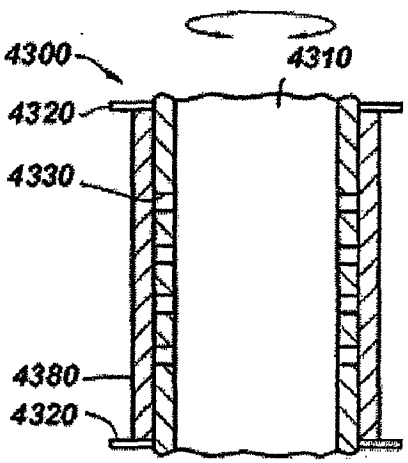
FIG. 43E illustrates a cross-sectional view of a sleeve in a well bore in a closed position.
Figure 43F:
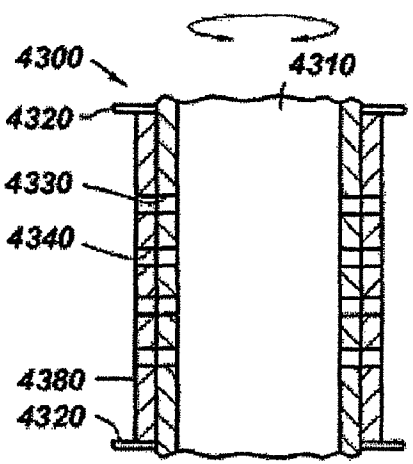
FIG. 43F illustrates a cross-sectional view of a sleeve in a well bore in an open position.

In certain embodiments and as shown in FIG. 43D, the sleeve 4380 is displaced about the liner 4310 to an open to screen position by rotating the sleeve 4380 in a clockwise or counter-clockwise manner so as to allow fluid to flow from the well bore and through ports 4340 and 4330 and into liner 4310. FIG. 43E illustrates the sleeve 4380 rotated in a clockwise or counter-clockwise manner to a closed position preventing any fluid from the well bore to flow through ports 4340 and 4330 and into the liner 4310 and also prevents fluids from flowing through the liner 4310 and out ports 4330 and 4340. FIG. 43F illustrates the sleeve 4380 actuated to displace the sleeve 4380 about the liner 4310 to an open position so as to allow fluid to flow from the liner 4310 through ports 4330 and 4340 and into the well bore. In one example embodiment, sleeve 4380 may be displaced by actuating a shifting tool to adjust positioning of the sleeve 4380.

Figure 44B:
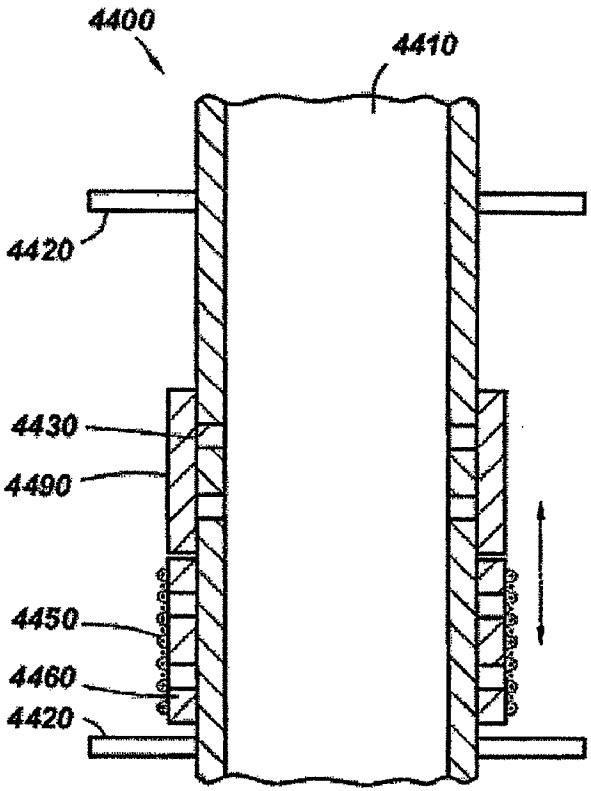
FIG. 44B illustrates a cross-sectional view of a sleeve in a well bore in a closed position.
Figure 44A:
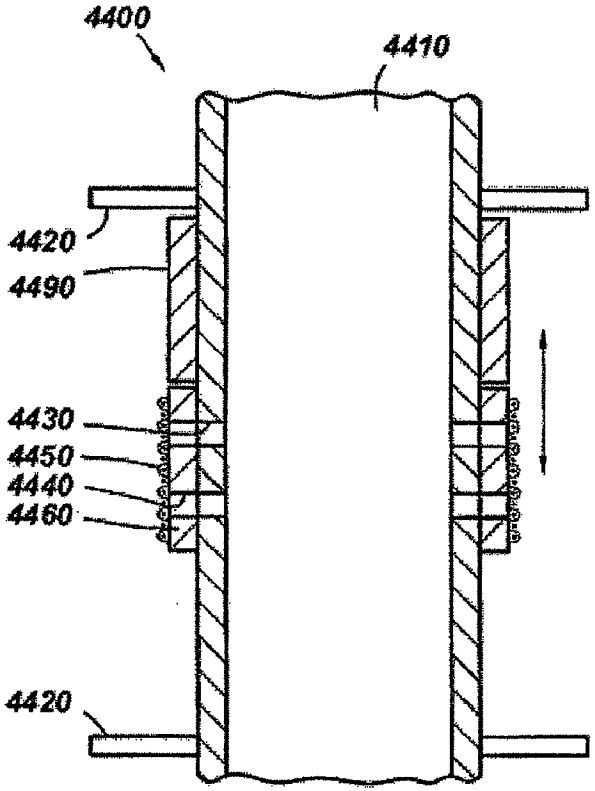
FIG. 44A illustrates a cross-sectional view of a sleeve in a well bore in an open position.

FIGS. 44A-44B illustrate, generally, cross-sectional views of a sleeve in a well bore 4400. In certain embodiments, one or more sleeves 4470 and one or more sleeves 4460 may be disposed about a liner 4410. In FIG. 44A, screen-wrapped sleeve 4460 is a sleeve with a screen 4450 or other acceptable fines mitigation device covering ports 4440 of the sleeve 4460. In FIG. 44A, sleeve 4490 is a sleeve without any ports. Sleeve 4460 and sleeve 4490 are disposed around a liner 4410 as part of an isolation assembly discussed with respect to FIGS. 44A and 44B. In certain embodiments, liner 4410 may have preformed ports 4430. In other embodiments, ports 4430 may be formed after the liner 4410 has been inserted into the well bore. To prevent the walls of the well bore from damaging the screens 4450, one or more centralizers 4420 may be disposed about the sleeve 4460 or liner 4410. As shown in FIG. 44A, centralizers 4420 are positioned above and below the sleeve 4460. In certain embodiments, one or more centralizers 4420 may be positioned only above, only below, above and below, or any location along the liner 4410 or the sleeve 4460. As depicted in FIG. 44A, screen-wrapped sleeve 4460 and sleeve 4490 may be displaced longitudinally a selected spacing along the liner 4410 to an open to screen position so as to align ports 4430 of the liner 4410 with ports 4440 of the screen-wrapped sleeve 4460. In certain embodiments, an open to screen position allows fluids to flow from the well bore through the ports 4440 of the sleeve 4460 and through the ports 4430 of the liner 4410. The fluids may be provided by a centralized well treatment fluid center such as that depicted in FIG. 17 generally shown as 1700. FIG. 44B illustrates a solid sleeve 4490, with no ports, actuated to displace longitudinally along the liner 4410 to prevent any fluid from the well bore to flow through ports 4430 and into the liner 4410 and also to prevent fluids from flowing through the liner 4410 and out ports 4430.

Figure 45A:
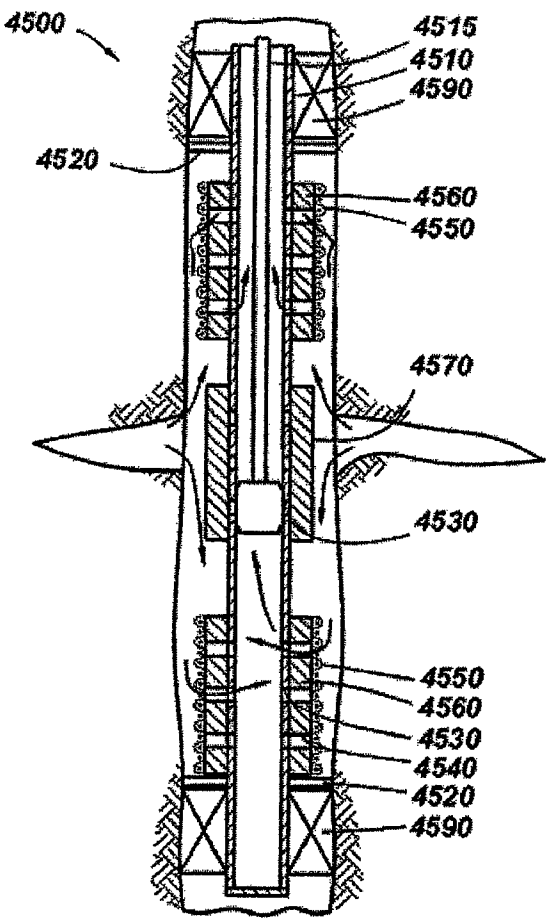
FIG. 45A illustrates a cross-sectional view of an isolation assembly in a well bore.
Figure 45B:
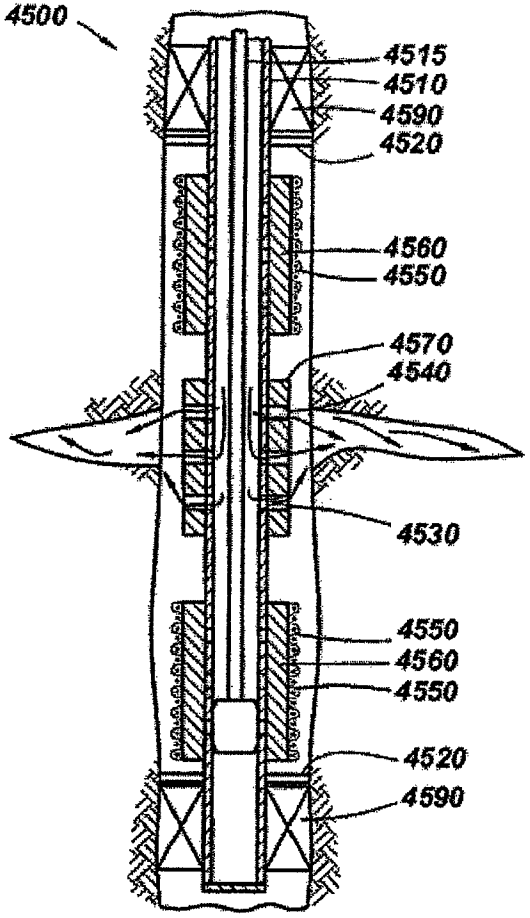
FIG. 45B illustrates a cross-sectional view of an isolation assembly in a well bore.

FIGS. 45A and 45B illustrate, generally, cross-sectional views of an isolation assembly 4500 in a well bore so as to allow a one trip placement and treatment of a multiple interval well bore in accordance with one embodiment of the present invention. One of the advantages of this implementation of the present invention includes the ability to introduce isolation assembly 4500 downhole and perform treatment and production operations in a single trip in the well bore. One or more sleeves 4570 and one or more screen-wrapped sleeves 4560 are disposed around liner 4510. Sleeves 4570 have one or more ports 4540 (shown in FIG. 45B). Sleeves 4570 may function similarly to sleeves 4270. Screen-wrapped sleeves 4560 have one or more ports 4540 covered by a screen 4550. Screen-wrapped sleeves 4560 may function similarly to screen-wrapped sleeves 4160. In one embodiment, sleeves 4570 and screen-wrapped sleeves 4560 may be replaced with a sleeve having the functionality of both screen-wrapped sleeves 4560 and sleeves 4570 such as sleeve 4380 depicted in FIG. 43.

One or more swellable packers 4590 are also disposed around liner 4510. Also, to prevent the walls of the well bore from damaging the screens 4550, one or more centralizers 4520 may be disposed about the sleeve 4560 or liner 4510. As shown in FIGS. 45A and 45B, centralizers 4520 are positioned above and below the sleeves 4560. In certain embodiments, one or more centralizers 4520 may be positioned only above, only below, above and below, or any location along the liner 4510 or the sleeve 4580.

The method of selecting, stimulating, and producing hydrocarbons from an interval or zone using an isolation assembly will now be described with reference to FIG. 45A and FIG. 45B. First, the isolation assembly 4500 is introduced into the well bore. Second, the swellable packers 4590 may be allowed to swell to create a fluid tight seal so as to isolate or reisolate selected intervals of the well bore. The swellable packers 4590 may be formed of a variety of materials such as those stated for swellable packer 3620. Any method generally known to one of ordinary skill in the art may be used to swell the swellable packers 4590 as well as those discussed with respect to FIG. 37. For illustration purposes only, FIGS. 45A and 45B depict a selected interval between swellable packers 4590 with two screen-wrapped sleeves 4560 and one sleeve 4570. In other embodiments, a selected interval isolated by swellable packers 4590 may include any number of screen-wrapped sleeves 4560 and any number of sleeves 4570. Other example embodiments may also include multiple selected intervals isolated by multiple swellable packers 4590. Another example embodiment may include a sleeve with the functional characteristics of both 4560 and 4570 as depicted in FIGS. 43A-43D.

Next, a shifting tool 4515 may be introduced into liner 4510. As depicted here, the shifting tool 4515 may be actuated to displace the sleeves 4570 and screen-wrapped sleeves 4560 about the liner 4510. Displacement or adjustment of position of sleeves 4570 and screen-wrapped sleeves 4560 may occur longitudinally along the liner 4510 or rotationally about the liner 4510 as described in FIGS. 40-44. The shifting tool 4515 may be deployed within tubing, coiled tubing, wireline, drill-pipe or on any other acceptable mechanism.

Once a selected interval has been isolated, the shifting tool 4515 actuates the sleeve 4570 to adjust positioning of the sleeve 4570 to an open position. Screen-wrapped sleeves 4560 are in a closed position to prevent any fluid from flowing back into the liner 4510. The well bore is treated with fluid that flows down the liner 4510, through ports 4530 and 4540 and out into the well bore. The fluid may be provided by a centralized well treatment fluid center such as that depicted in FIG. 17 generally shown as 1700. In one example embodiment, the selected intervals are treated with fracturing fluid so as to stimulate the well bore.

The swellable packers 4590 prevent any fluid from flowing outside the selected interval so as to form zonal isolation of the selected interval. After treatment, the sleeve 4570 is actuated by the shifting tool 4515 to a closed position. Fluid treatments may then be applied to other selected intervals in like manner. In another embodiment, multiple selected intervals isolated by multiple swellable packers 4590 may be treated simultaneously by actuating multiple sleeves 4570 in the multiple selected intervals to an open position and then flowing the treatment fluid. Multiple selected intervals may be contiguous, non-contiguous or a combination thereof.

Once the selected intervals have been treated, sleeves 4570 may be actuated to a closed position in order to reestablish zonal isolation of the selected interval and to allow for further operations of the well bore. For instance, the shifting tool 4515 may actuate screen-wrapped sleeves 4560 to an open or open to screen position in a selected interval as depicted in FIG. 45B. Fluid flows from the well bore through ports 4540 and 4530 and into the liner 4510. In one example embodiment the fluid is production fluid. In another embodiment, multiple selected intervals isolated by multiple swellable packers 4590 with one or more screen-wrapped sleeves 4560 are actuated to an open position so as to allow fluid to flow through ports 4540 and 4530 and into liner 4510 from the multiple selected intervals. Again, multiple selected intervals need not be contiguous.

Screen-wrapped sleeves 4560 may be actuated to a closed position to allow for further operations of the well bore. In one example embodiment, refracturing of the well bore may be initiated by actuating the sleeves 4570 to an open position so as to allow treatment of the well bore. In another embodiment, new selected intervals may be chosen for stimulation and receipt of production fluids.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method of inducing multiple fractures in a subterranean formation surrounding a plurality of wells within a region by utilizing a centralized well treatment fluid center, comprising the steps of:

configuring a centralized well treatment fluid center for fracturing a plurality of wells, wherein the centralized well treatment fluid center is adapted to manufacture and pump a well treatment fluid;

inducing a fracture at a first well location by flowing the well treatment fluid from the centralized well treatment fluid center to the first well location, wherein the fracture at the first well location alters one or more first well location stress fields in the subterranean formation;

measuring one or more first well location effects of the one or more first well location stress fields from the fracture at the first well location;

determining a time delay before inducing a fracture at a second well location, wherein the time delay is determined based, at least in part, on at least one of the one or more first well location effects;

selecting the second well location for fracturing, wherein the selection of the second well location is based, at least in part, on at least one of the one or more first well location effects; and inducing the fracture at the second well location by flowing the well treatment fluid from the centralized well treatment fluid center to the second well location, wherein the fracture at the second well location is induced after the time delay and the fracture at the second well location alters one or more second well location stress fields in the subterranean formation.

2. The method according to claim 1, further comprising the steps of:

selecting a third well location for fracturing, wherein the selection of the third well location is based, at least in part, on at least one of the one or more first well location effects and at least one of the one or more second well location effects; and inducing a fracture at the third well location by flowing well treatment fluid from the centralized well treatment fluid center to the third well location, wherein the fracture at the third well location and the fracture at the second well location are induced substantially simultaneously with each other and the fracture at the third well location alters one or more third well location stress fields in the subterranean formation.

3. The method according to claim 1, further comprising the steps of:

measuring one or more second well location effects of the one or more second well location stress fields from the fracture at the second well location;

determining a second time delay, wherein the second time delay is based, at least in part, on at least one of the one or more second well location effects;

selecting one or more subsequent well locations based, at least in part, on at least one of the one or more first well location effects and at least one of the one or more second well location effects; and inducing fractures at the one or more subsequent well locations after the second time delay at the one or more subsequent well locations by flowing well treatment fluid from the centralized well treatment fluid center to the one or more subsequent well locations, wherein the one or more subsequent fractures alter one or more subsequent well location stress fields in the subterranean formation.

4. The method according to claim 1, wherein the fracture at the first well location is a first fracture, further comprising the step of:

inducing an additional fracture at the first well location by flowing well treatment fluid from the centralized well treatment fluid center to the first well location, wherein an orientation line of the additional fracture has an angular disposition with an orientation line of the first fracture and the additional fracture alters the one or more first well location stress fields in the subterranean formation.

5. The method according to claim 4, wherein the orientation line of the additional fracture is based, at least in part, on at least one of the one or more first well location effects from the first fracture.

6. The method according to claim 4, further comprising the step of:

measuring one or more combined effects of one or more combined stress fields in a region, wherein the one or more combined effects are based, at least in part, on at least one of the one or more first well location effects and at least one of the one or more second well location effects, wherein the orientation line of the additional fracture is based, at least in part, on at least one of the one or more combined effects.

7. The method according to claim 1, wherein:

at least one of the fracture at the first well location and the fracture at the second well location is induced by using one or more isolation assembly tools and the one or more isolation assembly tools are adapted to provide multi-interval fracturing completion.

8. The method according to claim 7, wherein the one or more isolation assembly tools comprise one or more sleeves.

9. The method according to claim 1, further comprising the steps of:

determining a first angular direction of the first well location stress fields after the fracture at the first well location is induced;

determining an additional fracture orientation line so as to alter the first well location stress fields at least thirty degrees from the first angular direction after an additional fracture is induced, wherein the additional fracture orientation line has an angular disposition with an orientation line of the fracture at the first well location; and inducing the additional fracture at a third well location by flowing well treatment fluid from the centralized well treatment fluid center to the third well location.

10. The method according to claim 1, further comprising the steps of:

configuring the centralized well treatment fluid center to produce the well treatment fluid;

configuring the centralized well treatment fluid center to receive a first production fluid; and receiving from the first well location the first production fluid.

11. The method according to claim 10, further comprising the steps of:

configuring the centralized well treatment fluid center to receive the well treatment fluid from the first well location;

configuring the centralized well treatment fluid center to clean the well treatment fluid received from the first well location; and configuring the centralized well treatment fluid center to recondition the well treatment fluid received from the first well location.

12. The method according to claim 1, further comprising the steps of:

determining, after each fracture, one or more effects of one or more region stress fields, wherein the one or more effects comprise at least one effect selected from the group consisting of:

a stick-slip velocity of the region stress fields;

a Maxwell creep of the region stress fields;

a pseudo-Maxwell creep of the region stress fields a lapse of time between initiating a subsequent fracture and closure of the subsequent fracture;

a length of fracture of a prior fracture in an outward direction; and a length of closure time of the prior fracture in an inward direction; and determining subsequent time delays for one or more subsequent fractures based, at least in part, on the one or more effects.

13. A system for fracturing a subterranean formation, associated with a region, from a centralized location, the system comprising:

a centralized well treatment fluid center located within a region, wherein the centralized well treatment fluid center is:

adapted to manufacture and pump a well treatment fluid; and configured with a plurality of distribution lines for pumping the well treatment fluid, wherein the plurality of distribution lines are adapted to flow a well treatment fluid;

a first downhole conveyance coupled to at least one of the plurality of distribution lines, wherein the first downhole conveyance is at least partially disposed in a first wellbore;

a second downhole conveyance coupled to at least one of the plurality of distribution lines, wherein the second downhole conveyance is at least partially disposed in a second wellbore;

a first fracturing tool coupled to the first downhole conveyance, wherein the first fracturing tool is adapted to initiate a fracture at about a first fracturing location;

a second fracturing tool coupled to the second downhole conveyance, wherein the second fracturing tool is adapted to initiate a fracture at about a second fracturing location;

one or more region stress field sensors disposed about the first fracturing location and the second fracturing location, wherein the one or more region stress field sensors are adapted to measure information from one or more region effects of one or more region stress fields; and a computer comprising one or more processors and a memory, the memory comprising executable instructions that, when executed, cause the one or more processors to:

receive one or more outputs from the one or more region stress field sensors; and determine a time delay between inducing the fracture at about the first fracturing location and inducing the fracture at about the second fracturing location, wherein the time delay is determined based, at least in part, on at least one of the one or more region effects contained in the one or more outputs.

14. The system of claim 13, wherein the first fracturing location and the second fracturing location are at the same well location.

15. The system of claim 13, wherein the first fracturing location and the second fracturing location are at different well locations.

16. The system of claim 13, wherein the centralized well treatment fluid center is adapted to produce, clean, and recondition the well treatment fluid.

17. The system of claim 13, wherein the centralized well treatment fluid center is adapted to receive production fluid from the first well location and the second well location substantially simultaneously with each other.

18. The system of claim 13, wherein an additional fracture is initiated at an angular disposition to the fracture at about the first fracturing location so as to alter angular direction of the region stress fields by at least 30 degrees from the angular direction of the region stress fields after the fracture at about the first fracturing location.

19. The system of claim 13, wherein at least one of the fracture at about the first fracturing location and the fracture at about the second fracturing location is induced by using one or more isolation assembly tools, wherein the one or more isolation assembly tools are adapted to provide multi-interval fracturing completion.

20. The system of claim 19, wherein the one or more isolation assembly tools comprise one or more sleeves.

21. A computer program, stored in a computer readable tangible medium, for initiating multiple fractures from a centralized well treatment fluid center at a plurality of well locations within a region, wherein the initiating of the multiple fractures is at a determined time delay and location, comprising executable instructions that cause at least one processor to:

initiate inducement of a fracture at a first well location by flowing a well treatment fluid from a centralized well treatment fluid center to the first well location, wherein the centralized well treatment is adapted to manufacture and pump the well treatment fluid;

receive one or more first outputs from one or more region stress field sensors after initiating inducement of the fracture at the first well location, wherein:

the one or more region stress field sensors are disposed about the region; and the one or more region stress field sensors are adapted to output one or more effects of one or more region stress fields;

determine a first time delay based, at least in part, on at least one of the one or more region effects contained in the one or more first outputs;

initiate inducement of a fracture at a second well location by flowing the well treatment fluid from the centralized well treatment facility to the second well location, wherein inducement of the fracture at the second well location is initiated after the first time delay and the second well location is determined based, at least in part, on at least one of the one or more first outputs; and receive one or more second outputs from the one or more region stress field sensors after initiating inducement of the fracture at the second well location.

22. The executable instructions of claim 21 that further cause the at least one processor to:

determine a second time delay based, at least in part, on the one or more second outputs; and initiate an additional fracture at the first location by flowing well treatment fluid from the centralized well treatment facility to the first location, wherein the additional facture is initiated after the second time delay.

23. The executable instructions of claim 21 that further cause the at least one processor to:

initiate an additional fracture at the first location from the centralized well treatment facility, wherein the additional fracture is initiated substantially simultaneously with the fracture at the second well location and the additional fracture alters the one or more region stress fields.

24. The executable instructions of claim 21 that further cause the at least one processor to:

determine a first angular direction of the region stress fields after the fracture at the first well location is induced;

determine an additional fracture orientation line so as to alter the region stress fields at least thirty degrees from the first angular direction after an additional fracture is induced, wherein the additional fracture orientation line has an angular disposition with an orientation line of the fracture at the first well location; and initiate inducement of the additional fracture at the first well location by flowing a well treatment fluid from the centralized well treatment fluid center to the first well location, wherein inducement of the additional fracture is at the additional fracture orientation line.

* * * * *